US011878892B2

(12) United States Patent
Knierim et al.

(10) Patent No.: US 11,878,892 B2
(45) Date of Patent: Jan. 23, 2024

(54) LINEAR MEDIA HANDLING SYSTEM AND DEVICES PRODUCED USING THE SAME

(71) Applicant: INFINITY PHYSICS, LLC, Littleton, CO (US)

(72) Inventors: Glenn Auld Knierim, Littleton, CO (US); Mark Douglas Spieker, Littleton, CO (US)

(73) Assignee: INFINITY PHYSICS, LLC, Littleton, CO (US)

( * ) Notice: Subject to any disclaimer, the term of this patent is extended or adjusted under 35 U.S.C. 154(b) by 305 days.

(21) Appl. No.: 17/159,047

(22) Filed: Jan. 26, 2021

(65) Prior Publication Data

US 2021/0229946 A1 Jul. 29, 2021

Related U.S. Application Data

(63) Continuation-in-part of application No. 15/927,877, filed on Mar. 21, 2018, now Pat. No. 10,899,575, (Continued)

(51) Int. Cl.
*B65H 59/00* (2006.01)
*B65H 59/38* (2006.01)
*B65H 59/40* (2006.01)

(52) U.S. Cl.
CPC ..... *B65H 59/385* (2013.01); *B65H 59/40* (2013.01)

(58) Field of Classification Search
CPC ..... B65H 59/385; B65H 59/40; D01B 7/14; D01B 2205/40; D01B 2207/4095; (Continued)

(56) References Cited

U.S. PATENT DOCUMENTS 2,671,495 A 3/1954 Iredell
3,381,459 A 5/1968 Vavvter
(Continued)

FOREIGN PATENT DOCUMENTS

CN 103531303 1/2014
DE 4104087 A1 * 8/1991 ..... B65H 59/36
(Continued)

OTHER PUBLICATIONS

International Search Report and Written Opinion from related PCT/US22/13662, dated Jun. 2022. 19 pages.
(Continued)

*Primary Examiner* — Emmanuel M Marcelo
(74) *Attorney, Agent, or Firm* — FisherBroyles, LLP; Craig W. Mueller

(57) ABSTRACT

An improved system for handling delicate linear media and in particular to a method and apparatus for winding delicate linear media such as superconducting wire or tape or optical fibers onto a spool or former. A combination of direct closed loop control and media routing design facilitates the handling of the delicate media without causing damage. The axial tension in the linear media may be closely controlled during winding by means of feedback control loop using tension measurements to control the rotation speeds of the wind-from and wind-to spools. Further, during winding, the delicate linear media is only exposed to large radius bends with no reverse bending. Finally, output devices and features, commercial or otherwise, made possible by delicate linear media handling are revealed. This includes advanced SC devices and features.

20 Claims, 36 Drawing Sheets

Related U.S. Application Data which is a continuation-in-part of application No. PCT/US2016/053174, filed on Sep. 22, 2016.

(60) Provisional application No. 62/243,966, filed on Oct. 20, 2015, provisional application No. 62/242,393, filed on Oct. 16, 2015, provisional application No. 62/221,910, filed on Sep. 22, 2015.

(58) Field of Classification Search
CPC ..... D01B 2301/15; D01B 2301/5559; D01B 2501/406; D01B 7/02; H01F 41/048
See application file for complete search history.

(56) References Cited

U.S. PATENT DOCUMENTS

| | | | | |
|---|---|---|---|---|
| 3,507,137 | A | 4/1970 | Taleff | |
| 3,701,491 | A | 10/1972 | Brown | |
| 3,833,184 | A | 9/1974 | Hara | |
| 4,022,391 | A | 5/1977 | Stein | |
| 4,347,993 | A | 9/1982 | Leonard | |
| 4,407,062 | A | 10/1983 | Sutcliffe | |
| 4,434,945 | A | 3/1984 | Hamane | |
| 4,459,742 | A | 7/1984 | Banner | |
| 4,463,547 | A | 8/1984 | Young | |
| 4,484,586 | A | 11/1984 | McMickle | |
| 4,546,656 | A | 10/1985 | Grundy | |
| 4,548,085 | A | 10/1985 | Grundy | |
| 4,665,952 | A | 5/1987 | Macemon | |
| 4,671,465 | A | 6/1987 | Lemley | |
| 4,683,919 | A | 8/1987 | Macemon | |
| 4,699,184 | A | 10/1987 | Macemon | |
| 4,750,960 | A | 6/1988 | Bubeck | |
| 4,765,552 | A | 8/1988 | Sugioka | |
| 4,771,961 | A | 9/1988 | Sugioka | |
| 4,773,607 | A | 9/1988 | Missout | |
| 4,928,894 | A | 5/1990 | Ohno | |
| 5,145,052 | A | 9/1992 | Santandrea | |
| 5,315,189 | A | 5/1994 | Neff | |
| 5,421,534 | A | 6/1995 | Arnold | |
| 5,505,398 | A | 4/1996 | Emmerich | |
| 5,551,144 | A | 9/1996 | Mantone | |
| 5,623,189 | A | 4/1997 | Hemmer | |
| 5,632,136 | A * | 5/1997 | Luchenbill | B65H 81/08 242/441.4 |
| 5,681,006 | A | 10/1997 | Herd | |
| 6,387,852 | B1 | 5/2002 | Celik | |
| 6,395,080 | B1 | 5/2002 | Cass | |
| 6,510,604 | B1 | 1/2003 | Pourrahimi | |
| 6,595,454 | B2 | 7/2003 | Roba | |
| 6,603,379 | B1 | 8/2003 | Manlief | |
| 6,820,833 | B1 | 11/2004 | Carlsson | |
| 6,991,144 | B2 | 1/2006 | Franz | |
| 8,936,209 | B1 | 1/2015 | Knierim | |
| 9,624,068 | B1 | 4/2017 | Knierim | |
| 2002/0125787 | A1 | 9/2002 | Howard | |
| 2002/0172891 | A1 | 11/2002 | Mori | |
| 2002/0183208 | A1 | 12/2002 | Pereira | |
| 2003/0115836 | A1 | 6/2003 | Suzuki | |
| 2004/0040451 | A1 * | 3/2004 | Peroni | B65B 13/28 100/5 |
| 2004/0094656 | A1 | 5/2004 | Perry | |
| 2004/0193303 | A1 | 9/2004 | Fore, Sr. | |
| 2004/0206849 | A1 | 10/2004 | Harrington | |
| 2004/0211851 | A1 | 10/2004 | Barton | |
| 2004/0245365 | A1 | 12/2004 | Ramesh | |
| 2005/0227873 | A1 | 10/2005 | Leghissa | |
| 2006/0266794 | A1 | 11/2006 | Melfi | |
| 2009/0118126 | A1 | 5/2009 | Burke et al. | |
| 2009/0140451 | A1 | 6/2009 | Wampler | |
| 2009/0183486 | A1 | 7/2009 | Beck | |
| 2010/0319802 | A1 | 12/2010 | Hattori | |
| 2017/0236627 | A1 | 8/2017 | Walsh et al. | |
| 2018/0251333 | A1 | 9/2018 | Kmierim et al. | |
| 2021/0006116 | A1 | 1/2021 | Gabrys et al. | |

FOREIGN PATENT DOCUMENTS

| | | | | |
|---|---|---|---|---|
| EP | 0519629 | | 12/1992 | |
| GB | 2043715 | A | 10/1980 | |
| JP | H065416 | A | 1/1994 | |
| KR | 20110085123 | A | 1/2011 | |
| WO | WO2015123415 | | 8/2015 | |
| WO | WO-2022164787 | A1 * | 8/2022 | H01F 6/06 |

OTHER PUBLICATIONS

International Search Report and Written Opinion for PCT/US2016/053174.

Extended European Search Report dated Apr. 26, 2019 associated with corresponding EP16849625.5. 13 pages.

* cited by examiner

LINEAR MEDIA HANDLING SYSTEM AND DEVICES PRODUCED USING THE SAME

This application is a continuation in part of U.S. patent application Ser. No. 15/927,877, filed Mar. 21, 2018, now U.S. Pat. No. 10,899,575, issued Jan. 26, 2021, which is a continuation-in-part of PCT/US2016/053174, filed Sep. 22, 2016, and published as WO2017/053611 on Mar. 30, 2017, the entire disclosures of which are incorporated by reference herein.

PCT/US2016/053174 claims the benefit of U.S. Provisional Patent Application Ser. No. 62/221,910, filed Sep. 22, 2015, entitled "Linear Media Handling System," the entire disclosure of which is incorporated by reference herein.

PCT/US2016/053174 also claims the benefit of U.S. Provisional Patent Application Ser. No. 62/242,393, filed Oct. 16, 2015, entitled "Linear Media Handling System," the entire disclosure of which is incorporated by reference herein.

PCT/US2016/053174 also claims the benefit of U.S. Provisional Patent Application Ser. No. 62/243,966, filed Oct. 20, 2015, entitled "Compact Advanced Superconducting (SC) Devices," the entire disclosure of which is incorporated by reference herein.

This application is related to U.S. patent application Ser. No. 14/569,314, filed Dec. 12, 2014, now U.S. Pat. No. 9,624,068, issued Apr. 18, 2017, which is a continuation-in-part of U.S. patent application Ser. No. 13/269,549, filed Oct. 7, 2011, now U.S. Pat. No. 8,936,209, issued Jan. 20, 2015, which is a continuation-in-part of abandoned U.S. patent application Ser. No. 13/114,012, filed May 23, 2011, which claims the benefit of U.S. Provisional Patent Application Ser. No. 61/347,374, filed May 21, 2010, the entire disclosures of which are incorporated by reference herein.

FIELD OF THE INVENTION

Embodiments of the present invention are generally related to devices and apparatus that handle and manipulate delicate linear media, particularly to an apparatus and method for winding linear media such as superconducting linear media. Other embodiments of the present invention are the output of this apparatus, particularly products and devices made from winding superconductors into magnets, cables, and/or cable magnets.

BACKGROUND OF THE INVENTION

Society is swiftly attempting to achieve lower greenhouse gas emissions and more renewable, efficient, and compact forms of power. Electricity is our primary means of power and has shaped the world we know because it is the most efficient, flexible, and clean form of power generation, distribution, storage, and use. Increasing efficiency in production, distribution, and consumption reduces the need for increased generation, which lowers environmental impact, thus constituting a renewable green solution, particularly as most electricity generation out to 2050 will be provided by $CO_2$ producing fossil fuels.

Once extremely low impedance superconductor transients are settled, a superconductor (sometimes referred to herein as "SC") will exhibit immeasurably low to 0 electrical resistance primarily inside a low-temperature operating range. Accordingly, superconductors are ideal for a wide variety of utility and power uses, mobile electric platforms of varying sorts, power transmission, and distribution on all scales, fulfilling the dream of increased energy efficiency mentioned above.

Superconducting linear media can also be used in various applications, including powerful electromagnets, nuclear magnetic resonance (NMR) devices, magnetic resonance imaging (MRI) devices, mass spectrometers, motors and generators, beam focusing and steering magnets found in particle accelerators, and electrical power cables. Like most magnetic coils, cables, and cable magnet, superconducting magnetic coils, cables, and cable magnets are made by wrapping a conducting material around a shape-defining form. When coil temperature is reduced below a predetermined threshold, the conducting material will exist in a superconducting state. The conductor's current-carrying performance also increases, wherein large magnetic fields can be generated and power can be delivered with less to negligible loss and with lower voltage requirements.

Superconductors have the promise of bringing pure efficiency (i.e., 100% efficiency), which would allow for the manufacture of innovative devices that can accommodate increased energy and power requirements in a compact package and through HTS use provide for lessened cryogenic requirements via LN2 use. Unfortunately, current commercially-available advanced SC products, such as magnets, cables, and cable magnets, are virtually non-existent because superconductors, including those that can tolerate higher temperatures, are fragile. Accordingly, the winding process must consider the fragile SC media during handling, winding, and final operation. Another drawback of low-temperature SCs (LTS) is that they often cannot be used outside of a laboratory due to liquid helium (LHe) cooling complexity, size, and operational limits. Cost is also a factor as global LHe supply is being depleted.

As mentioned above, LTS SC commercial applications have been limited to NMRs, MRIs, and science experiments, such as fusion and high energy physics which are all laboratory or lab equivalent locked, including all MRI/NMR building to even mobile locations. After decades of efforts, HTS cables are limited to short 100's of meters to just over a kilometer long demonstrators with no customer acceptance or possibility for commercial viability from short microgrid runs to the millions of kilometers for utility needs, particularly for alternating current (AC) or pulsed power applications. After decades of efforts, there are no HTS or MTS commercial devices of any type such as linear, rotary, curved, etc. electric machines (motors/generators), NMR/MRI, etc. but only more laboratory locked demonstrators. These applications use LHe-based LTS that is cryogenically impractical for long utility cable and non-laboratory needs. Accordingly, current and potential SC products desire to use High-temperature SCs (HTS). HTS promise even more innovation due to lessened cryogen requirements. Accordingly, HTS winding has been chosen as the best solution to reduce the impact of increasing global power consumption, degradation of conventional conductor-based infrastructure, and to enable hybrid to all-electric mobile platforms through compact power devices.

HTS machines are desired across industries from individual device to enabling electric system solutions. Conventional copper (Cu) and permanent magnet (PM) machines are limited by air gap magnetic flux density (B), torque, thermal, and power output. Cu cooling needs are also great and add to system weight. Conventional machines use iron (Fe) to increase their air gap B but at the expense of weight. A required gearbox increases the power range at the expense of complexity, cost, reliability, size, weight, and service needs, but gearboxes are also torque limited where, in one example, an industrial 3-stage gearbox has a 9 MW range limit. Conversely, an HTS direct drive machine has no thermal loss and over 6× a conventional machine torque limit due to the higher magnetic flux density (B) output.

After decades no HTS or MTS device, including electric machines, have moved beyond laboratory-based demonstration levels. Due to winding limitations, other HTS winding machine attempts focus on making a pancake stack machine field coil with only limited protection from HTS winding and operational stress. Pancake stacks increase harmonic content, move the coils further from the air gap, which lowers the air gap B, and thus cannot be used for complex winds such as armature coils. Further, pancake stacks are not curved to protect the HTS tape from quenching due to high B locations. There have been no attempts to create a fully HTS via a fully cold, cryogenically cooled on both the armature and rotor, machine due to the difficulty in winding HTS armature coils, which leads to a machine that gains less than half of SC operational benefits. Other MTS solutions have lower material cost but are even more fragile and have a higher cryostat cost and complexity given a lower operating temperature and potentially more dangerous cryogen.

Current HTS is the only non-laboratory commercial SC application solution as they can operate at liquid nitrogen ($LN_2$) temperatures or higher. In some instances, HTS operate at temperatures lower than $LN_2$ temperatures when used in extreme situations, such as in HTS magnets with higher than LTS capable magnetic fields. $LN_2$ is a commercially appealing cryogen because $N_2$ is abundant on Earth, and for a cryogen, $LN_2$ is relatively easy to make. $LN_2$ is also very stable versus liquid hydrogen or mixed air, colder cryogen options. Unlike LHe, $LN_2$ is inexpensive and can be remotely generated from the surrounding air using a briefcase-sized device. $LN_2$ is also appealing to cryogenic systems design because it is molecularly larger than LHe, making it easier to contain and transport with far less insulation because it has a much higher thermal capacity. At 77 Kelvin, $LN_2$ is much warmer than the commonly used yet much harder to operate lower temperature cryogens and, in particular, LHe. $LN_2$ advantages allow HTS based, compact devices from a cryogen perspective.

Those of ordinary skill in the art will appreciate that manufacturing for HTS applications requires complex geometric materials to experience low winding stress. This requirement is exacerbated when manufacturing complex geometric magnets categorized by their primary mounting and rotation needs, which include solenoid (often mounted on a common central turning platform), planar (such as a racetrack coil or a curved plane cos-theta magnet and often mounted on cylindrical tooling), and spherical (such as a baseball or yin-yang magnets). Advances in HTS operational values, their performance, the reliability of cryogenic systems, connections, etc., and the understanding that HTS material costs drop during production have collectively targeted SC manufacturing as the remaining issue for commercial SC applications.

Winding machines are used in various applications to wind linear media, such as conventional conductors, superconductors, insulating materials, and fiber optics in the form of wire, tape, and cable of multiple geometries onto items such as a spool or cable core. Spools or cable cores in turn form, for example, magnetic coils or linear cable cores. Conductive coils are formed by winding single or multiple electrical conductors around a coil form such as a spool or a core. Electric motor armatures and field coil magnets employ a conductive coil. In these applications, an insulated resistive conductor (e.g., a copper wire surrounded by electrical insulation) is wound about a core of iron, air, a hybrid of iron/air, or another material. Conductive cables are formed by winding at least one electrical conductor around an axis, often accompanied by a physical core. Cable conductors can be wound in a spiral or helical pattern or interwoven in more complex geometries such as partial to full transposition or braided to offer desirable mechanical and electromagnetic properties. Overhead power and communication transmission lines typically consist of many interwoven conductors and insulation layers. Winding machines are also commonly used to wind coils of wire, tape, coil, or other material onto large spools for storage or transport.

Full transposition commercial winding is required for long length alternating current (AC) cables, pulsed power cables, and any transient magnet and cable magnet operation where reactance is an issue. "Transposition" is a technique of periodic swapping of conductor positions that reduces magnetic crosstalk reactance and increases transmission efficiency. Full transposition of an SC allows AC and transient operation as resistance and reactance are negligible due to an even current distribution amongst transposed winds that often terminate together. Full transposition for a wound strand means precise conductor position that leads to no inductive mismatch or net self-field flux enclosed between the strands and, hence, low residual magnetization-producing transients, such as AC, losses or power choke. Full transposition for a subcable or cable goes further to also provide homogenous current distribution across the subcable or cable. Roebel HTS cable tests promise AC operation, but the high cost associated with Roebel manufacturing has always limited this technology to short cable lengths. Braiding adds an entirely new layer of complexity beyond full transposition, as will be described later. No system exists today that is suited to wind any advanced SC in either full transposition or, in particular, braiding. Advanced SCs are defined as the more modern and operationally capable low and medium temperature SCs (MTS) such as reacted Nb3Sn and MgB2 as well as high-temperature SCs such as rare-earth barium copper oxide (ReBCO), including yttrium barium copper oxide (YBCO), and bismuth strontium calcium copper oxide (BSCCO). Advanced SCs contrast to classical LTS that operate around liquid helium temperatures, which restricts their widespread use.

While prior art winding machines work reasonably well for most conventional metal wire, several delicate linear media types are too fragile for prior art winding machines and techniques. Examples of such delicate media include advanced superconductors including medium and high temperature (as commonly defined by their transition temperature into the superconducting state) superconducting wire and tape, very fine conventional wire, filamentary linear materials, fiber optic wire, thin strands of carbon-based fiber, smart fabrics, and extremely dense fine fiber matrices. Superconductors such as reacted magnesium diboride ($MgB_2$) and Niobium-3 tin ($Nb_3Sn$) are also very brittle and, thus, are difficult to wind without damaging the same. All forms of HTS for engineering use are brittle ceramic tapes comprising an extremely thin and wide cross-section, which greatly increases the winding complexity and a primary reason all prior attempts at non-helical winds have failed. Indeed, most experts in the HTS field believe a non-helical winding is not possible for winding a magnet, cable, and/or cable magnet. Thus, all HTS prototypes have been built manually with a final product experiencing known unacceptable magnet reactance values for any final commercial product transient operation use. Transient embodiments of such use include power transmission cables of any length, particularly long length, pulsed power transmission cables, and transient magnets and/or cable magnets of any type, including pulsed power operation and even common motor and generator AC armature use.

It is very easy to damage advanced superconducting materials while attempting to wind them onto a magnet coil spool or cable core. Improper winding has prevented commercial use of HTS and MTS magnets, cables, and cable magnets. This is in large part due to customer concerns with non-reliable output from traditional winding machine-based SC magnet limitations where the HTS and reacted MTS is fragile until bound into a final form. These methods do not produce precise, repeatable outputs or account for fragile media needs and, hence, cannot allow desired winding configurations. This exacerbates flaws in the wound material that create stress/strain points risking premature failure either due to wind stress or due to the inability to place and curve the wound HTS to protect the magnet, cable, or cable magnet from worst-case peak operational magnetics, thermal, and mechanical forces. More specifically, cables, wires, and tapes are bent during the winding process. The smaller the coil or cable form, the more the cable or wire or tape must be bent, thereby introducing higher stress levels on the superconducting filaments. Because many superconductors are brittle and very thin and wide (in the case of HTSs), bending can cause breakage. Specifically, current-day HTS has a very thin (measured in micrometers) and wide rectangular cross-section, wherein winding can crack or fully destroy the HTS. When superconductor wires and tapes are wound onto a spool by a prior art winding machine, the stress on the superconducting filaments can be great enough to destroy the desired superconducting properties. Operational stresses will also magnify the winding stress, which usually translates to damage during peak operation times. Further, prior art winding methods do not account for fragile media needs and hence exacerbate flaws in the wound material that create stress/strain points that lower operational values and lead to premature failure. For a given superconductor or superconducting cable, there is a lower limit on the radius of curvature to which the superconductor or superconducting cable can be wound.

A "wind-then-react" method is often used to address the difficulties in handling certain particularly brittle, medium temperature superconducting cables/wires. This process begins by winding unreacted superconductor precursor around a former or spool. The spool is then processed with high temperatures in an oxidizing environment to convert the precursor material into the desired superconductor material already formed into the desired coil shape. The "wind-then-react" approach has several disadvantages. For example, because the precursor material must be heated after the wire is coiled onto a magnet system, all of the components of the magnet system to which the coil is associated must withstand the high temperatures needed to react and form the superconductor. Thus, the magnet system cannot include aluminum or its alloys as such materials melt at the temperatures used during superconductor formation. It is also difficult and expensive to apply insulation to a wound coil to prevent electrical current flow between the turns. Another drawback of the "wind-then-react" method is that superconducting linear media cannot be easily prepared and stored ahead of time, because it must be formed onto the spool or system in which it will be used. One particular problem area is seen in the production of MRI and NMR machines. MRIs employ, just like large motors or generators or large accelerator magnets, a coil of superconducting wire or tape several kilometers in length that weighs hundreds to thousands of pounds. The sheer size of the required coil presents several difficulties when using a "wind-then-react" method as the entire coil must be placed in an oven for processing. Due to these MTS reaction requirements, an MTS cable is not possible.

In contrast, a "react-then-wind" production technique provides several advantages, including decreased manufacturing and storage costs. The resultant magnet systems use a broader range of materials. But despite these known advantages, the difficulties in handling the more delicate reacted superconductor linear media without damage, especially for lower-cost superconducting materials like $MgB_2Nb_3Sn$, has prevented the "react-then-wind" method from gaining widespread commercial acceptance.

Regardless of the linear media being wound, the design and control complexity of a machine for handling and winding a cable employing full transposition and braiding aspects has proven too difficult to date. For example, operational mechanical, thermal, and magnetic stress and associated fatigue affect the final design acceptance and final magnet, cable, and cable magnet operational considerations and must be considered. Such factors contribute to any advanced SC mechanical winding decisions, such as SC wire and tape force and position control of the SC and output winding product. Winding fragile yet thin rectangular cross-section tape consisting of YBCO exposes the added geometric difficulties of tape placement and control required to build an acceptable HTS cable, magnet, and cable magnet, which include controlling overlays, turning, puckering, kink angles, twist and pitch angle; addressing side loads so only single planar winding exists from any angle; controlling stress across the neutral axis; controlling tension and compressive spring response; variable material and void control; eliminating linear wind-on twist; controlling layer variance; controlling high packing factor (pf); mechanically supporting HTS strands for operation; controlling wind direction reversals across width; eliminating stress/bend delamination, mechanically supporting HTS strands to orient for operation; and eliminating kick-ups, etc.

Unlike wire, HTS must wind onto a line while in a straight plane with the source spool, and before final positioning, only contact non-stressing guides that remove stress and allows for the creation of complex shapes. The complexity behind building an SC winding machine that can safely arrange delicate media, especially HTS, by directly monitoring and actively controlling the location, tension, and bend of every wound conductor and insulator with inertial corrections requires a new mechanical design with non-linear control. Because of these issues, there are no advanced SC commercial devices and, thus, HTS tape providers call HTS a "wire" for marketing reasons. To further complicate HTS winding and design, unlike LTS and MTS, an HTS strand and final cable and magnet have operational parameters that must be observed and incorporated into the winding process, including wind complexity, for safe and fully beneficial use.

The problem with prior art winding systems is that the means of passive or active tension control needed during the winding process is too harsh for the most delicate linear media requirements. Several prior art systems use a dancer pulley for tension control. However, the mechanical action of tension control using a dancer pulley under high acceleration or deceleration profiles places an unacceptable impulsive force on the linear media that often damage the media. Further, some prior art systems' tension measurement methods are either inaccurate or too damaging to the media, such as multiple reverse bends across small spools. Unfortunately, a prior art winding system does not exist that is capable of successfully winding service level robust devices from extremely delicate, medium-temperature superconducting (MTS) reacted $MgB_2$ and $Nb_3Sn$ wires and HTS. This problem is immediately conveyed to all wound output products. Manufacturing high-temperature superconducting tapes consisting of ReBCO, YBCO, or BSCCO, or larger diameter fiber optical wire, suffers from the same issues without continual human intervention. Accordingly, long process times, poor quality control, and difficulties in meeting manufacturing repeatability standards are the norm. Often the media and hence the final product are so damaged by the winding process that it can no longer be used for its intended purpose or has an extremely short operational life due to media handling induced fatigue.

There are many good HTS demonstrator projects, yet after decades none of these have moved beyond demonstration levels due to customer concerns with non-reliable output from traditional winding machine-based advanced SC limitations with limited geometric complexity outputs. Further, the ability to manufacture long length direct current (DC) cables is limited. Existing fabrication methods do not produce engineering standard precise or repeatable R and D or commercially reliable or cost allowable SC magnets, cables, or cable magnets.

For power cables, legacy helical wound HTS, such as Conductor on Round Cable (CORC), are promising SC cable technologies that scale to long lengths and very high currents by adding more ReBCO layers. Still, all current wound HTS fabrication methods use historic handcrafted winding to partial yet relatively rough automation methods, which stress the HTS while only allowing partial transposition and an arbitrary twist pitch as the layer diameters increase, leading to reactance and power mismatch issues. The complex cable and magnet configurations desired, especially complex magnets tape full transposition and braiding winding for cables both geometrically equivalent to conventional conductor windings, are not possible with legacy winding without stressing the linear media beyond acceptable limits. Therefore, for cables legacy helical winds are limited to partial transposition, limiting AC power transmission to well less than 10 km due to reactive requirements such as utility needs. This precludes them from use in all regular non-DC cable and cable magnet applications, such as utility AC power delivery and pulsed power applications such as fusion and high energy physics or all-electric aircraft pulsed power applications. This has stopped all commercial use of existing SC cables beyond early demonstrators. For magnets, legacy winds often limit HTS coils to simple pancake coils stacked together. This limits HTS magnets to only the simplest of magnet options.

The SC power cable competitive landscape includes over a dozen past SC demonstrations, most less than 1 km, and not a single commercial sale. R and D includes Florida State CAPS, American Magnet Lab, and Advanced Conductor Technologies. Commercial companies with demonstrators include Nexans with a European installation, AMSC, and Sumitomo through SuperPower, but also general OEMs such as HtsTriax by Ultera as a subsidiary of Southwire, STI, New England Wire, Luvata, and Fujikura, Ltd. Projects include the U.S. Department of Energy sponsored Nexans generation 1 SC, three-phase, 138 kV, 574 MVA power link 600 m cable in Long Island, N.Y. installed in 2008 as the world's first SC cable in a live grid operating at transmission voltage and more recently the 1 km long AmpaCity project connecting two transformer stations in Essen, Germany that is the longest SC cable installation in the world. In 2014 AMSC and ComEd, Commonwealth Edison Company, embarked upon the U.S. Department of Homeland Security funded Resilient Electric Grid system for the city of Chicago that will provide an urban environment SC transmission system to demonstrate how SCs can protect a grid during times of failure. Existing product technical limitations allow every SC cable OEM to be a potential user with the greater capability. A large benefit of these limited demonstrator projects is the apparent willingness of utilities to invest in SC cables and proof that all ancillary equipment, such as SC cable cryo cooling, works in the field for decades without issue.

Regarding magnets, in one industry example—hybrid and all electric aircraft—there are no known SC propulsive motors or generators. Aviation technologies must support aircraft moving further and faster with minimal pollution and often with more payload at a decreased operation cost to operate. These needs require increased aircraft efficiency and power with less weight, including how much fuel the aircraft must carry onboard. General SC motor and generator machine demonstrators include power system developers focus on maximizing the current transmission. In contrast, energy system-based SC machine efforts focus on the primary benefit of SCs to increase the air gap magnetic flux density (B), thereby increasing the machine power density and specific power over four times while substantially increasing efficiency and voltage over comparable wire wound or permanent magnet-based conventional machines. A U.S. Navy energy systems machine example is the Zumwalt class DDG-1000 next-generation destroyer propulsion rated at 36.5 MW, 6.6 kV, and 120 rpm competition. Three companies built final full-scale machines where the primary difference was mass and volume across their three separate motor topologies. The winning propulsion power plant was the Converteam advanced induction motor. Compared to this, the DRS PM motor built and tested was ~80% of the induction machine's mass and volume, whereas the AMSC built and tested SC motor was 47% volume and ~30% mass of the induction machine while providing much higher efficiency. This technological leap allowed by SCs is revolutionary, yet the AMSC team lost with SC application product technical reliability being a chief concern. An SC machine for aircraft would achieve an even greater machine reduction in size and can be direct drive, without a gearbox or a converter.

These common scenarios have positioned advanced SC cables, magnets, and cable magnets as a poor application choice that does not support commercialization and contributes to why only high-cost advanced SC demonstrators or science experiments are developed with no industry-accepted commercial applications. Realizing industry standards compared to the fragility of advanced SCs, the disclosed set of winding systems were created to safely complete HTS cables, magnets, and cable magnets to the point of protected epoxy or equivalent for a magnet or cable magnet and cladding or equivalent for a cable.

There is a long-felt need for an improved method and apparatus for handling and winding delicate linear media and geometrically difficult-to-wind media into a cable or coil for use in SC devices and products. The 2009 US Department of Energy report on, "Research Needs for Magnetic Fusion Energy Sciences," states on pages 285-290 that advancing cable-based magnet fabrication techniques can, "revolutionize the design of magnet fusion devices," and in particular, "advanced manufacturing techniques will yield quantitative reductions in the magnet fabrication complexity and assembly. This is an area that has received little attention and where even limited resources may yield substantial gains." The contemplated SC devices and products are more efficient and more powerful and/or more compact than conventional electrical conductor devices and products.

SUMMARY OF THE INVENTION

It is one aspect of embodiments to provide a revolutionary manufacturing method for producing high temperature superconducting (HTS) and medium temperature superconducting (MTS) commercial applications and devices across all relevant industries, including enabling fieldable superconducting devices and enabling electric systems that are not possible without being able to use HTS. The disclosed manufacturing process reduces stress, allowing complex magnet, cable, and cable magnet configurations. For example, the method of one embodiment produces a robust magnet configuration configured for use in the first fully cold (liquid cryogen) HTS linear, rotary, curved, etc. electric machine (motor/generator). This contemplated method also may allow for the manufacture of a reliable and robust power-dense HTS cable core operating from DC to transient, including AC and pulsed power with negligible reactance and acceptable power loss compared to existing practice. The cable, magnet, cable core, cable magnet, etc. produced by the methods described herein are designed to function at liquid nitrogen (LN2) temperatures using existing HTS. Accordingly, the disclosed magnet, cable, and cable magnet superconductor winding capabilities disclosed herein allow for the most power-dense, specific power, energy-dense, and specific energy electrical and magnet-based products ever created, especially embodiments that utilize HTS.

Achieving the goals described herein required developing a new and advanced controllable system of constant tension control, no reverse bends, minimized lateral bends, and a twist angle larger than the plastic strain bend radius in all angular and linear dimensions approaching the limit of the most careful manual operations. The contemplated winding machine allows negligible stressing of wire and tape of any produced width in any dimension while also maintaining an automated process line level of reliability, throughput, and cost for developing commercial industry standard robust products. All winding machine methods and hardware focus on acquiring and maintaining the desired wind-on location solution to achieve the desired output product.

It is an aspect of some embodiments of the invention to provide an improved method and apparatus for handling delicate linear media, such as reacted superconductor wire and HTS, and in particular for winding delicate media in a coil shape onto a former sometimes called a spool or bobbin. Other embodiments wind delicate media in a cable shape onto a former that is sometimes called a cable core. Some embodiments of the present invention carefully control the axial and lateral forces applied to the media during the winding process and eliminate all small radius bends, reverse bends, and lateral bends as the media is handled. A combination of direct closed-loop control and media routing design facilitates handling the delicate media without causing damage. Axial tension applied to the linear media during the winding process may be closely controlled with a feedback control loop using tension measurements to control rotation speeds of each the wind-off spools, e.g., one or more source spools, and wind-on spool, e.g., coil or cable former.

Further, during winding, the delicate linear media is only exposed to large radius bends with no reverse bending. Thus, a Linear Media Handling System (LMHS) is contemplated. When electrical conductors are used for input, LMHS generally refers to a family of apparatus configured to manufacture a magnet, a cable, or a magnet from a cable (also referred to herein as a "cable magnet") where the cable is built then wound into a magnet. The material comprising the magnet or cable could be superconducting (SC) of any type from low to the more advanced and delicate medium and high-temperature superconducting materials. The purpose of LMHS is to address using automation the complexity and expense of producing a robust and reliable commercially viable magnet, cable, and cable magnet. LMHS usefulness extends to other products winding other materials but is originally targeted particularly for low-cost manufacturing with respect to competing options for producing applications using advanced superconductors. LMHS provides a cable, magnet, and cable magnet to the final product designer a machine that allows manual to algorithm automated strand tension, twist pitch, angle control, packing factor degree for each tape and/or wire for the entire stack, etc. for partial to full transposition to braiding of cables, magnets, and cable magnets. The output of LMHS produces a multitude of specialized products, including Compact Advanced Superconducting Devices (CASD) described herein as LMHS product embodiments.

In many embodiments, mechanical and control designs are built to mimic with greater precision the physical contact and choices made by a human manually laying down an individual and accurate wind of a media in an automated method that is unattended, repeatable, reliable, and high speed. The winding machine of one embodiment is capable of assuming design inputs equivalent to current day CNC or 3D printer machines along with CAD/CAM techniques to fabricate the final magnet, cable, and/or cable magnet from sets of inputs, controlled feedback loops, and algorithm-based automated responses. To achieve the level of precision and motion control required for the most fragile winding media, many embodiments of the disclosed winding solutions combine semi-automated to fully automated non-linear closed-loop higher-order controls. Other aspects employed may include controlled linear media routing, electronically geared DoF, precision motion control with deterministic EtherCAT FPGA or equivalent control, and specially designed direct tension, packing, and position sensors. The contemplated sensors provide greater sensitivity for their size to guide material output and contact location of the wind, while automatically maintaining appropriate tension levels in the individual SC wires and tapes. The novel arrangement and abundance of state-of-the-art motion control equipment and original control algorithms, built upon a non-traditional modular frame allowing infinite position flexibility, combine to provide an unprecedented level of configurable motion control.

The winding machines of some embodiments of the present invention provide the ability to directly monitor and actively control the location, tension, and bend of every conductor and insulator being used to create the magnet, cable, and/or cable magnet at every moment of production. This aspect is often key to generating the optimum magnet, cable, and/or cable magnet from fragile media. The use of sensors and control algorithms are also often key to the most complex part of the disclosed winding solution. Independent but electronically geared active control for each conductor and insulation winding spool for a single product provides the functionality required.

In many process embodiments, independently controlled winding layup location and position (including angular position) and tension sense and control are important to fabricating the final application having an acceptable packing factor (pf), no gaps or set gap inclusions, full transposition up to braiding, and reliably. The independent sense and control also allows many other complex magnet, subcable, cable, and cable magnet geometry inclusions to safely handle fragile material with minimal axial stress and negligible non-axial stress. Some process and control automation embodiments of the disclosed winding solutions include lowered winding tension during an inside wind, which prevents outer layers from being pulled up. Thereafter, tension can be increased during the outside wind to tighten the pf to a level that does not harm the media and avoids material gaps. Given appropriate layup control logic, the large issue of conductor proximity effect and capacitive area cross talk is minimized by incorporating an appropriate transposed/braided tightly packed winding scheme. The contemplated winding machine's open nature supports diagnosing conductor and insulator defects before winding and, should a defect be discovered, splicing in a new conductor or localized insulator to wind. Feedback systems may also be provided that record for each strand laser or vision position and height wound offsets, tension, media length, and HTS dropout value upgrades. Machine upgrades will automatically slow or reverse operation to mitigate anomalies, unwinding as necessary, if the feedback information indicates an anomaly. For example, embodiments of the disclosed winding machine will automatically indicate areas of concern, including reverse operation and splices.

The following sections outline aspects of some embodiments of the present invention. Those of ordinary skill in the art should appreciate the aspects described herein may be employed or combined in any fashion to produce various winding machines and the products (and end products, e.g., NMRs) of those winding machines. Those of ordinary skill in the art should also appreciate that all winding machine embodiments disclosed herein may be configured to form magnets, subcables, cables, and/or cable magnets whether or not explicitly stated in each case. Further, "automated" embodiments described herein also encompass partial or semi-automated processes.

Degrees of Freedom (DoF) Controls. As used herein, the term "DoF" will be used to describe the control of the routing elements and structures to adjust the orientation of the elements and structures to provide linear and/or rotational degrees of freedom to facilitate the handling of the delicate media without causing damage.

Winding Arc Rotation. Automated and/or manual rotation of the wind-on former allowing a key wind-on DoF ability. The purpose is to allow simple to very complex magnet, cable, and cable magnet wind abilities equivalent to human wind interaction and to a level not possible with other semi to fully automated winding machines. Embodiments include a goniometer or rack and pinion arc mechanized system such as for a complex solenoid, planar, and/or spherical magnet wind.

No Reverse Bends Linear Media Routing Design. Some embodiments of the present invention use a routing design that follows strict design rules in transferring linear media from a storage/reacting, wind-off spool to the desired wind-on spool (or bobbin or former). It is highly desirable that the media routing path, particularly HTS and reacted MTS, have no reverse bends whatsoever.

Bend Radius Control. As media is routed through the winding machine, it is also highly preferable that each bend, including wind-off and wind-on spools and any pulleys over which media passes, should maintain a minimum bend radius. This minimum radius, which can also be expressed as a minimum radius of curvature, is determined by the nature of the media material being processed.

Dynamic Surfaces. To minimize media stress and strain through friction and rubbing, which not only increases axial tension on the media but also tends to damage any wire insulation, all of the surfaces touched by the wire during the winding process will preferably provide a dynamic routing surface moving in the direction of the media motion (i.e., pulleys or wheels) else be low friction surfaces with no sharp edges.

Direct Closed Loop Axial Control. According to some embodiments of the present invention, axial tension is measured and used as input data for the primary control loop affecting system operation. Preferably, closed-loop control is used whereby the winding process is initiated by motors that turn either the wind-off spool or the wind-on spool (or both).

Direct Closed Loop Lateral Control. Lateral bending and stress should also be controlled in some embodiments of the present invention. Superconductor wire should unwind from the wind-off spool, pass around the tension sensor wheel (preferably wrapped around approximately 180 degrees circumferentially to ensure accurate measurement of the tension), and wind onto the wind-on spool while staying in substantially the same plane.

Media Orchestrating Routing Technology (MORT). Another embodiment of the invention includes a versatile system for quick media alignment and movement called Media Orchestrating Routing Technology (MORT).

Mammoth Oversize Round Tube (MORT-II). One embodiment uses a large tube and separately rotating internal bearing or bearings that allow power and data transfer across static to a rotational plane without the use of slip rings with the embodiment of powering, controlling, and acquiring data from rotating planes in both cable and magnet winding operations.

Angle On/Off Wind. Active control loops based on the axial tension value as one embodiment of being the global control master and a hierarchy of master/slave relationships provide the means of varying the pitch angle while accurately maintaining the desired performance value such as constant axial tension.

End of Layer Sense. A critical transition in windings occurs when the edge of a wind-on spool is encountered. In multilayer windings, a change in direction must be negotiated at this transition.

Dropout Identification. High-Temperature Superconducting Material is often flawed with "dropouts," i.e., lowered maximum operational points. Thus, it is another aspect of some embodiments of the present invention to check each SC strand being handled or formed into a cable or magnet for dropouts, then to incorporate a splice to remove the dropout before incorporating the SC strand into the cable or magnet.

Material Handling. It is yet another aspect of embodiments of the present invention to provide enhanced material handling capabilities. More specifically, current SC winding methods produce various stress/strain points that lead to material failure and lower critical SC values, which lowers operational performance. The stress/strain points will often survive winding and subsequent quality assurance processes but will lead to failure during the worst-case scenario of the highest system power or energy operation.

Proof of Performance. Some embodiments of the present invention provide proof of post winding performance integrity. More specifically, values such as tension and dropout occurrences are recorded throughout each SC strand's length and, therefore, in the final cable and magnet.

Turn-by-Turn Tension Control. It is another aspect of some embodiments of the present invention to provide turn-by-turn tension control or by continually varying tension control throughout the wind-on process. For example, some LMHS allow the operator to set winding tension values for each layer and even each turn per layer in the wind.

Reverse Direction Wind. Winding operation onto a bobbin commonly involves a single bobbin rotation direction. It is another aspect of some embodiments of the present invention to provide an LMHS that performs a reverse direction wind onto a bobbin.

Cable Diagnostics. Final system cable diagnostics are useful such as faults, smart grid, and distributed grid diagnostics. In this case the cable, magnet, and/or cable magnet is designed to reflect electrical bounces to provide a location of splices and certainly of a sudden resistance fault and resistance spread.

Diagnostic Station. Embodiments provide a process for long and reliable advanced SC lengths for cables and magnets. As one of ordinary skill will appreciate, HTS have great potential, but they have problems that prohibit commercial viability. One way to increase HTS reliability, especially for ReBCO, is to identify dropouts and to improve associated splicing techniques so that long, complex, and reliable magnets and cables can be manufactured.

Machine Vision. It is yet another aspect of embodiments of the present invention to provide non-contact precision sensors, such as optical, laser, and/or proximity sensors. For example, some LMHS embodiments employ a non-contact media position or wind pattern sensor system such as a vision or laser or a non-contact tension sense electromagnetic, resistance, or inductance measurement sensor.

Tensioner and Guide. It is another aspect of some embodiments of the present invention to provide a linear media tensioner and guide. More specifically, the LMHS may manual or automatically guide and hold tension for both wind-off and wind-on portions of the cable, magnet, or cable magnet wind while allowing individual SC operations, such as SC critical value testing, splicing operations, and wind-off spool swapping, to occur. One embodiment of the contemplated winding machine employs a compression mechanism to safely hold the linear media so that a wind-off spool(s) can be exchanged. The compression mechanism is likewise able to hold the linear media in tension on both sides of an operation, such as a splice operation. The compressive tension mechanism is then released to allow normal winding operations. In the case of a magnet wind embodiment, the compression mechanism is off of the spool or follower subsystems and/or the MMP frame in general. In the case of a cable wind embodiment, the compression mechanism is off of the transposition, braiding, and/or helical wind stations and/or the MMP frame in general. One of ordinary skill in the art will appreciate that the compression mechanism may comprise grippers or similar devices that are adapted to contact and grasp the linear media at a predetermined location(s) without damage.

Splice Mitigation. LMHS of one embodiment provides the ability to lower the number of and, in some cases, remove splices required for any linear media such as SC wire or tape due to the large number of controllable degrees of freedom (DoF).

Splicing Operation. It is another aspect of some embodiments to provide manual to automated splicing within LMHS. Splicing of a single SC wire or tape strand for a repair section or for exchanging an emptied for a subsequent spool of SC wire or tape is important in creating required long HTS lengths with high operational values. The tensioner and guide is used to hold the linear media in place as the linear media is cut as needed in one or more locations to remove any non-desired media. Then a bridge, lap, or another type of splice/joint soldering or equivalent linear media joining operation is performed. In the case of a magnet wind embodiment, this splice mitigation mechanism is off of the spool or follower subsystems and/or the MMP frame in general. In the case of a cable wind embodiment, the splice mitigation mechanism is off of the transposition, braiding, and/or helical wind stations and/or the MMP frame in general.

Automated Spool Exchange. In some embodiments for winding cables, LMHS can automatically swap out emptied raw SC spools and replace them with new full spools without manual intervention.

Cryostat Cladding. The LMHS of one embodiment of the present invention provides an inline cryostat cladding station that facilitates the development of large commercial cable magnets and commercial power cables.

Integrated Wound Components. It is yet another aspect of some embodiments of the present invention to provide a winding machine configured to integrate energy storage system (ESS), power electronics, sensors, etc., into a cable, magnet, or cable magnet. The cable embodiment can wrapped for a finite, intermittent, or complete cable length and/or when used in a cryogen environment. One of skill in the art will appreciate that a common energy storage system that could be incorporated by winding into or onto or placed into or onto a cable, magnet, or cable magnet, for example, is an ultracapacitor (same as a supercapacitor), capacitor, battery, or similar device. Further, "power electronics" are understood to often be solid-state, non-solid-state, such as linear based, etc., electronics that selectively control and convert electric power. Sensors provide ESS, power electronics, cable, magnet, cable magnet, etc. sensing which can then be recorded and/or used in a controlled response. Integrated ESS, power electronics, sensors, etc., are lighter, smaller, and safer than a conventional ESS pack/box that employ ESS housings, busbars, nuts and bolts, etc. The ESS and power electronics may be wound separately or together as a combined solution at an automated and/or manual station.

One cable embodiment component is periodically wrapped around a cable core either in a spiral wrap process or formed into long strips to separately spiral wrap in one embodiment. In a further example, ultracapacitors (UCs) passively protect the remainder of the ESS, such as batteries, from stress that would otherwise require heavy and costly power electronics. This functionality provides a Distributed Grid solution, and for an electric aircraft embodiment, a Distributed Electric Propulsion (DEP) solution. In a separate or combined embodiment example, a wound battery will often be used to provide long-lasting energy to power capabilities and the UC will be used to provide peak power capabilities where either or both may include power electronics and sensors.

In one UC embodiment, cable wrapped chemical UCs are placed in a non-cryogen region. Another UC, e.g., nanowhiskers (nw), is placed in the cryogen resulting in a more efficient and thinner UC, allowing the transmission of AC/DC/pulsed power. Placing the UC into the cryogen removes the need to regularly break through the cryostat to connect the UC to the superconductor, which is important for thermal management and increased reliability. The cryogen will also provide added electromagnetic (EM) shielding external to the SC device. Further, cryogenic temperatures increase copper (Cu) electrodes' conductivity, further supporting a more efficient and thinner UC. Specifically, placing the UC into the cryogen should result in a lower equivalent series resistance (ESR), which improves a UCs ability to deliver large amounts of power as ESR is inversely proportional to peak power. Power electronics and sensor embodiments provide active sense and control of any elements wrapped onto the cables, magnets, and/or cable magnets contemplated herein.

Adjustable Winding Guides. Adjustable Winding Guides, such as independent follower guides or wind-to guides, are utilized by some embodiments of the present invention to allow wind-on equivalent to a human operator. The contemplated guides provide an automated and/or manual ability to control the wound media. Wind-to guides can be low friction surfaces, rollers, rods, or guides located on one or multiple sides of the media in space. In one embodiment, wind-on guides are set to the linear media width and hold the media in place. The guides are either directly or via a separate pusher used for added side alignment force needs. In certain embodiments, the software can code a spline or equivalent from computer-aided design (CAD), computer-aided manufacturing (CAM), or equivalent for multiple DoF to follow to create a more precise and winding contour. All adjustable winding guide embodiments can connect to any winding machine sensor and control to automatically control their motion. Human interaction via a control panel may also be used.

The guides are intended to provide a machine equivalent solution for human interaction to control delicate media. Accordingly, one benefit of some embodiments is that the media is properly handled. In addition, by providing machine-calculated variable tension control at some to all wind layup points, mechanical stress in the radial and angular direction is controlled. Using these techniques, system-neutral stress axis stress is also located, which can be leveraged to negate eventual operational stresses. Typically, a negative radial or inward wind stress is chosen, thereby reducing the entire wind stress from mechanical wound stress, such as magnet hoop and radial stress. Finally, more DoF provides a greater ability to actively minimize the stress and bends and achieve a more complex final geometry.

One embodiment is designed to fabricate a classic magnet armature wind or any angled, curved, or concave section wind. An added "push" is used for a zone equivalent to a human pusher tool. For applications that require a curved armature magnet, a single to multi-positioned pusher setup is employed on top of the linear media to hold media layers located in a contoured slot to achieve a curved stack instead of a linear pancake coil. In another process, optional axial tension is generated between the spool and bobbin/former to "pull" the media taught. In another embodiment, independent follower guide arms are used with multiple DoF such as linear and rotary motion of the follower providing motion relative to the former.

In another embodiment, winding cones or equivalent guides are used to set the wind angle of the tapes and winding window for the allowable maximum and minimum wind-on at the winding front and back locations. In one cone embodiment, each cone may be made of two halves of a polymeric material, such as oil-impregnated urethane, Teflon coated metal, or equivalent, set at the front and back ends of the media emplacement zone. This embodiment eliminates the walking or undesired moving of tapes and fouling of tapes when winding onto the core.

In another embodiment, one pusher could be configured to push one or both sides of the linear media with the proper tooling, whereas the other pusher could be used for other operations such as pushing down on the linear media to hold in place or wrap around a difficult corner.

In all embodiments, adjustable winding guides could help acquire a tighter packing factor and stop any fouling of the wind. Adjustable winding guides could also help control emplacement zones of each wind, especially for embodiments configured to manufacture cable with a full transposition of the wind stacks for single to multiple diamond and square pattern, or equivalent types of wind groups, locations.

Winding Group Spacers. Automated and/or manual winding group spacers are used to keep the wind groups or single wind-on linear media where the multiple single linear medias constitute a group from fouling. In one cable winding embodiment, spacers located between each transposition wheel and prior to wind-on points are used to eliminate tape walking and fouling of tapes when winding onto the former. Multiple sets of transposition wheel winds, e.g., three winds, may be positioned at slight angles so front and back transposed wind stacks cannot move to a middle wind-on location. In all embodiments, winding group spacers could help achieve a tighter packing factor without fouling the wind and could also help control emplacement zones of each wind, especially for cables employing full transposition wind stacks with diamond and square pattern, or equivalent types of wind groups, locations.

3D Printing of Superconducting Winding to Application Parts. It is one aspect to provide 3D print parts specific to superconducting, particularly HTS and MTS, application. That is, 3D print parts could be used in electric machines, MRIs and NMRs, regular to high-frequency transformers, common to specialty magnetic device cores, etc.

Winding HTS and MTS generally requires very large bend radii and the tensiometer (e.g., a tension measuring device) and tensiometer wheel that holds and senses the linear media must be large in diameter for HTS, and particularly reacted MTS, and well balanced in all directions to provide a part of a Newton level of tension continuous measurement. Such a wheel does not exist in industry. Due to the extremely high superconductor current and magnetic field capable needs and benefits, use of 3D printing for final applications and products can be of extreme benefit, such as assisting the development and operation of fully cryogenically cold and power-dense devices, rotary electric machines with high structural capability at high-speeds, thermal conductive paths, specialty materials, such as Titanium (Ti), which is often an excellent material to use in superconducting applications, and lower mass devices and systems. A linear to rotary electric machine embodiment includes elements to complete electric machine rotor and stator to hold the field and armature windings. Any magnet, cable, and/or cable magnet device includes cryostats and cryogenic cooling and conductive paths, gas paths (e.g., cryogenic liquid to gas expansion paths), electromagnetic (EM) shields and shield mounts, supporting and controlling EM and mechanical effects such as via mechanical and/or electrical high-speed and frequency induced EM effects, conductive cooling and quench support, structural support, allows increased manufacturability of components to systems, means of minimizing part counts and increasing reliability, lowering cost, etc.

Multipurpose Modular Platform (MMP). The Multipurpose Modular Platform (MMP) open architecture allows winding machine versatility, motion density, and abundant access to the wind and all winding elements by design. MMP is the extrusion formed base for all LMHS machines. Motion density is allowable through this modular machine, such as an Aluminum (Al) extrusion-based frame allowing many axes in a compact winding machine. One embodiment of motion density includes more than one actuator sharing the same DoF axis; thereby, both can be used for either winding control or motion density purposes. Motion density allows a smaller winding machine which also supports stiffening the structure which minimizes vibration, which allows the use of a lighter and more modular and versatile machine such as the extrusion base.

Winding Injector. Some versions of the contemplated winding machine employ an automated and/or manual winding injector for placement of an adhesive, UV adhesive, thermal compound, spot, linear, pattern, etc. in the wind. In one embodiment, the winding injector is used for a concave, complex, or open on one or both ends wind. In another embodiment, the winding injector is used in conjunction with the follower guide(s) or pusher(s) to hold for a brief dry and then wind continuation or slow wind. Full transposition provides the option of an embodiment for better cooling paths which provides better quench and fault current protection where each layer thermally shields the layer below versus the more common Cu or equivalent thermal stabilizer usage. These cooling paths comprise HTS to HTS winding voids that accommodate wound-in thermally conductive material or injected cryogenics. In either case, voids could be wound in alignment to allow cryogen direct cooling to all layers. By orienting the internally wound thermally conductive material, the wound cooling paths can be connected to an outer conductive cooling path at repeated lengths down a cable, such as 0.5 meter contacts or a mesh contact, while allowing cryogen flow. If cooling is adequate, then the voids can be epoxy or similarly filled for improved structural support.

Magnet Station. One embodiment of the present invention provides an inline magnet and cable magnet station that facilitates the development of commercial magnets and cable magnets. This magnet station improves capability, reliability, cost, and production rate of complex magnet and cable magnet configurations while incorporating partial to full transposition and braiding of modern SC magnets and cable magnets. Embodiments of industry use include high energy physics (HEP), fusion, NMR/MRI, transformers, fault current limiters, superconducting energy storage rings (SMES), motor/generator magnets, and cable magnets.

Dynamic Feed Winding. Some embodiments of the present invention provide dynamic feed winding. This aspect results from using strand tension measurement feedback to precisely control the feed rates of multiple strands to be wound as well as the feed rate of a dynamically fed subcomponent such as a cable core or magnet core.

Wind Form Filler. Another aspect of some embodiments of the present invention provides an LMHS that incorporates a wound former filler or bridge that prevents sharp bend points to occur in the wind-on material, particularly during flexure, operation, or other induced movement in a wound magnet, cable, cable magnet. Applied filler can be solid or liquid.

Managed Winding Gaps. Some embodiments of the present invention provide for specified and carefully managed creation of gaps among wound materials.

Advanced Sense and Control. The LMHS of one embodiment employs advanced control processes, techniques, algorithms, and supporting sensor, type, placement, and use beyond what winding systems use to date. A primary embodiment is the uniquely developed and used axial tension sensor as a basis for all wind feed rates and tension control.

Variable Media. Reviewers of this application and the applications described above will appreciate that in some respects the media type being wound or transferred is not relevant. More specifically, the wound media can be any type of delicate material (e.g., superconducting wire, tape, cable, etc.) wound or transferred from one location to another. Those of ordinary skill in the art will also recognize that the apparatus and methods described in these applications can be used to create cables, magnets, cable magnets, or any other device known in the art that incorporates wires or cables or linear media.

Full Transposition. Some winding machines described herein provide for the full transposition of the wound media being tapes and/or wires and/or cables. The wound media are set into a full transposition configuration when placed onto a former or are transposed without placing onto a former and then placed onto a former, which includes a cable core. An HTS cable embodiment with full transposition provides the first transformational change to a commercial power cable since the mid-1800s. The impact versus other SC cables include: 1) safely wound HTS commercial production cables; 2) first ever full transposition allowing AC with no length limits and pulsed power operation; 3) commercial solution versus just another demonstration project that does not address customer needs; 4) low total lifetime cost (TLC); 5) longest life; and 6) manufacturing ease for all cable sizes and options. The impact versus conventional cables include: 1) highest efficiency with "almost" lossless SC power delivery; 2) highest power and power density; 3) lowest voltage for same power; 4) lightest weight; 5) smallest size; 6) lowest TLC; 7) longest life; 8) no external electromagnetic (EM) fields; 9) no internal heat generation; 10) greenhouse gas mitigation (50% to near complete removal); 11) able to function as a Fault Current Limiter (FCL); 12) costly power equipment to power station removal increases reliability; 13) increased safety through lowered voltages; 14) enables new grid demands and applications; 15) complies with new regulations; 16) decreased right of way (RoW) (i.e. 150 meter overhead transmission lines RoW are replace by a single power equivalent 5.5 meter underground RoW); and 17) long effective charge length (over 100 km). Further, inherent protection and rating provides: 1) cryo cladding provides a self-contained thermal envelope which isolates the cold dielectric and HTS from the atmosphere; 2) EM shielding and decreased reactance removes power per distance derating of the cable and surrounding materials; 3) EM shielding and thermal isolation removes placement derating such as cable burial method, depth, or soil type; 4) no internal heat generation and cryo cladding removes derating for operational or ambient temperature loads; 5) cryogenic cooling slows to stops all chemical reactions such as surface oxidation and dielectric aging versus an elevated temperature cable; 6) lower voltage for the same power removes voltage derating while providing a higher safety rating; 7) self FCL protection; and 8) undergrounding removes environmental exposure.

Variable Twist Pitch and Angle. Another embodiment provides means of an optional, specialized winding allowance that is accomplished by an additional active DoF providing a continuous or changing twist pitch and another DoF for a continuous or changing twist angle from the wind-off spool, across the sensor systems such as axial tension, and onto the wind-on spool.

Subcables with Transposition. Another embodiment incorporates transposition winding and produces subcables from input SC tapes. Multiple embodiments variations can accomplish these subcables, such as the horizontal (SC spools in a flat plane) versus vertical (angled plane of SC spools in a sort of angled Ferris wheel) stack with respect to the former core for wind on. There are benefits of each where vertical SC spool stack allows a constant wind onto former pitch angle across the SCs with relatively simpler and automated control of the pitch angle and readily allows more SCs to form into a subcable.

Subcables, Transposition, and Twist Pitch. Current HTS cable fabrications methods do not allow a full transposition or a set twist pitch and angle because the diameter varies with each layer, which leads to an arbitrary twist pitch and angle as winding layers build. Transient including AC losses due to not allowing full transpositions or even controlled variable twist pitch leads to unacceptable high power transient based losses due to the inductive mismatch and associated high losses. These transient current losses are unacceptable in many high-power applications, including fusion, electric power transmission lines, pulsed power, etc.

Spool Rotation Around Cable. To achieve complete routing location and DoF control of cable winding, the spool systems must rotate relative to the dynamic former or cable core. Every embodiment shown in drawings here has a non-revolving cable core. This method of achieving the relative motion provides the advantage of not having to rotate the heavy spools of cable core at both end of the winding process. It also facilitates more complex processes such as winding cable magnets.

Braiding. The winding machine of one embodiment is capable of braiding up to an estimated 12 HTS tapes and more wires per subcable. One of ordinary skill in the art will appreciate that full transposition is where each linear media evenly assumes to each position in the subcable away from the former, but they are always in the same order. And braiding is a full transposition technique with the added complexity of swapping the linear media order as the linear media evenly assumes to each position in the subcable away from, or while being placed upon, the former.

Braiding adds a new layer of complexity beyond full transposition. In the four HTS tape example, the (1,2,3,4) winding sequence will alternate pairs and in order as in full transposition. In one embodiment, one or both pairs (1,2) and (3,4) alternate upon command. This addition is an order of magnitude more complex to accomplish in both mechanical design and process controls than full transposition, yet builds upon the full transposition technology. Braiding is not possible without a full transposition winding base and hence is a type of fully transposed wind.

Rotary Lift Stage with Tensioner. To assist with braiding and/or transposition, overlapping linear media of any sort such as a wire or tape is required. One embodiment is an active lift table incorporated at each SC spool location as a lift only embodiment or a lift performed with other actions embodiment as also described.

Automated Multiple Phased Winding. In one embodiment, the winding machine automatically creates single to multi-phase output when the phase groups remain electrically separated.

Superconducting Electric Machines. It is yet another aspect of some embodiments of the present invention to provide a transverse flux motor (TFM) that employs HTS, wherein the motor's stator and/or rotor portions are cryogenically cooled. The TFM components can also be partial or half cold. In one contemplated AC induction machine a field coil side can be replaced with conductive material, such as short circuited, passive HTS tapes perhaps in the form of coils, a squirrel cage, or sheet equivalent.

One embodiment of the contemplated invention is an air core AC or DC superconducting machine with HTS EM armature coils and HTS EM and TFM field poles, which maximizes rotational speed, removes all possible losses, provides the most efficient, power-dense, and specific power machine possible with today's technology. A fully HTS electric machine including complex curve multi-turn per layer HTS field and armature coils increases efficiency and power for the very low mass and volume, especially for a smaller sized machine electric machine, beyond any other currently possible within the same rotor velocity range. Fully cold HTS electric machine with curved HTS coil transformational benefits include: 1) highest efficiency (>99.0%); 2) highest power and power density; 3) lightest weight; 4) smallest size; 5) highest torque; 6) highest air gap B; 7) no internal heat generation; 8) safely wound HTS commercial production magnets; 9) first ever complex curve multi-turn per layer HTS field and armature coils; 10) fully cold machine; 11) TFMs incorporated with EM coils into the field poles; 12) TFM activation inside of the machine due to combined field and armature EM coil activation method; 13) least amount of conductor tape/wire required; and 14) manufacturing ease from winding to modular stockable/swappable subassemblies for all frame sizes. In this example, HTS primary losses are 85% removed. Machine performance increase is related to the number of magnets converted to HTS, starting with the removal of all magnet resistive losses. A Flat Fan HTS curved magnet design allows the removal of slots and harmonic losses. The HTS provided high air gap B allows an air core machine which, along with no PM use, removes all hysteretic losses. An evacuated air gap removes all windage loss. Cryogenic cooling loss is equivalent to conventional cooling loss.

Superconducting electric machines described herein apply to all electric vehicle types. In an electric aircraft propulsive motor embodiment, electric decoupling between the fan and turbine for independent speed control allows: 1) optimal operation throughout the flight regime; 2) yaw control through differential thrust; 3) the ability to provide high-velocity wing blowing with controlled thrust; and 4) noise reduction strategies. The increased circumference of an HTS aircraft propulsive motor further assists: 1) lowered blade tip speed requirements; and 2) increased stator magnetic volume for higher power and power density. Compared to conventional propeller or turbofan aircraft engines, electric propulsive motors are: 1) compact; 2) reliable; 3) efficient; 4) have lower mass where the aircraft motor to combustion engine weight reduction is over 70%; and 5) can be placed anywhere on the aircraft that provides external thrust via Distributed Electric Propulsion (DEP), an aviation gamechanger for any size aircraft.

Hybrid to Air Core. HTS provides a high air gap B, which allows a hybrid to fully air core device versus the common iron (Fe) core that directs the B into and across the air gap. In an electric machine embodiment, a half or derated HTS machine can use a hybrid air core design, where the teeth are air core but the back portion is Fe, which minimizes Fe core losses. Due to the high B possible from a fully HTS machine (far above Fe lamination saturation levels of ~0.6 to 1.1 T for costly laminations) and associated losses, the B is too high for Fe in a fully HTS machine making use of maximum B. A fully air core machine: 1) decreases weight; 2) eliminates Fe hysteresis loss; 3) reduces circulating current losses; 4) eliminates harmonics from the cogging torque caused by Fe slot openings; 5) increases allowable armature and field coil areas for windings; 6) provides a flexible structure for large and complex coil installation; 7) uses the complete B path for the magnetic energy versus only the mechanical air gap; 8) lowers vibration; 9) lowers noise; and 10) lowers total harmonic distortion.

Tape Curvature and Alignment for B Path. Iron, which controls the B path (including a normal B into the air gap), is absent in an air core device. Accordingly, a curved winding pattern is used to accommodate B path needs. Properly designed complex 3D shaped SC magnets allow compact and lighter sizing for high efficiency and B without exceeding HTS critical values. Multi-layer magnets, such as an electric machine field coil, incorporates radii at their corners to curve the B path and minimize placement of HTS in the highest B regions, like electric machine Fe tooth curves for limiting motor saturation. The highest HTS induced current occurs when the external B is perpendicular to the tape width, so in another unique design step, each HTS tape is placed and oriented to set the HTS width parallel to the highest B. When this configuration is not possible, such as certain armature configurations, HTS EM shields deflect the highest B from the tape width.

Flat Fan Magnetic Coil. The winding ability described herein turns the considered negatives of HTS tape geometry to an advantage. Flat Fan compact coil embodiments range from common EM-based devices to any EM specialty devices, such as circumferential electric machine (examples include a motor for an aircraft turbofan and a generator for a wind turbine), thrust tubes for exoatmospheric satellite ion propulsion, fusion reactors, and high energy physics particle accelerator beam compression/recompression and focusing to deflection magnets. For an electric machine embodiment, this increases electric machine performance far beyond any other machine attempt with an electrical machine as close to an ideal sinewave machine as current technology allows for a discrete, multi-turned winding.

An extremely high power, compact device of any type is also possible because HTS has no internal heat generation at any non-critical current level, excluding minute solder joint and EM transient conductor heating. No heat generation means there are no current thermal limits, no EM shielded winding cooling beyond cryo cool down, no parallel winds needed for internal current heating, etc. Given no large heat generation concerns, specialized complex HTS winding placement turns the very thin nature of HTS to an advantage, allowing a new "Flat Fan" coil to be built and placed into a new configuration. The flat fan coil uses a thin tape profile such as an HTS (often 0.2 mm for HTS) by placing the HTS tape width (often 2 to 12 mm) facing width along the straight length, like a shallow saddle coil that is densely packed and curved. B acts in a direction across the surface current, which is highest parallel to the longest length, so orienting the tape width perpendicular to the air gap gives the highest B across the air gap. Long wind depths are no longer required versus a single (pancake), double, or larger layer winding. When compacted into a pancake coil that curves to the air gap, this configuration places the thickness of all armature and field coil turns at the surface next to the air gap with no layers moving the HTS away from the air gap. This configuration maximizes the air gap B while minimizing losses. HTS in a flat fan allows a slotless armature with a small air gap and support for magnetic and mechanical forces, the main issues with slotless winds.

A slotless armature allows a high rpm, removal of slot losses, construction ease, and good armature back plane cooling, including removing the need to separate coil turns and coil groups for cooling purposes. The armature phases can then be placed next to one another, with or without a phase-to-phase HTS shielding layer, and then structurally bind all HTS phases into a single armature ring. Without slots and only shallow surface coils, the diameter, the best machine dimension to decrease for sizing and weight reduction needs, is minimized with only structural support and cooling beyond the radially outermost coils.

Field coils follow a similar structure of winding to thermal support. If operations including a quench do not structurally or thermally allow a slotless wind, then short, thin teeth or equivalent can also be incorporated. Harmonics are minimized in this highly distributed armature wind with each turn (of possibly 100's of turns for a small sized electric rotary, linear, arc, etc. machine and only increasing for larger sized machines) next to the air gap providing a slight B electromotive force (emf) step versus slot generated emf from concentrated windings with most turns far from the air gap. A single-phase is then a compact series of either vertical or angled HTS turns. In the individual HTS angle case each turn can be wound to partially overlap one another to further remove harmonics and further decrease any unwanted induced B in the tape width while providing the highest air gap B. For this case the HTS of the armature and/or field coil halves are angled into an overlapping V-pattern with respect to the B path.

The armature phase half turns in one embodiment turn inwards with respect to the field pole to accommodate the field coil B moving past the armature. To provide the lowest induced B in the field coils, the field turns in one embodiment turn outwards with respect to the field pole to accommodate any non-EM shielded B moving past the pole. An armature wind skew angle is possible but may not be necessary due to overlapping HTS turns. In one embodiment, armature and field coils are designed to have the field poles cover just over a one phase center to have a constant field to armature B connection to further reduce harmonic content. Although cogging torque is not a concern, a fractional pitch wind is still considered in one embodiment to focus on and remove any harmonics remaining. Without harmonics, mostly due to the highly distributed wind, all non-leakage B goes into the power-producing fundamental frequency.

If the stray B is minimized, critical HTS current is not approached, and if the B across the tape width is acceptable, then any tape width desired can be used for either the armature or field coils embodiment. For a high current machine, larger HTS widths provide a higher current output with a faster response time. On the lower end, smaller HTS widths allow many ampere-turns for a multi-layer coil else a high power, highly compact HTS single layer machine. Electrically, more turns give a higher emf with a natural current filter where HTS is already a high current output. More layers provide a higher power density within B and current critical limits.

Flat Fan End Turns. Conventional device end turns often experience leakage flux and copper (Cu) loss due to no back-iron and geometries that move the end turns away from the air gap and not orthogonal to the field coil B. Electric machine poles can overlap end turns on one or both sides making them part of the magnetic length due to: 1) the flat, fan geometry of the HTS end turns; 2) the short end turns air gap; 3) 45-degree or smaller end turn angle with respect to the straight armature length; and 4) no end turn resistive losses. Mainly for an air core and compact and/or short axial machine where the end turns are a large axial length percentage, this adds power density and efficiency by increasing useable axial length and removing leakage inductance for the end turns and nearby straight magnetic length. If the phase power is not smooth due to no phase transition region such as chording, field to phase overlaps, or enough inductive lag, end turn magnet lengths smooth phase power by automatically overlapping.

Curved Flat Fan Coils and TFMs. In one electric machine embodiment, the field coils are a flat fan with multi-dimensional curved sides to control the B path and further accommodate trapped field magnets (TFM), such as but not limited to HTS TFMs, to further increase the air gap B and output performance. In a further electric machine embodiment of an HTS electric machine, the EM coil outsides curve to enclose all TFMs while maximizing the B for a small air gap pole area that overlaps multiple armature phases. The HTS EM field pole: 1) activates the TFMs in the machine; 2) maximizes the field B; 3) augments and controls the B for a higher and more efficient fundamental B for each rpm; and 4) waveform shapes power generation when in a self-excitation mode with the armature. Because the TFM B forms the shape of an equilateral triangle with the maximum at the puck middle surface, in one embodiment TFMs are placed side to side facing and angled with the air gap to provide the maximum averaged air gap B. The entire pole is then curved to decrease the curved air gap to allow the highest B without quench while providing a variable air gap length at each pole end to further lower harmonics. Field coil TFMs are epoxied into place, which protects the TFM and for ease of rotor manufacturing. Sensors and heaters placed with the TFMs control deactivation. Rotor poles are connected to form a cylinder for structural support.

TFM activation in a conventional or half HTS EM wound machine is a large concern due to the limitations of Cu winds and the maximum B they can hold across the TFM. This concern is removed for a superconducting, such as HTS and MTS, EM due to the high B with no heat generation. In one embodiment, TFM activation is achieved by aligning the field pole to a specific armature phase location and applying a same direction DC B across both the armature and field HTS coils.

EM Shields. In an electric machine embodiment, EM shields are employed over the field poles, between armature phases, and over non-magnetic length end turns. These unique EM shield windings, with HTS being one embodiment: 1) offer lower quench issues; 2) support a higher B in a tight and contained path, especially in smaller magnets; 3) lowers mass by removing Fe and HTS turn needs; and 4) optimize efficiency by minimizing stray and hysteretic B loss while allowing more current per HTS strand. For an embodiment of an armature magnetic length and end turn EM shielding, one to multiple single strips of parallel HTS with possibly soldered ends is used. In the armature length, the HTS strips are placed between the phases. End turns will use shorted HTS strip EM shields between phases to protect against high frequency losses such as power conditioning system (PCS) switching. In some embodiments, a field pole EM shield for armature transients is required to minimize transient EM losses. In such cases if a field cryostat is required, then the stainless steel or aluminum or titanium or equivalent conductive metal cryostat wall will be considered for the EM shield, else shorted HTS strips are placed over the field poles. Due to the high conductivities and skin depth of all metals at cryogenic temperature, any high frequency metal EM shield is often very thin. Cryogenic cooling paths for all EM shields can provide an excellent inductively generated heat removal mechanism.

Compact Advanced Superconducting Devices. It is another aspect of some embodiments of the present invention to provide advanced, compact devices made of superconductors. The superconductors may be made or processed using the techniques described herein. Contemplated compact SC devices include but are not limited to: motor and generator machines, magnetic resonance imagining (MRI), nuclear magnetic resonance (NMR), surface NMR (SNMR) [which includes surface MRI (SMRI) in this document], fault current limiters (FCL), and any device that includes or uses a high EM field and/or current partly to fully created by an advanced SC. Advanced SCs contain materials that allow superconducting operation at higher temperatures and are generally more to significantly more mechanically fragile. The disclosed devices can be used for motors and generators, medical applications, geoscience applications, wind energy generators, hydro-electric generators, hybrid or all-electric vehicles, oil and gas applications, magnetic containment, high energy physics (HEP) and fusion applications, including high B magnets, greater than 16 Tesla (T) magnets, power systems, aeronautical and aerospace applications, EM propulsion (magprop), EM levitation (maglev), space EM shielding, ship systems, ground transportation, military, utility, agricultural, construction, mining, environmental, resource management, disaster relief, archeology, and any industry using an EM system. Although some of the instant disclosure is focused on compact systems, those of skill in the art will appreciate SC devices of any size can be manufactured.

Compact Superconducting Device. The compact advanced SC of one embodiment is a high output and/or resolution device compact in size and weight. Some compact SC devices may be personnel portable employing power, energy storage, controls, data acquisition (DAQ), operator interface, and cryogenic systems.

Component Based Superconducting Device. Another embodiment of the invention includes the SC magnet set and other elements being designed as swappable components or line replaceable units (LRUs).

Field Operable Superconducting Device. All superconducting devices have historically been placed in a lab or laboratory equivalent environment. This includes magnets, cables, and cable magnets for NMR and/or MRI or similar devices such as MRM from a hospital to semi-truck system, fusion, and high energy physics. The superconducting application reliability provided via the winding techniques and processes disclosed herein allows the possibility of moving outside of such as fully controlled environment from a mobile platform, such as supporting and powering and moving an airplane or ground or sea or space vehicle, or to the field, such as a personnel portable or small cart of vehicle mobile device or long-distance power cable or any linear, rotary, curved, etc. electric machine motoring or generation such as a wind turbine. HTS winding and magnet technique for a very compact and lightweight magnet for a high B with a controlled B path output applies to any magnet. Yet, the utility typically changes where for an electric machine high specific energy and energy density is attained, for fusion and high energy physics, high field magnets are attained in a compact size, and for an MRI, NMR, MRM, and similar science magnets a high resolution is attained in a compact size.

Field Operable Superconducting System. The superconducting application reliability provided the winding techniques and processes described herein allows this possibility on the component/device/product level, which leads to entire system level of components working together from how power is used to increase system, efficiency, and related reliability to the increased performance provided by a common cryogenic system. Developing components, particularly newer and lossless components such as HTS, allows system-level optimization and benefits that are otherwise negatives, such as using reflective power waves due to negligible system resistance and cable reactance but high electric machine and energy storage reactance. A fully HTS system is well suited to a simplified HTS microgrid with a single or minimized cryogen station. A common feature of HTS is a fully contained system, including the allowance of a cryogen, such as LN2, recuperation or replenishment for long term field use. Using and replenishing LN2 is readily possible versus other cryogen choices, particularly lower temperature, to the level of enabling compact to all-electric non-lab systems since LN2 is relatively low cost or simple to extract from air, easy to contain and transport with a compact unit remotely, and is easy to design into a cryogen cooling system. LN2, gaseous helium (GHe), or equivalent to higher temperature cryogen allows a more reliable and lower weight cryo system supplying all HTS devices, including cables, which then allows a HTS system.

In a superconducting versus conventional cable system embodiment, the use of HTS cables described in this patent at a system level provides a negligible resistance and low impedance path for bi-directional power balancing, including passive to active load sharing, to attract excess power to the cables disclosed herein versus conventional or non-transposed superconducting cable paths. This system solution provides a very low loss and natural power preferred path, which then enables remote renewables and a distributed, smart, and secure grid of any scale not allowed via other conventional to non-transposed superconducting cable system solutions. Use of these fully transposition cables also provides other system benefits such as lowering to removing power electronics to substation elements and turning the cable into a power element beyond power transmission such as fault current limiting, energy storage and power electronics, etc., thus removing these items common to any small to large scale power system architecture. In another cables embodiment, the negligible resistance and full transposition low impedance superconducting cable has localized turn to turn and phase to phase as well as system connectivity inductance and capacitance effects that can lead to lossy power wave reflections, which can be removed if designed at the system connection level of components and cable types and lengths.

In a superconducting devices and cable system solution embodiment, a complete HTS system solution can be designed to lower weight and increase power and efficiency by designing each component separately and using the system approach of designing the HTS components for a system response. One design example is the superconductor's ability for high current for any voltage and frequency capability across all HTS devices and cables, including using the full transposition cables disclosed herein to allow directly DC and AC power distribution system connecting multi-phase devices such as motors and generators. Another example is designing all superconducting negligible resistance and low impedance elements such that the end turns of an electric machine connected to a power conditioning system normally produce a high-frequency turn to turn loss response that translates into an electric machine to system lossy response. However, the superconducting electric machine and connected superconducting elements can be designed to remove this loss at the system level. In an electric aircraft embodiment example, specific power is critical for any aircraft, especially as the aircraft weight and range are increased, such as medium to large body aircraft, and faster flight speeds. Conventional conducting cables, electric machines, etc. and all supporting elements are too heavy for too low of power/energy, which hinder to prohibit the possibility of electric aircraft, whereas a hybrid to fully electric aircraft of any size is enabled when using HTS devices such as propulsion motors and power generators in general but especially when removing back iron for air core machines, cables, associated power electronics including LN2 cooling from the cryogen system to support higher power level power electronics in a lighter package, etc. In this electric aircraft embodiment, a fully HTS system enables larger sized, longer range, and faster all-electric aircraft by providing directly from the HTS devices and through airframe and flight conditions: 1) increased efficiency; 2) increased power; 3) extended range; 4) increased payload; 5) increased speed; 6) lowered operating costs; 7) lowered to removed fuel consumption; 8) removal of greenhouse gas emissions; 9) lowered noise; 10) greater stealth (lower thermal and visible signature); and 11) improved use of pulsed power capabilities. An all-electric aircraft allows higher propulsive efficiency due to: 1) efficient propulsive motor; 2) increased lift to drag ratio (L/D); 3) no combustion air needs (no emissions and less weight with no propulsive fuel and higher altitudes); 4) higher flight altitudes (lower air density provides less drag); 5) distributed electric propulsion (DEP); 6) boundary layer ingestion (BLI); 7) bypass ratio (BPR) from a current 12 to a possible 20; 8) electric decoupling between the fan and turbine for a turbine engine; and 9) windmilling of electric motors during descent provides regenerative electrical power. DEP benefits include: 1) electric machines and cable redundancy; 2) thinner wings (⅓ width of conventional wings reduces weight and drag); 3) more stable and efficient (due to enhanced airflow over the wings and lowered weight and drag); 4) decreased drag and support weight (reduced wake from reenergized momentum losses through BLI and DEP propulsors can be incorporated throughout a lifting body aircraft design such as mounted on the fuselage or distributed above, below, on the tips, or embedded in the wing versus the traditional aircraft large nacelle engine often located below the wing in a non-moving air configuration); 5) increased lift at low flight speeds (by raising the dynamic pressure over the wing which allows takeoff and landing on shorter runways; 6) lowered noise (due to slower blade tip speeds and faster climb rates for airport surroundings); and 7) relaxed engine-out design constraints leading to a smaller vertical tail plane (decreases weight and increases maneuverability).

Hybrid Superconducting Magnetics. The magnetics include hybrid embodiments with conventional electromagnet (EM) conductors and/or permanent magnets to complete wound SC and/or bulk TFM type SC. Embodiments include using magnetics of one type of source, such controlled and wound SC, to control and shape the magnetics of another type of source, such as a TFM or permanent magnet, whether part of the same pole or not.

Combined Superconducting Magnetics and Speed. Another embodiment of the invention is the combination of increasing the speed of a partial to complete SC device to further increase energy density and specific energy while not losing efficiency due to speed induced transient losses. In an electric machine embodiment, maximizing B with a fully HTS electric machine and extreme speeds (10,000 rpm and above) supports highest power and size reduction, leading to an ultra-high power and compact machine.

Superconducting Magnetic Prime Mover Power System Approach. The magnetic prime mover power system focus is atypical for an SC machine. Large scale efficiency and performance increase for any electrical machine is commonly achieved through the energy system means of increased relative motion of the magnetic reference frame, for example, the armature and exciter field coil in a synchronous motor and/or generator machine, and/or by maximizing the magnetic air gap magnetic flux density (B) for a particular operational temperature (T). This energy system approach is the future of SC machines once SC materials allow further increases. This common approach is not the direct focus of this embodiment. Instead, this embodiment incorporates a power system approach from the benefits of increased current density (J) from a system mindset.

Power Conditioning Specific to Superconducting System. Power conditioning systems (PCS) such as converters involve often solid state to sometimes non-sold state devices to provide system power control such as puled width modulation (PWM) switching. This high-frequency switching reflects power waves in the form of voltage spikes back across the system cables and onto elements such as the electric machines. The lossless and low impedance state of a fully superconducting system, such as the HTS or MTS embodiment, can involve unacceptably high-power reflections, loss, and noise. A properly designed PCS, as well as other superconducting system elements, can not only remove these losses but increase the desired fundamental frequency response. This is particularly true for a smart PCS and/or smart PCS elements.

Magprop. The winding to application descriptions herein, such as all electric machine descriptions, as applied to electromagnetic propulsion (magprop) including the embodiment of an HTS and MTS applied to any and all SC linear or curved electric machines of any type for terrestrial to extraterrestrial use including magnetic levitation (maglev) train propulsion and vehicle launchers including space launch systems.

Superconducting Inertial Propulsion. The winding to application descriptions herein, such as all electric machine descriptions, as applied to electromagnetic inertial propulsion including the embodiment of an HTS and MTS applied to any and all SC inertial propulsion of any type for terrestrial to extraterrestrial, including space, use including ion propulsion systems.

Maglev. The winding to application descriptions herein, such as all electric machine descriptions, as applied to magnetic levitation (maglev) including the embodiment of an HTS and MTS applied to any and all SC linear curved electric machines of any type for terrestrial to extraterrestrial use including magnetic levitation (maglev) train levitation and vehicle launchers including space launch systems.

Superconducting Transformer. The winding to application descriptions herein as applied to a transformer including the embodiment of an HTS and MTS regular to high frequency transformer. One embodiment of such a transformer may include a 3D printed core to support more advanced needs such as high frequency switching operations.

Superconducting Fault Current Limiters. The winding to application descriptions herein as applied to a superconducting fault current limiters (FCL) including the embodiment of an HTS and MTS regular to high transient and power FCL.

Superconducting Magnetic Energy Storage. The winding to application descriptions herein as applied to superconducting magnetic energy storage (SMES) including the embodiment of an HTS and MTS SMES.

Superconducting Flywheel Energy Storage. The winding to application descriptions herein as applied to a superconducting flywheel energy storage including the embodiment of an HTS and MTS regular to high speed and power flywheel.

Removal of Converter for Superconducting Power Train. A higher voltage can remove power converter steps and associated losses in part or at times in whole by replacing the converter with a well-tuned and stably filtered voltage transformer system. Maximizing the EMF or generated voltage (V) is achieved by maximizing the N per Faraday's Law and accordingly a greater primary to secondary magnetic coupling since inductance increases by the square of the N. Current (I) developed has no R dissipative energy component, the largest loss of a conventional machine, and negligible stray losses and hence is still very high which increases the total power generated and is only limited by the magnetic flux density (B) and SC critical values which are traded between series and parallel winding sets per phase.

On the system scale, this V instead of B and hence I output dominant generator and/or motor lessens to entirely remove the need for a power electronic converter in the power train and replaces the converter with a larger reactive power filter. The final intent is to allow maximum energy capture at a high V output across intermittent shaft rotations without a converter or other efficiency lowering device. This is then provided to a large V isolation capacitor bank with a single direction power flow configuration which then directly feeds the next level of V step up into the transmission lines.

Removal of Gearbox for Superconducting Power Train. SC machines can provide much higher torques via both a higher current (I) and B which enables the practical removal of gearboxes.

Superconducting High Field Magnets. The winding to application descriptions herein as applied to superconducting high field magnets including the embodiment of an HTS and MTS high field magnets for high energy physics (HEP) and fusion applications greater than 16 Tesla (T) magnets.

Superconducting Space EM Shielding. The winding to application descriptions herein as applied to superconducting electromagnetic (EM) shielding magnets including the embodiment of HTS and MTS EM shielding magnets.

Superconducting Device Data Control. An aspect of particular interest is data control for a field operable and/or component-based SC device. In particular MRI and general NMR embodiments of any size benefit from retaining raw data and processing data.

Compact NMR/MRI Coils. High resolution and compact, with one embodiment being personnel portable, NMR (where NMR includes MRI, MRM or magnetic resonance microscopy, and all equivalent type EM based devices) for EM based sensing embodiments range from human, animal, and plant health and processes to general investigations from lab and clinic to field use. Due to the benefits for the embodiment of converting all magnets to HTS, the unique HTS magnet winding and arrangement described herein, the extremely thin HTS profile, the size ratios of HTS individual magnet tape to overall magnet and the magnet proximity and size to field of view (FoV) where a smaller bore to large FoV is beneficial due to how B drops with distance, and small-bore size for a compact device, compact NMR, MRI, etc. benefits include for any fieldable device and in some cases any MRI and NMR: 1) highest efficiency allowing a compact system; 2) highest B (3 Tesla or more); 3) highest resolution and quality factor; 4) fastest response/scan time; 5) highest sensitivity; 6) highest signal to noise ratio (SNR); 7) highest field uniformity; 8) highest temporal stability; 9)

highest frequency EM shielding to possible containment; 10) lowest acoustic signature; 11) compact size; 12) very low weight; 13) some embodiments of personnel-portable; 14) rugged; 15) reliable; 16) in situ field operable; 17) in vivo; 18) real time; 19) structural imaging; 20) only known functional imaging; 21) no internal heat generation allowing a compact system; 22) non-invasive; 23) non-hazardous; 24) orientable to the subject's position; 25) largest bore; 26) largest bore to machine diameter ratio; 27) upgradeable to a split bore to accommodate large test subjects; 28) only known possible NMR spectroscopy inside of an MRI, due to HTS and compact sizing; 29) only all $LN_2$ commercial MRI; 30) simplified use from small size benefits to software; 31) autonomous operation capable; 32) only safely wound HTS commercial production magnets; 33) first ever complex curve multi-turn per layer HTS coils allowing the required EM configurations; 34) least amount of tape/wire required; 35) manufacturing ease from winding to modular stockable/swappable subassemblies; 36) modular; and 37) innovative low cost. A compact MRI of this type increases existing MRI field measurement capabilities 2× to 10× including voxel size due to these benefits.

HTS for NMR radio frequency (RF) coils allow a very high Q detection circuit which greatly supports response modes. For more sensitivity, a more uniform and higher main coil B ($B_0$) embodiment is used and the number of scans is increased to offset gradient B sensitivity loss. Sensitivity, scan time, and response signal to noise ratio (SNR) increase and slice thickness decreases with decreasing oscillating frequency and increasing the RF and B0 magnitude. The response resolution degrades as the test time increases where the test time is predominately polarization time. Since high B increases polarization time, for proximity measurements the B amplitudes are set to a lower value and increase as the sensitivity is increased. At a high sensitivity, the SNR and response resolution decrease. Due to the small device size and FoV proximity to all magnets, a uniform, high B and lowered frequency is easier to maintain and with far smaller power supplies than a large-scale MRI/NMR, but gradient non-linearities may require the embodiment of a warping algorithm. Due to mobility, resonant frequency drift checks are important, gradient amplifiers need time to stabilize, and periodic phantom image checks are often required. To optimize output while attenuating noise, certain main and RF coil embodiments will both change the B magnitude for the sensitivity of interest. The RF coil operational frequency and bandwidth are also controllable to tune for an appropriate Larmor frequency. Multiple RF coils will also be employed in unison to allow frequency tuning for material type of interest and sensitivity. MRI and MRM gradient coil embodiments may include capacitive reactive compensation circuits to assist with time response. Active gradient shielding will minimize eddy current and k-space trajectories will correct for gradient hardware.

In one MRM embodiment, the tube bore is small versus length and overall size is small enough to consider a long, single turn main coil option. Although the width is parallel to the B when building a long solenoid but in a pancake flat section, the common HTS width height is low versus the bore. This provides many turns for a low profile to approximate an ideal solenoid.

NMR Field of View. The compact design of some NMR, including MRI, MFM, etc. type devices, contemplated herein allows magnetic density required to achieve high resolutions, increased field uniformity, and increased temporal stability in a smaller volume. This aspect is realized because of the size of the HTS magnet tape compared to the magnet and the magnet proximity and size to the field of view (FoV).

Bore that Orients to Subject Position. One embodiment of the present invention SC device is compact enough in size and weight to allow orienting to a desired position, such as a desired operating position.

NMR Magnet Design. The compact design of some NMR, including MRI, MFM, etc. type devices, contemplated herein provide a B acting in a direction across the surface current, which is highest parallel to the longest B length. The embodiment of HTS very thin tape thickness (often 0.2 mm) versus the much larger width (2 to 12 mm) greatly supports most of the B aligned parallel to the width which superimposes the B for many turns aligned together. Radial NMR B coils such as RF and x y gradient coils are oriented for the tape thickness to align facing the bore center axis. Axial NMR B coils such as the main and z gradient coils are oriented for the tape width to align parallel to the bore center axis.

To solve the greatest NMR technical challenge, producing a homogenous $B_0$, two design features will be superimposed and varied for optimization. 1) flat spiral magnet: the very thin nature of HTS allows a new "flat spiral" coil to be built and placed into a new MRI, NMR, MRM, etc. configuration. By placing the flat spiral HTS tapes width to width along the entire bore length but with the option of evenly spaced gaps between turns, a large superposition of an extremely homogeneous and high $B_0$ with an acceptable number of turns is possible. Therefore, the main coil is spiral wound down the entire length which, due to the high strand J and B, approximates an ideal solenoid. 2) Addition of multi-layer coils as needed: The classic NMR main coil sets of many discrete main coils and supporting shim coils with long radial depths trying to approximate a uniform $B_0$ may no longer be required if the flat spiral is shown to provide the anticipated uniform $B_0$. Any $B_0$ non-uniformity at the axial bore ends can then incorporate bore end main magnets to expand the typical NMR z-axis FoV.

Successfully working with HTS embodiments, particularly at elevated B, requires additional design features for all coils. The highest HTS induced current is when the external B is perpendicular to the tape width. So, for more unique design steps each HTS tape is placed, including tape angle, to set the HTS width parallel to the highest external B and minimize placement of HTS in the highest B regions. Curved Corners: Multi-layer coils incorporate radii at their corners which angles the HTS with respect to the central bore z-axis. Although this HTS strand curvature provides a lowered corner packing factor, all these curvatures lower critical current density while developing a more homogeneous B by smoothing out the B source at the coil-to-coil transition and bore end regions. Bore ends may also include extra single to multiple layer coils to maintain a longer FoV with a constant $B_0$ as well as the embodiments of any bore location of combining Helmholtz coil pairs with long solenoid options. Stepped Magnets: To increase B homogeneity on all axes, Helmholtz coil pairs are stepped in decreasing radius and axial distance when moving from the FoV axially. When unable to curve the HTS, the B path is controlled via HTS EM shields: Used as necessary to deflect the highest B from the tape width while limiting stray fields. Due to the high conductivities and skin depth of all metals at cryogenic temperature, any metal EM shield is very thin. Cryogenic cooling paths for all EM shields will provide an excellent inductively generated heat removal mechanism.

These magnet design innovations optimal for a compact NMR and only allowable through specialized HTS winding described herein this patent will: 1) support a homogeneous $B_0$; 2) support a high B for all magnets including increasing the useful B; 3) increase HTS useful current density; 4) lower quench issues by protecting the HTS per the maximum self and external coil B; 5) lower mass by lowering iron (Fe) and HTS turn needs; 6) allow a compact magnet and MRI; 7) lower bore opening stray B by maintaining a tight and controlled B path, especially for smaller magnets, which removes external sense disruptions such as Fe in the ground and equipment to sensors outside of the bore; 8) optimize efficiency by minimizing stray and hysteretic B loss while allowing more current per HTS strand; and 9) possibly mitigate to remove the need for shim coils and phantom image corrections.

With only shallow and limited number of surface coils in these embodiments, HTS use is minimized and the outside NMR diameter, the best machine dimension to decrease for sizing and weight reduction needs, is also minimized with only structural support and cooling beyond the radially outermost coils. Standard 2 to 12 mm width HTS products are used for all magnets, depending on operation. HTS magnets operate at low, safe voltages while more turns with a thinner tape allow a natural current filter and smaller power supplies. The final HTS width choice will be determined by the highest B output for a set cross section, allowable power supply current, coil sizing, and ability to turn the tape away from the maximum B.

High Penetration Depth Surface NMR and More Elements. Using aspects of the invention described herein, an embodiment surface NMR (SNMR), which includes SMRI, will extend current limits for hydrogen and carbon detection.

SNMR Angled Gradient Coils. z-axis gradient coils are larger diameter rings for higher penetration depth and smaller rings for shorter depths and higher sensitivity. An embodiment of SNMR Angled Gradient and RF Coils, as used in an NMR/MRI versus the SNMR use of the Earth's magnetic field and current amplitudes to manipulate the signal's special origin to produce an image, achieve a higher resolution, the necessary response at high penetration depths, and support the tomography option. Gradient coils are set for angled direction pulsed field gradients and response echoes are tuned and filtered for differences between B susceptibility of rock grains, pore or free surface fluids, etc. Although the x and y-direction gradient coils are in pairs to increase their B and the RF response, all SNMR coils are single sided surface which leads to a non-linear B from all coils.

Performing conventional frequency/phase encoding imaging, especially with the complexity of non-linear and non-orthogonal gradient pairs, will require non-linear pulsed field gradients due to the geometry of the coils which further distorts the soil B susceptibility variations leading to a strong relaxation due to diffusion which affect relaxation time indicators of pore size and permeability. Not having orthogonal x and y gradient and RF coil magnets with respect to the other coil magnets severely limits depth of an SNMR. This is solved by an embodiment of groups of high-power gradient and possibly RF coils, else pairs and/or phased arrays of RF coils separated from the z center axis, oriented at 15 to 75 degrees with respect to the ground and pointed towards the center main coil axis to allow a deeper penetration depth. By focusing a few, such as 4, evenly paired gradient, and possibly RF, coil groups (in the x and y axes) at a single measurement point at the chosen depth (in the z axis) the gradient coil magnets will work to achieve a maximum orthogonal B to the main coil B at the depth of interest.

To better assist this system, the gradient coils could be set to allow a variable angle with respect to the ground and hence tuning the orthogonal component of the gradient B to the main coil B for the depth of interest. Then RF response data processing will require new math techniques with verified simulations to resolve the measurement including removal of data that is identified as not being part of an orthogonal magnetics reading. Although the outcome is not the ideal orthogonal gradient and RF B directions with respect to the main coil B, due to high power SCs this system still allows enough of a pulse to capture good data at desired penetration depth. Geometrically the gradient and RF coils assume a trapezoidal shape to focus the center magnetics and simulation compare with more ease. A concern with this method is how gradient coils induce an emf in all coils below which provides a gradient B shielding and added current density into the other coils. Due to the transient time of the gradient field, the coil relative geometries, the ability to cancel induced mutual effects via twisting or transposition techniques or by shielding all other coils from the gradient coils, this is currently not considered a concern. If this become a concern, then an embodiment for a solution is to reduce the gradient B overlapping the other coils via changing the gradient coil geometry and/or moving the gradient coils further away from the main coil center axis.

SNMR Angled and/or separated RF Coils. The RF coils, dependent upon the Larmor frequency, are more geometrically dependent than DC power coils. Impedance mismatches between the coil and ground will cause poor RF transmission in and out of the ground. RF coil geometries are chosen to optimize pulse train B frequency with the Larmor frequency at each penetration depth and hence sensitive volume of interest. The RF transmit and probe coils are combined but operate per response lag times. Larger area RF coils achieve both an even pulse response and higher echo sensitivity for longer penetration depths. An embodiment of RF probes are dual set phased array surface coils combined to produce a circularly polarized field with an optimal response in the region directly below the coils where the B lines from each 90-degree coil set are roughly perpendicular. An embodiment of RF symmetric configurations includes dual, quadrature, etc. and will be properly connected electrically providing noise cancellation and power boosting from source to echo response modes. Since symmetric RF coil configurations are highly geometry dependent between the region of interest and coils themselves, a 2× larger than shown RF array is another embodiment consideration. The RF coil number of turns versus pulse and resonator impedance levels are trades for these coil loss domain dominant SC coils. RF coils operate in an overcoupled inductive mode to control HTS current densities and increase bandwidth.

Notched and Graded Main Coils. Shim coils and winding techniques such as notched and graded main coils remove small wound coil magnetic moment inhomogeneities. These coil manufacturing errors arise from machine errors such as locating coil troughs, wire distribution during winding, contraction of the system when cooled to cryogen temperatures, magnetic force induced wire shifting, surrounding structure magnet impurities, and mechanical stress during transport. Passive and especially active coil shims, notches, and grading use is lessened to potentially removed due to an embodiment of 3D curved main coils producing a highly homogeneous FoV, the small FoV versus coil size assisting with FoV homogeneity, and the winding described herein removing most main coil manufacturing errors while allowing advanced 3D coil geometries to structure a desired B.

Focused Magnetic Array. A set of conventional and/or SC electromagnetic (EM), SC TFM, and/or permanent magnets also with the possible inclusion of permeable material such as iron (Fe) material all arranged to focus the magnet field while limiting stray field effects. In one embodiment of the focused magnetic array, as required by a compact NMR, is created by using highly 3D curved HTS Main Directional Coils. These coils are placed at the bore end and on the outside bore but just inside of bore end to actively provide a North/South pole, much like a spatially oriented PM magnetization Halbach array. This helps orient the main B static fields (B0) path at the bore end to immediately turn to the outside of the bore to minimize stray B0 and help contain B. Yet, unlike a PM used in a Halbach array, an SC allows a very high B to better support stray B containment and greater additional main B. The North/South orientation of these coils also actively superimpose more B into the B0 field from both the B path focusing on the outside bore ring as well as each individual coil provides more B directly into the bore.

To help these B0 effects an embodiment of a lamination stack, around 10 layers of thin M19 oriented with the flat parallel to the desired B0 path, is considered for placing into the center of the main directional coils. As the main coils are believed best designed, from the FoV out, as center, Helmholtz pair #1 (radial), Helmholtz pair #2 (axial), Helmholtz pair #3 (radial/square which steps down into the gradient coil radial level), the main directional coil just inside the bore end perfectly fits into the Helmholtz pair #2 coil space and the bore end coil fits around the Helmholtz pair #3. As the LN2 cooled HTS metal Cu stabilizer of the B main coils cancels all high frequency B attempting to go thru the side of the bore and, along with the cryostat, placing the main directional coils into the bore main coil gaps further directs all B back into the center bore while canceling all high frequency B. The main directional coils are intended to not only contain the B and enhance the B, but even act as shim coils to help provide a more homogenous and high B in the main bore. All B radially outside, with respect to the z-axis, of the main directional coils mostly cancels any remaining B from main bore stray B. For best operation, an embodiment of the main directional coil ends are rotated to center on same axis as the RF probes. To assist with B path containment and continuity, a thin Fe plate is also placed at the main directional coil to coil overlaps at the winding turn location on the side away from the FoV only, else the main B could be turned back. For a split configuration, both the RF probes and the main directional coils are rotationally aligned away from the split to provide the best SNR. These coils are designed to fit in a confined cryostat space while giving an acceptable area for directing the B0.

An embodiment of conducting bore ends act as a transient EM magnetic mirror and up to the skin depth effectively doubles the electric length which significantly improves homogeneity. At both bores, embodiments of removable passive and/or active EM shields called End Plates and End Annulus Plates provide magnetic mirror response for NMR bore ends. The End Plate approximately doubles RF response and is used for far end bore closure when observing sections. The End Annulus is for all thru plant locations and when in use commonly gives a greater RF response and associated EM shielding at that end. A combined EM and Fe shield in an End Annulus shuttered closure mechanism to close down onto the subject in the bore access along with additional external Fe and EM shields, such as an EM shielded shell, can be added to the system to limit fringe fields for SNR.

A magnet set cryostat embodiment is comprised of a conductive wall acting as an EM shield on all surfaces excluding the bore facing surfaces. The cryostat EM shield will enclose the HTS coils excluding the bore openings and act as a Faraday box protecting external NMR areas from EM transients while also providing a minor waveguide for the RF source and echo response EM power direction needs. An embodiment of separating the cryostat into EM shielded zones to further lower the power loss along with the RF coils. Because it is desired to place all HTS coils as close to the subject as possible, the cryostat inside bore will be a thin, non-electrically conductive material to thermally insulate the system without condensate and not attenuate the source or response transient B. A turned inwards Cu curved sheet at the axial bore end located just beyond the RF antenna radius acts as a bore end RF waveguide. Length of this bore end waveguide into the bore axis depends upon general transient heating and gradient coil loss effects. If needed, a thin Fe shield is placed outside the main coil as the cryostat outside wall to retain B0 while staying within portability weight limits. Unlike LHe, LN2 readily allows all EM shields a transient heating conductive cooling path without adding significant cryogen heat loads.

Geometric and Operationally Tunable Coils. In an SNMR the most difficult technical needs involve achieving a highly controllable DC and RF B at each resolution gap down to the penetration depth for atomic tipping and then detecting the response echoes. In one embodiment, a larger main coil is used for greater penetration depths for a uniform B. Further, to compensate for the loss of gradient field sensitivity, the number of scans is increased proportionally to depth. This SNMR magnetic field gradient depends upon three factors: 1) tool design and configuration, 2) B gradients, and 3) environmental conditions.

Electromagnetic (EM) Material Containment. Containing the majority of electromagnetic (EM) radiation is a concern across industries, yet mostly for the Medical MRI profession. Current NMR and MRI at best shield part of the EM noise.

Acoustic Containment. Containing majority to all of acoustic noise is a concern across industries yet mostly for the Medical MRI profession. Current NMR and MRI at best shield part of the acoustic noise.

Electromagnetic (EM) Material Containment Cooling. Thermally conductive materials to allow cooling for all electromagnetic (EM) containment shields will be provided. Unlike LHe, LN2 readily allows the embodiment for all EM shields a transient heating conductive cooling path without adding significant cryogen heat loads.

Cool Down Method and Plenum Design. At the start of the cryogen cool down process, the liquid nitrogen plenum is used to push gaseous nitrogen (GN2) to evacuate air in the warm cryostat prior to LN2. When not using this GN2 push method, $LN_2$ pressure push produces a backpressure during cool down as $LN_2$ turns to a gas which delays cool down and recovery times which then leads to an LN2 pull method, which also helps remove the cryostat pre-cool down gas purge step.

Cryogen Gas Venting System. A cryogen, such as GN2, venting system is required. During a fault example, the 1:694 LN2 to nitrogen gas (GN2) expansion ratio presents concern for pressure release incidents and GN2 asphyxiation to humans and animals. One embodiment is an electric aircraft where GN2 is actively vented during pre-flight chill-down and the LN2 system is closed loop once cooled. Dedicated, thick-walled venting pipes remove GN2 from enclosed person/animal occupied areas while maintaining GN2 in the superconducting device for fast fault recovery, as an example by connecting to a superconducting cable at 5 meter intervals with enclosed and redundant pressure relief valves (PRV) internal to the pipe at each cable connection.

Additional embodiments. It is thus one embodiment of the present invention to provide a winding machine that may be capable of twenty DoF, comprising: a frame having an upper portion and a base portion; a wind-off spool subassembly, comprising: a first linear actuator interconnected to the base, a first rotary actuator interconnected to the first linear actuator, a second linear actuator interconnected to the first rotary linear actuator, a wind-off frame interconnected to the second linear actuator, and a rotatable wind-off spool, which is adapted to carry linear media, operatively interconnected to the wind-off frame; a follower subassembly, comprising: a third linear actuator interconnected to a cross member of the upper portion of the frame, the third linear actuator being substantially oriented with the first linear actuator, a second rotary actuator interconnected to the third linear actuator, a plate interconnected to the second rotary actuator, at least one riser interconnected to the plate, at least one beam interconnected to at least one riser, a tensiometer operatively associated with the at least one beam, a transverse beam interconnected to at least one beam and spaced from the tensiometer, a turning fork rotatably interconnected to the transverse beam, the turning fork ending in parallel guides adapted to receive the linear matter, a fourth linear actuator interconnected to a frame member associated with the plate, wherein the fourth linear actuator is configured to urge a first arm in a direction non-parallel to the third linear actuator, a fifth linear actuator interconnected to a frame member associated with the plate, wherein the fifth linear actuator is configured to urge a second arm in a direction non-parallel to the third linear actuator, a sixth linear actuator interconnected to the fourth linear actuator, wherein the sixth linear actuator is configured to urge a third arm in a direction orthogonal to the fourth linear actuator, a seventh linear actuator interconnected to the fifth linear actuator, wherein the seventh linear actuator is configured to urge a fourth arm in a direction orthogonal to the fifth linear actuator, a third rotary actuator interconnected to the sixth linear actuator, a fourth rotary actuator interconnected to the seventh linear actuator, an eighth linear actuator interconnected to the third rotary actuator, wherein the eighth linear actuator is configured to urge a fifth arm in a direction towards the linear media, a ninth linear actuator interconnected to the fourth rotary actuator, wherein the ninth linear actuator is configured to urge a sixth arm in a direction towards the linear media, a first wind-on guide interconnected to an end of the fifth arm, and a second wind-on guide interconnected to an end of the sixth arm; a former subassembly, comprising: at least one tenth linear actuator interconnected to the base portion, at least one eleventh linear actuator interconnected to the base portion, a twelfth linear actuator interconnected to the tenth and twelfth linear actuators, a fifth rotary actuator interconnected to the twelfth linear actuator, a wind-on frame interconnected to the fifth rotary actuator, a sixth winding arc rotation interconnected to the fifth rotary actuator, and a wind-on spool operatively interconnected to the wind-on frame, the wind-on spool configured to rotate and adapted to receive the linear media; and wherein the linear media is taken from the wind-off spool, transitioned about the tensiometer, and wound onto the wind-on spool to form a magnet, and wherein the turning fork, the first wind-on guide, and the second wind-on guide along with selective movement of at least one of the first linear actuator, second linear actuator, third linear actuator, fourth linear actuator, fifth linear actuator, sixth linear actuator, seventh linear actuator, eighth linear actuator, ninth linear actuator, tenth linear actuator, eleventh linear actuator, twelfth linear actuator, first rotary actuator, second rotary actuator, third rotary actuator, fourth rotary actuator, fifth rotary actuator, or sixth winding arc rotation control the position of the linear media. The wind-on spool associated with a sixth rotary device at the spool location provides winding arc rotation, thereby allowing the wind-on spool to selectively tilt which include embodiments such as a goniometer or a rack and pinion arc mechanism.

It is yet another aspect of some embodiments to provide a winding machine, comprising: a wind-off spool adapted to carry linear media; a wind-on spool adapted to receive the linear media; a follower subassembly positioned between the wind-off spool and the wind-on spool, comprising: at least one actuator associated with at least one wind-on guide subassembly, the at least one actuator configured to selectively impart lateral motion, transverse motion, or a combination thereof relative to the wind-on spool onto the at least one wind-on guide subassembly, the at least one wind-on guide subassembly comprising: a rotary guide actuator, a linear guide actuator operably interconnected to the rotary guide actuator, a wind-on guide operably interconnected to the linear guide actuator, wherein the linear guide actuator provides at least selective movement of an end of the wind-on guide towards or away from the wind-on spool, wherein the rotary guide actuator provides selective arcuate translation of the end of the wind-on guide; and wherein the linear media is taken from the wind-off spool and wound onto the wind-on spool to form a magnet, cable, or cable magnet, and wherein selective movement of the linear guide actuator or the rotary guide actuator controls the position of the linear media as it is placed on the wind-on spool.

It is still yet another aspect of some embodiments to provide a winding machine for use with linear media, comprising: a linear media supply spool adapted to store the linear media and from which linear media is removed; a cable core, magnet, or cable magnet associated with a wind-off spool; at least one motor that translates the cable core, magnet, or cable magnet, thereby transferring the cable core, magnet, or cable magnet onto a wind-on spool, a wrapping station configured to wrap linear media strands from the linear media supply spool onto the cable core, magnet, or cable magnet; and a component integration station that adds a component to the cable core, magnet, or cable magnet before, during, or after the cable core, magnet, or cable magnet is wound onto the wind-on spool or a former.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present invention are possible utilizing, alone or in combination, as set forth above and/or described in the accompanying figures and/or in the description herein below.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and drawing figures are to be understood as being approximations which may be modified in all instances as required for a particular application of the novel assembly and method described herein.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description and in the appended drawing figures.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIG. 1 through FIG. 5 illustrate an embodiment of the present invention that satisfies the requirements described above with respect to winding delicate linear media, such as superconducting wire, into a coil shape. Typically, superconducting wire will be wound onto a spool and then reacted as described above to create a magnet or shape capable of making very strong electromagnetic fields. A spool of reacted superconductor wire from which the wire is to be removed (the wind-off spool) is loaded onto the lower spool position. The system according to some embodiments of the invention shown in FIG. 1 through FIG. 4 is a dual system, with the capacity for two different wind-off spools and two wind-on spools. Other system configurations are possible within the scope of the invention, including systems with N wind-off and N wind-on spools, where N may be one or N may be greater than two. The wire is not shown in these figures for purposes of clarity in illustrating the apparatus components. Although in one embodiment for magnets is shown in FIG. 1 through FIG. 5, the wind-off spool is the lower spool and the wind-on spool is an upper spool, any orientation could be used, including for example a reverse arrangement or two spools side-by-side at the same height.

Another category of embodiments of this invention employs arrangements that produce windings around a linear former instead of a spool. Thus, cables are produced from even delicate media including advanced superconducting wire. FIG. 11 through FIG. 17/17A show demonstrators and portions of machines as examples of this category of embodiments. Each of these examples demonstrate the one arrangement of revolving the media source spools around the cable core to accomplish the winding. Other embodiments not shown are arranged such that the cable core revolves and the media source spools have one fewer DoF required to accomplish the cable wind.

Figure 10:
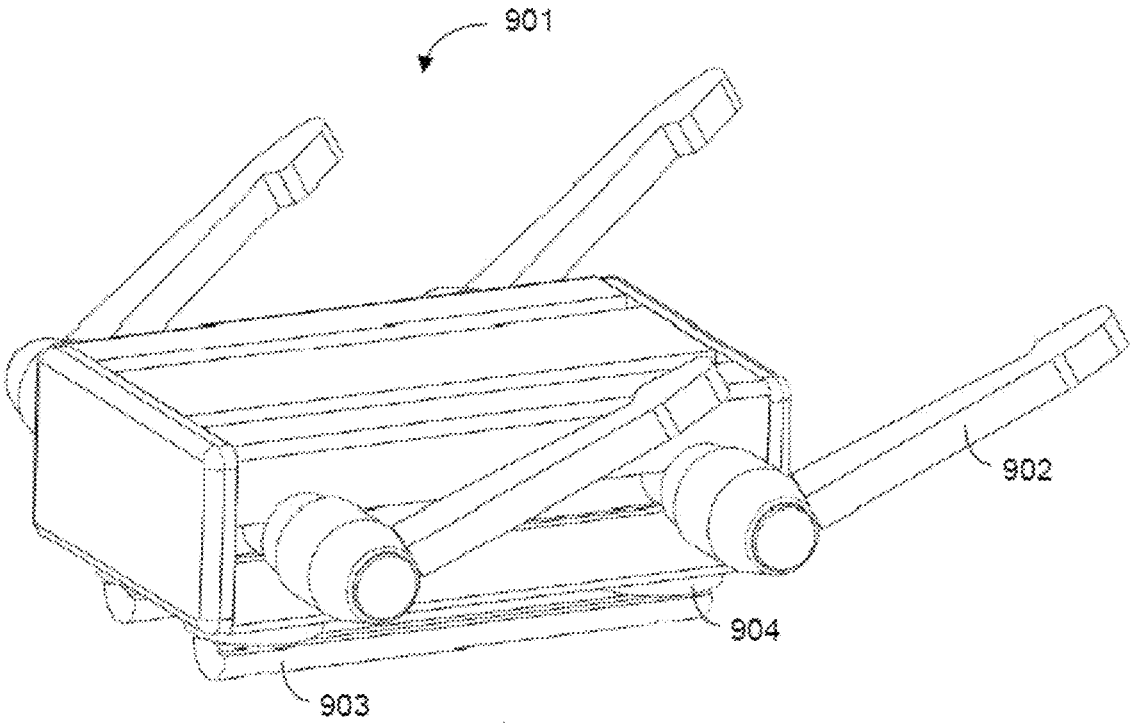
FIG. 10 is an illustration of a carriage that can be used to move and/or lock components of the media handling system in place.

Wire winding machine 100 comprises a frame 101 that supports the various components of the apparatus. Some embodiments of a wire winding machine according to the present invention can make use of commercially available framing systems using metal frame elements that can be mounted together in any desired configuration. In the embodiment of claim 5, the frame elements form a rectangular box shape, with various cross members for additional structural support. Referring also to FIG. 10, some embodiments of the present invention can make use of the novel MMP Carriages that allow frame elements within the overall outer frame to be readily moved and locked into place, whether in a no-load or high load setup. Such allowance provides for readily manipulating frame elements into new process configurations not possible with regular extrusion setups. Using MMP Carriages, it is possible to accommodate the manual positioning of both the wind-off and wind-on spools into any 3D location within the frame. Some embodiments of a wire winding machine according to the present invention can also include a gantry or crane system for the purpose of readily moving a load within the overall frame either within a single process station or to transfer a load between multiple stations.

Lower spool 110 (the wind-off spool) will typically be loaded with reacted superconductor wire, which is being transferred to upper spool 108 (the wind-on spool). Rotational motors 134 and 135 can cause the lower spool 110 and upper spool 108, respectively, to rotate in order to unwind the reacted wire from the lower spool 110 and wind it onto the upper spool 108. Rotational motors 134 and 135 can preferably be operated independently of one another.

Figure 5:
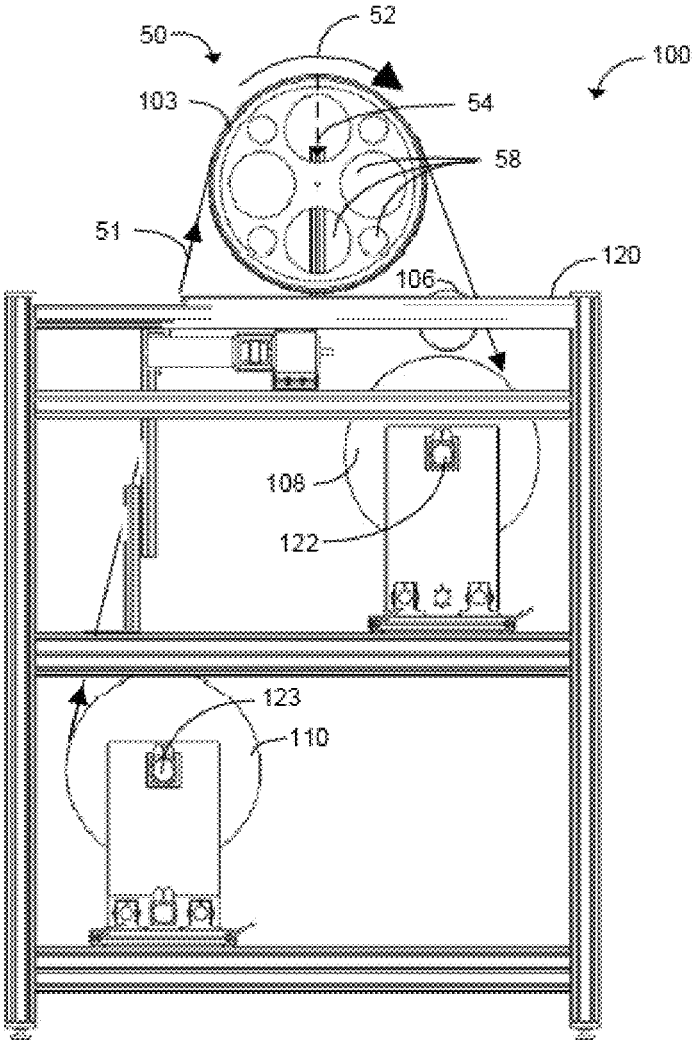
FIG. 5 shows a side view thereof and provides clear view of media routing path.
Figure 6:
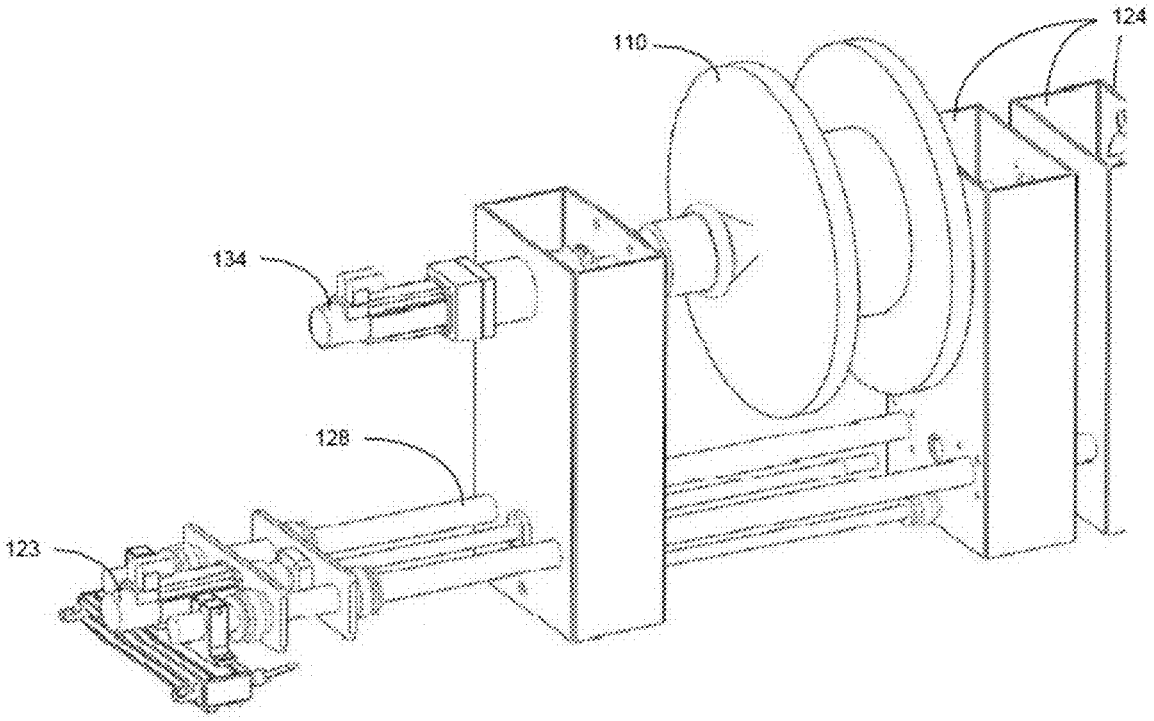
FIG. 6 shows an isometric view of the shaft supports and the shaft support rods according to one embodiment the present invention.
Figure 7:
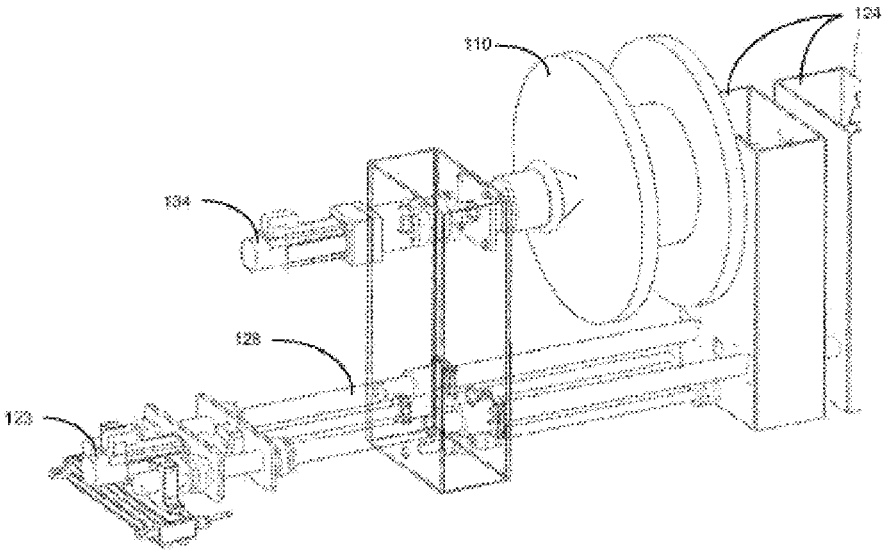
FIG. 7 shows a view of FIG. 6 with one of the supports shown as transparent.

Referring also to FIG. 5, wire from the lower spool 110 would be fed up and over the tension wheel 103 of the wire tension sensing system 50 in the direction shown by arrows 51 and 52. According to some embodiments of the present invention, the wire tension sensing system 50 is used as the primary control loop for the operation of the entire apparatus. This can be referred to as direct closed loop axial control, which is developed by directly sensing the axial tension on the linear media. The determination of axial tension can be problematic for delicate linear media. Many types of prior art tension measuring systems inherently induce some additional tension onto the media through the use of multiple pulleys or levers contacting the moving media. Further, many prior art tension measuring systems introduce small diameter bends and even reverse bends to the linear media. Either of these situations can destroy delicate media such as superconductor wire.

The accurate determination of axial tension without damaging the delicate linear media can be accomplished, for example, by the novel wire tension sensing system 50 according to the present invention. The wire tension sensing system 50 of the present invention makes use of a tension sensor wheel 103 and a tensiometer 104 (see also FIG. 1 through FIG. 3).

Because the tension sensing system should have no reverse bends, it is preferred that only one tension sensor wheel 103 is used, instead of the more common three-pulley tensiometers of the prior art. A single wheel system is also advantageous because the complexity of wire/media routing is minimized and there is less chance of fouling the wire surface or fibers. The arrangement between the wind-off spool 110, the tension sensor wheel 103, and the wind-on spool 108 incorporates a bend around tension sensor wheel 103 (as shown by line 52 in FIG. 5) that is close to 180 degrees for a better tension measurement. Because of the sizes of the spools (loaded and unloaded) and the other components of a winding machine according to the present invention, it will often be impractical to use a 180-degree bend around the tension sensor wheel. In the embodiment shown in FIG. 5, the bend is approximately 160 degrees. Any measurement error resulting from the angle will be small enough that it can be ignored. Alternatively, the error can be corrected for during the axial tension calculations. In some embodiments, angles as low as 60 degrees could be used.

The media is passed over wheel 103 which is supported by a center bolt 305 (see also FIG. 3) that is part of the tensiometer system 104. A known Wheatstone bridge arrangement allows the stress applied to the bolt to be measured to a high degree of accuracy. Persons of skill in the art will recognize that the center bolt 305 will also be stressed by the weight of wheel 103. The weight of the wheel 103 will need to be zeroed out in order to measure only the strain on the shaft caused by the delicate media. According to some embodiments of the present invention, the tension on the media can be calculated (preferably by software operating on a computer memory) from the angle of the wire, the diameter of the wheel 103, the temperature, and the stress applied to bolt 305 using a known calculation. For most applications, the angle of the wire will not change enough to be significant, but where there is a large change (which might result from a relatively large amount of wire wound onto or from a narrow spool) the angle will have to be calculated. In some embodiments, the wire angle can also be sensed by an appropriate sensor using known techniques.

While such a wheel and tensiometer arrangement is known in the art, Applicant has discovered that the bend radius requirements for the storage spools must also be applied to this type of tension sensing wheel in order for the apparatus to determine the media's axial tension in order to handle the media without damage. Accordingly, when winding, for example, magnesium diboride superconductor wire, wheel 103 will preferably have a diameter of at least 22 inches.

The relatively large size of the wheel causes a number of problems for the tension sensing system 50. Because the tensiometer arrangement for measuring the stress applied to the center bolt 305 needs to be able to accurately sense very small forces (typically less than 3 pounds) a large, heavy wheel will typically weigh so much that it will damage or degrade the performance of a sensor with a measurement range that covers such small forces. For example, if a very heavy wheel is used, the very small forces that are allowable for axial tension of a delicate media will make up only a small portion of the total force applied to the center bolt (with the large majority being the mass of the wheel). The forces to be measured will thus be largely lost within the system noise and measurement accuracy will be very low. Sensor resolution tends to be expressed as a percentage of the total measurement range of the sensor. For example, if a family of sensors has a resolution of 0.5%, a sensor capable of measuring up to 50 pounds for example, would have a resolution of 0.25 pounds. Such a sensor would not be able to allow the system to control axial tension to within +/−0.1 pounds as discussed above. A sensor with a higher resolution, however, would have a correspondingly lower measurement range. For example, a sensor with a range of 11 pounds would have a resolution of approximately 0.05 pounds. Such a sensor would provide the required resolution to control axial tension to within +/−0.1 pounds, but the total weight of the wheel and the tension (the desired tension could be on the order of about three-five pounds, for example) must be within the sensor's measurement range. Skilled persons will realize that it is preferable that the sensor resolution actually be as low as possible in relation to the allowable axial tension tolerances.

Therefore, the axial tension sensor wheel, the primary control feedback mechanism, should be as low as possible in overall mass to stay within the precision sensor limits to maintain a precise measurement as well as to allow the feedback motors to properly and safely control the media motion. The overall mass directly relates to the sensor range and accuracy limits possible for a reading and preferred values are case dependent for desired sensor feedback.

As a result, in one embodiment the wheel 103 be formed from a very lightweight material and that the wheel itself have a number of cutouts 58 to reduce the overall weight of the wheel. In some embodiments of the present invention, the wheel will weigh no more than 10 pounds, despite having a radius of 11 inches; more preferably, the wheel will weigh 5 pounds or less. The maximum allowable weight of the measurement wheel itself is dependent upon the axial forces being measured and the required sensor resolution. For example, where the maximum allowable axial force on the delicate linear media is three pounds, and the required tension tolerance (variability) is +/−0.1 pounds, the maximum preferred wheel mass would be approximately 7 pounds (for a resolution that is approximately half of the allowable tension tolerance).

Wheel 103 may have a very evenly distributed and uniform mass around the circumference. Any variation in mass can introduce inaccuracies in the axial force determination, which can be very detrimental to safe media handling. In some embodiments of the present invention, the wheel's angular variation in mass will be no more than 1/10 of the desired winding (axial) tension tolerance resolution. In some embodiments, minor variations in mass can be compensated for by calibrating the wheel and adjusting the sensor signal accordingly. Preferably, the wheel can be formed of a lightweight plastic or carbon fiber material, although any suitable lightweight material could be used that is rigid enough to support the wire and maintain a uniform mass around the circumference of the wheel. A suitable wheel can be manufactured by any suitable means, including for example, injection molding, 3-D printing, or stereolithography.

By using direct closed loop axial control as described herein, the delicate media can be unwound from the wind-off coil 110 and wound onto the wind-on coil 108 without producing an axial load that will damage the media. As the media is being transferred from one spool to the other, if the axial tension rises to a preset threshold, the system controller 137 will operate to compare the sensed axial tension to the preset threshold and then to reduce the tension, for example by speeding up the rotation of the lower wind-off spool 110 by a small amount. If the tension falls too low, the rotation of the wind-off spool 110 could be slowed by a small amount. In one embodiment, the rotational speeds of both spools can be controlled so that the system can maintain a proper media tension at the desired winding speed. Operation of the system controller 137 can be programmed via computer and monitor 140.

Figure 1:
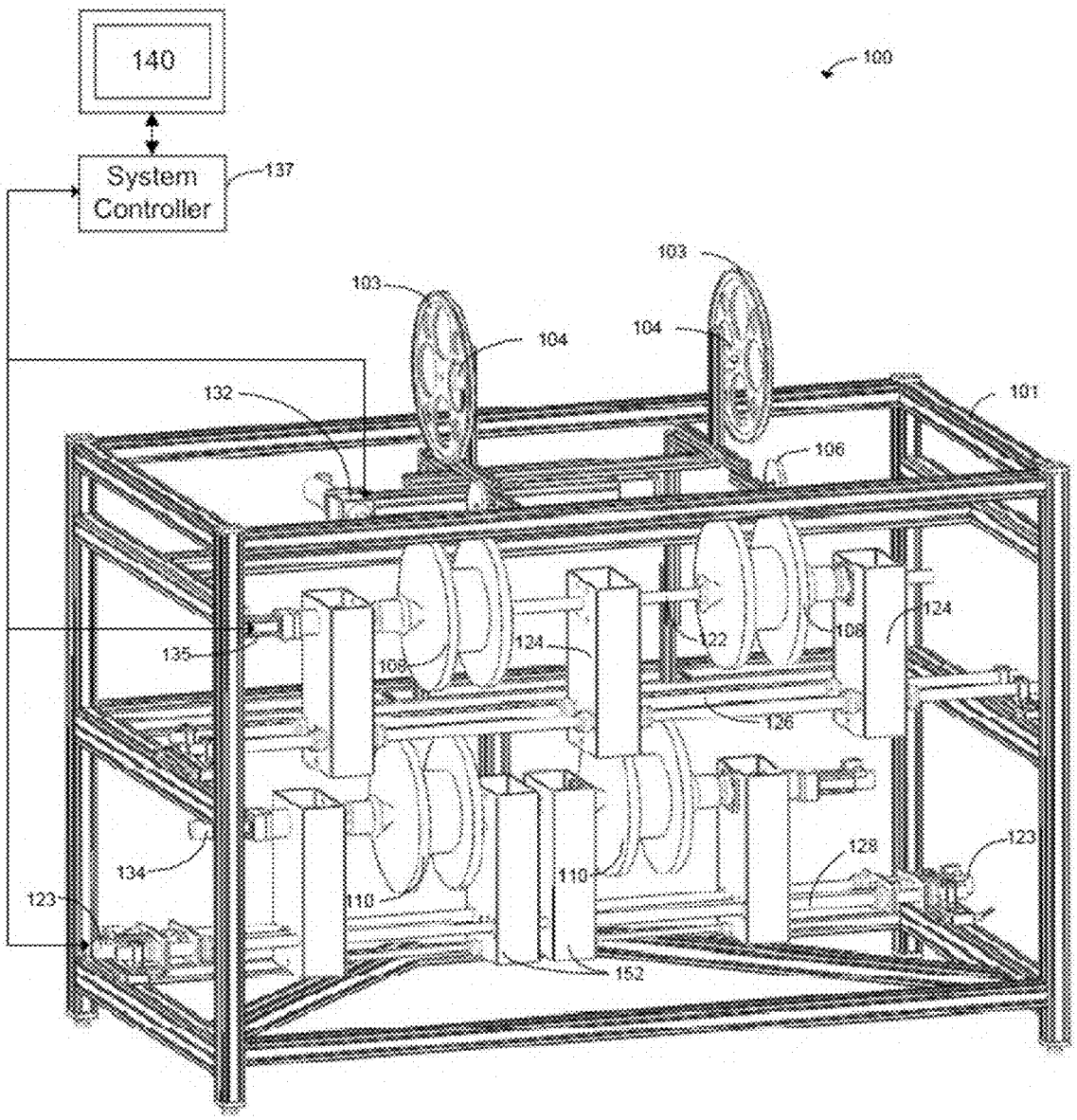
FIG. 1 shows an isometric front view of a linear media handling system according to one embodiment the present invention.
Figure 2:
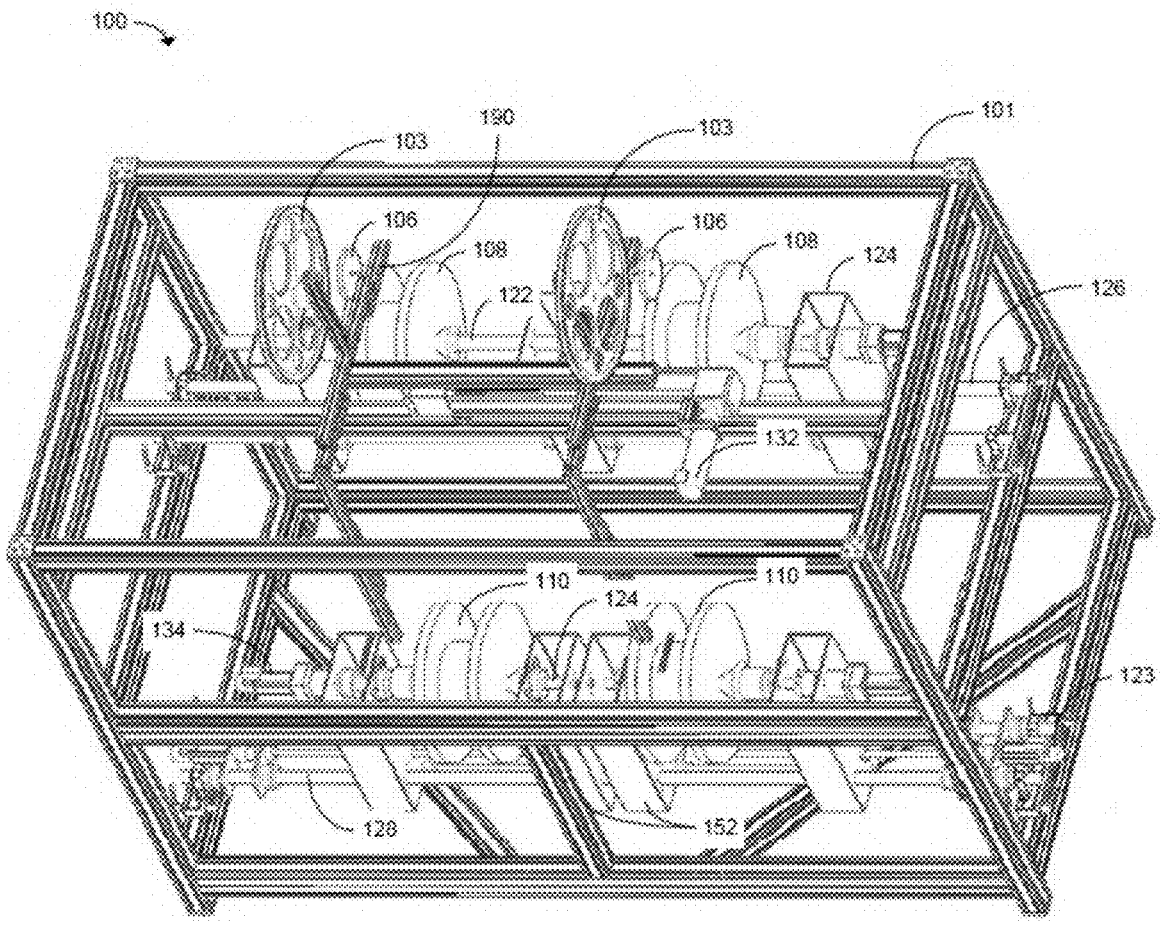
FIG. 2 shows an isometric top-down rear view of the embodiment of FIG. 1.
Figure 3:
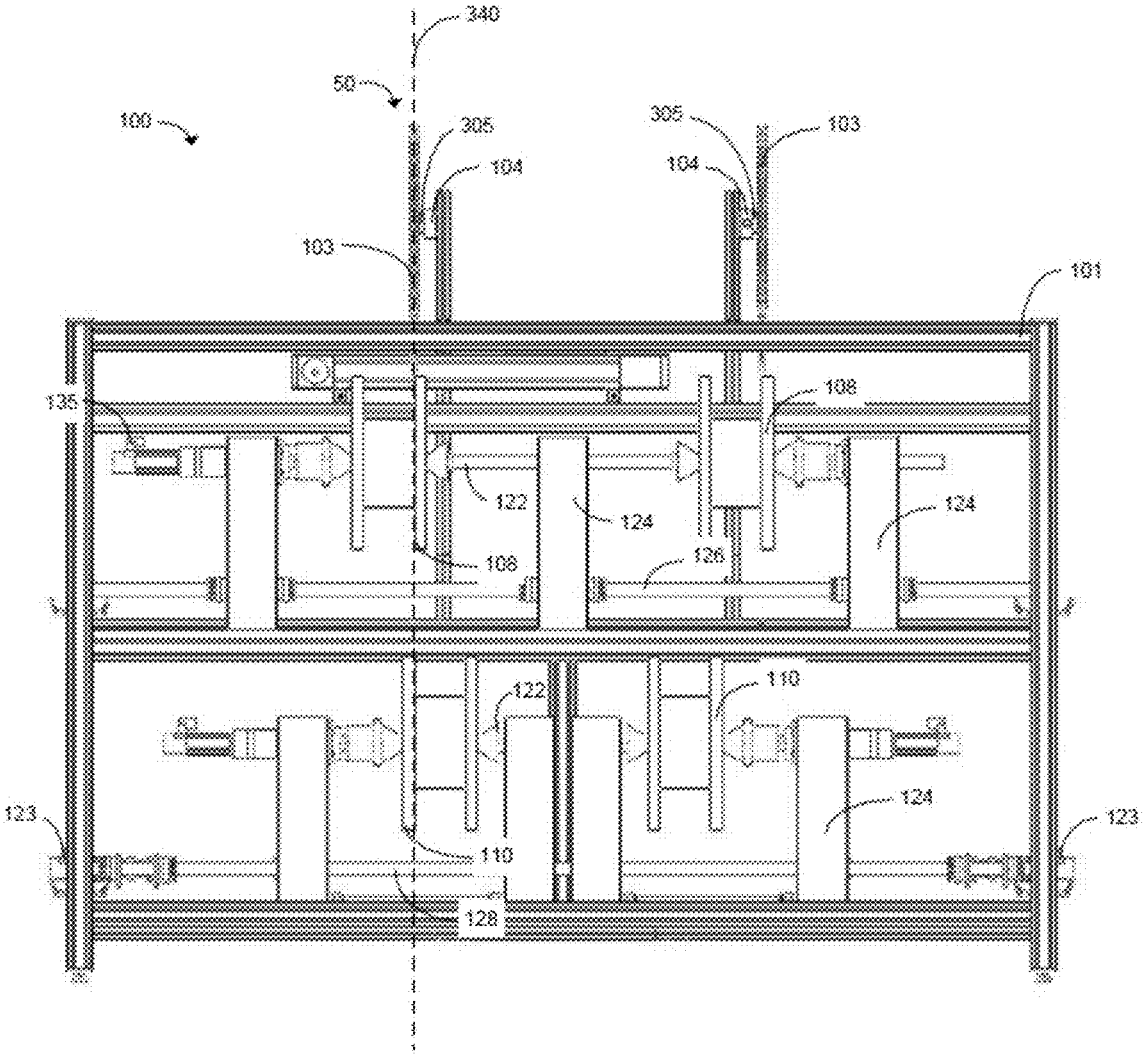
FIG. 3 shows a front view thereof.
Figure 4:
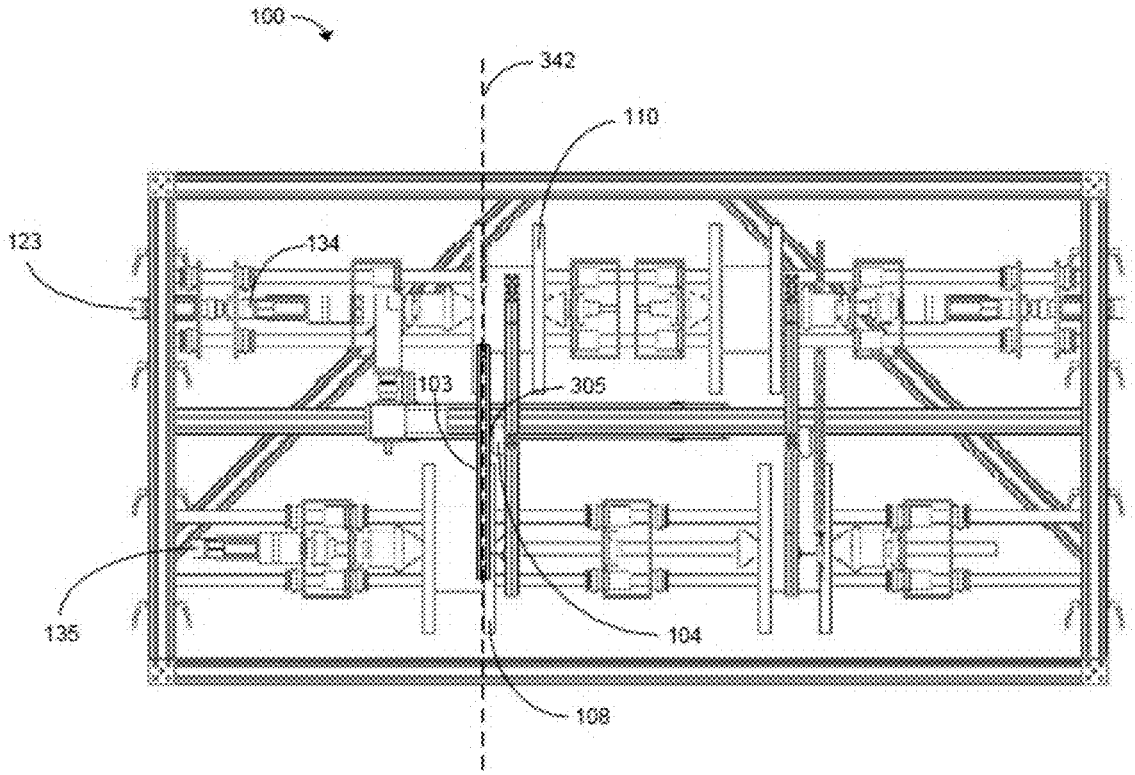
FIG. 4 shows a plan view thereof.

As described above with respect to Direct Closed Loop Lateral control, it is also preferable that any lateral stress on the wire as it is wound from the lower spool 110 to the upper spool 108 be eliminated, or at least minimized to no more than 1/10 of the maximum allowed axial tension. In some embodiments of the present invention, this is accomplished by maintaining the wind-off and wind-on points of spools 110 and 108, respectively, as well as the tension sensor wheel 103, in substantially the same plane. This is illustrated in FIG. 3 and FIG. 4 by dashed lines 340 and 342, respectively. As shown in FIG. 3, while the left-hand (as viewed from the front of the system 100) winding system is being used, wire would be winding off the far left of lower wind-off spool 110. The wire would then pass over tension wheel 103 and back down to wind onto the far right of upper wind-on spool 108. The positioning of the wire with respect to the upper spool 108 is aided by a follower wheel 106 (see FIG. 2 and FIG. 5) located between the tension sensor wheel 103 and the wind-on spool 108. The wheel 103 and follower 106 are preferably moveable so that they can maintain a position that is largely in line with the desired position on the wind-on spool 108 that will allow the media to be tightly wound onto the spool. Preferably, lateral movement of the wheel 103 and follower 106 is accomplished by motor 132 and controller 137, which can be programmed to move the wheel 103 and follower 106 into the proper position by taking into account factors such as the winding speed and the size of both the media and the upper spool 108.

The lateral position of the wind-off spool 110 can be adjusted by linear motor 134 and a controller 137. Adjustment will frequently be necessary when, for example, the wind-off and wind-on spools are of different sizes. In FIG. 3, the position of lower spool 110 has been adjusted along lower spool center support rod 128 by linear motor 123 so that the far-left portion of spool (the wind-off position in this example) 110 is also located in plane 340.

FIG. 4 shows a different view of the same point in the winding process. The wind-off location is at the far left of lower spool 110, while the wind-on position is at the far-right of the upper wind-on spool 108. Skilled persons will recognize that the arrangement (i.e., planes 340 or 342) need not be at either extreme of spools 110 or 108, and rather any appropriate portion of lower spool 110 (depending on the wind-off location) can be positioned so that it is in the same plane as the wheel 103 and follower 106 and as the wind-on location of the upper wind-on spool 108.

This type of lateral control requires a sensor capable of determining the location of the wire unwinding (the wind-off point) from the wind-off spool 110. In some embodiments, the sensor used to sense the media lateral position for the direct closed loop lateral control system is simply a rotational position-sensing encoder turned into an angle position system by placing a pair of low mass, parallel, adjustable separation bars on the sensor shaft. The media is routed through these parallel bars 190 (see FIG. 2), which have a center that is in substantially the same plane as the follower. The sensor angular position indicates if the media is too far to one lateral side or another with respect to the follower plane and therefore moves the wind-off spool to realign the spool wire wind-off with the follower plane. The lateral positioning sensor thus forms another closed control loop controlling the lateral position of the lower wind-off spool. Typically, the lateral position of the lateral positioning sensor and follower relative to the upper wind-on spool can be programmed based upon the spool and media sizes to produce a tightly wound coil.

The end of the travel media-follower guides allows a tight tolerance condition. Two primary mechanisms provide this ability. This first mechanism is a manually or automatically adjustable axis of the media guide towards the media in the wind-on spool to precisely control the media lay-up. The second mechanism is to manually or automatically have the media-guide side approaching the end of the follower travel move beyond the interference position posed by the follower travel and/or spool side next to the media itself and thereby allow the end of travel limits to extend to the true end of the wind-on spool and/or spool media lay-up. This end of limit follower guide prior to reversing the follower direction will be activated either passively via a mechanical mechanism or through the linear motion end of limit switch. Both mechanisms are used to provide a tighter and more even media-packing factor through the full media positioning control length of the wind-on spool.

In the winding system 100 of FIG. 1 through FIG. 7, the spools and center rods are supported by a number of modular supports 124 that provide a simple and cost-effective method of construction. Supports 124 are preferably formed from a rectangular extrusion of, for example, aluminum or an aluminum alloy. A hole bored with a high degree of accuracy on the centerline in each extrusion is fitted with a bushing that supports the center shafts 122 of the spools and ensures they are aligned with these centerline openings. Supports 124 are held in position relative to the frame 101 by support shafts 126 and 128. Preferably at least two support shafts 126 or 128 are used for each support 124 to provide both vertical support and rotational alignment. In this way, the positions of the components can be maintained within tolerances. Supports 124 also provide an extremely robust mounting structure through the uniquely large separation of the large diameter parallel support shafts 126 and 128 for a relatively affordable cost. Supports 124 are a central feature of the MORT technology, described above, that allows a reduction in both part count and tolerance stack up between the linear motion and the rotary motion. Tailstocks 152 provide additional support for wind-off spool 110 and in some embodiments are identical to supports 124. Those skilled in the art will recognize that MORT technology can function via a cantilevered system to hold a large spool without the use of a tailstock.

Figure 9:
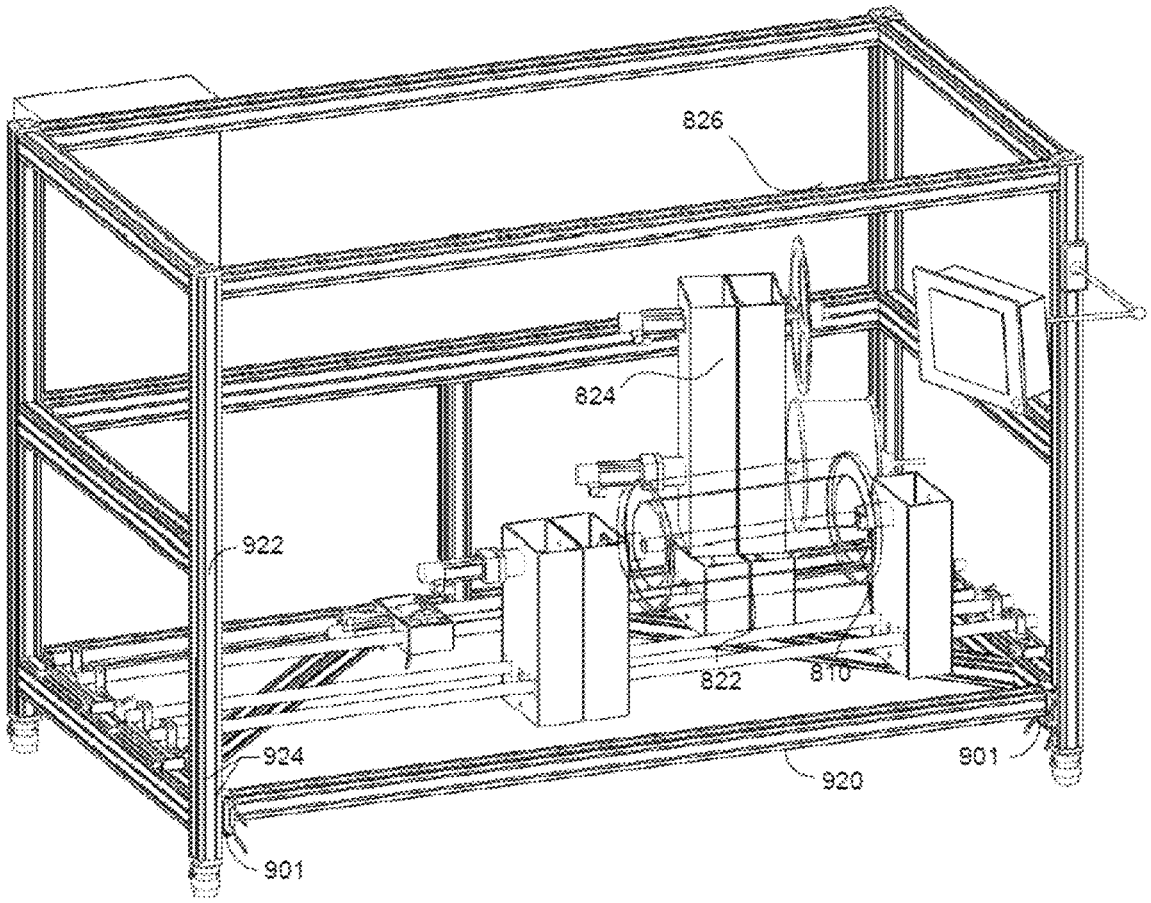
FIG. 9 is an illustration of the embodiment shown in FIG. 8 as part of the linear media handling system.

FIG. 9 shows another embodiment of the present invention which incorporates an angle on/off wind and allows a continuous or changing angle from the spool wind-off. Media 702 is unwound from wind-off spool 704 and wound onto a wind-on spool 706 at an angle 742. A follower 710 is a sensor system that measures axial tension. Follower 710 can rotate with rotational degree of freedom 722 and can also move linearly with linear degree of freedom 724. Wind-on spool 706 and wind-off spool 704 also have rotational degrees of freedom, shown as 726 and 728, respectively. Wind-off spool 704 is held in place by spool supports 732 and 734. Support 732 has linear degree of freedom 754, while support 734 has rotational degree of freedom 752. The combination of both linear and rotational degrees of freedom provides a means of varying the set or changing angle relationship while maintaining constant axial tension. Active control loops based on the axial tension value as the global control master and a hierarchy of master slave relationships from that top-level master provides the means of varying the set or changing angle relationship while accurately maintaining the desired performance value such as constant axial tension. This embodiment allows additional active degrees of freedom, which suits needs such as a tape media winding or helical winding, where the wind-on spool must assume a special angle for the winding yet the angle from the wind-on spool back to the wind-off spool must be constant or a set varying value. Those skilled in the art will readily recognize that the angle of the winding can be changed to fit the desired application and the capabilities of this embodiment can be controlled automatically as well. Not so easily recognized is that this rotational system, coupled with the tension feedback-controlled rotation of the wind-off spool and the wind-on spool comprise a capable system that permits the graceful transition from winding in one axial direction to the opposite direction while maintaining a tight tolerance on continuous tension.

Figure 8:
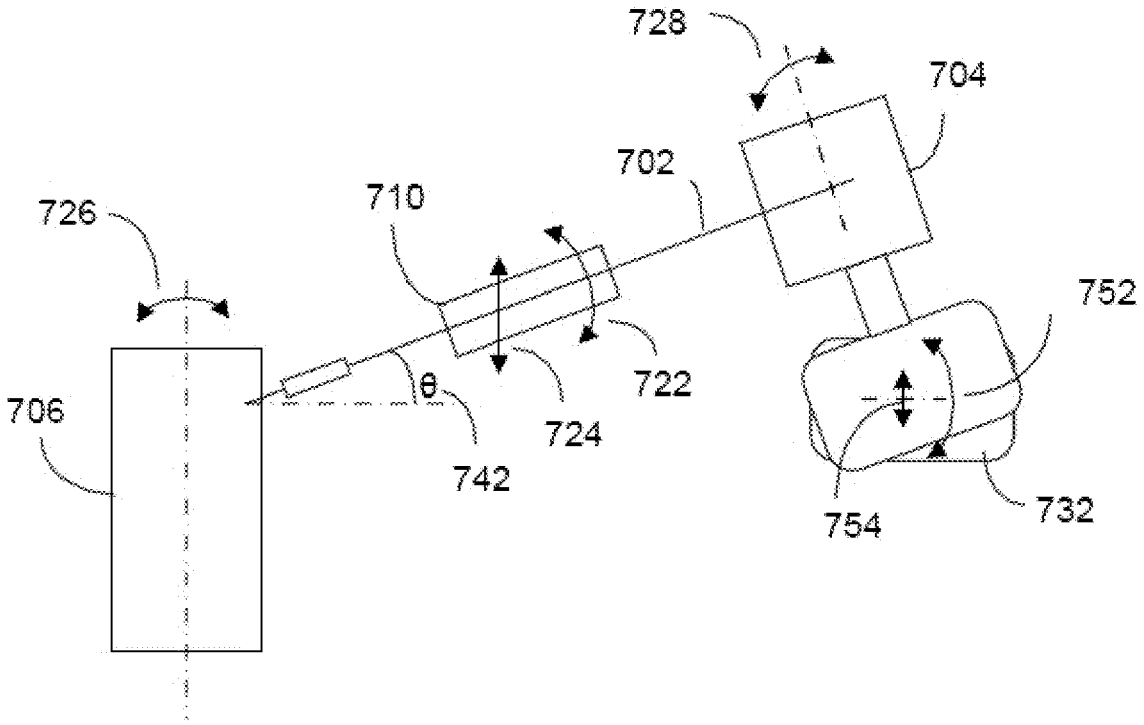
FIG. 8 shows one embodiment of the invention which allows a continuous or changing angle from the spool wind-off.

FIG. 8 is an illustration of the embodiment shown in FIG. 9 as part of the linear media handling system. For clarity purposes, spool 810 is shown transparent. Wind-off spool 812 is supported by supports 822 and 824. Bottom supports 822 and top supports 824 are physically connected, but bottom supports 822 are functionally split from top supports 824 such that bottom supports provide linear movement while the top supports provide rotational movement. A tension sensor wheel 826 is used to measure axial tension. Preferably, winding can be performed either at a constant or varying angle in a manner that prevents folding or puckering for certain tape media or other non-cylindrical media applications. Changing the pitch angle 742, the angle the media is to be wound on to the wind-on spool, without any other movement creates a kink in the linear media that can exceed allowable stresses in the media. Rotation of the wind-off spool and the wind-on spool as pitch angle changes is preferably controlled to avoid any kinks or puckers. In this embodiment, an active control loop uses tension information to control the rotational and linear movement in order to maintain a desired tension. The axial tension in the media during winding is measured and the output fed back to the system controller(s), which can adjust the speed of either or both of the spool rotations (both wind-off and wind-on spools) in order to keep the axial tension within a desired range. Persons skilled in the art will readily appreciate that the active control loop can be automated to maintain a desired tension.

FIG. 10 is an illustration of a carriage 901 that can be used to move and/or lock frame elements. Four handles 902 are rotated and pull up on machined T-slot bars 903. Referring also to FIG. 9, carriages can be permanently attached, for example, at the end of a support beam such as lower horizontal support beam 920. The T-slot bars 824 slide into slots 924 of another beam such as vertical support 922. Rotating the handles pulls on the support into which the T-slit bars are slotted and compresses the upper (toward the carriage) surface of that beam against polymer washers 904. The washers 904 allow for the carriage to slide easily when not locked and provide for even spacing when clamped to lock the carriage in place against the attached beam. By mounting equipment or parts of the disclosed assembly to these carriages, the carriages can be loosened to allow linear motion is along support beams and then clamped into place at any desired location. Other known methods for removable clamping of support beams could also be used.

No Reverse Bends Linear Media Routing Design

Some embodiments of the present invention use a routing design that follows strict design rules in transferring linear media from a storage/reacting, wind-off spool to the desired wind-on spool (or bobbin or former). It is highly desirable that the media routing path have no reverse bends whatsoever. As used herein, the term "reverse bend" is used to mean a subsequent bending of the media in a direction (for example by passing the media over a second pulley in a counter-clockwise direction) after first bending the media in the opposite direction (for example by passing the media over a pulley in a clockwise direction). Such a desired no reverse bends path according to embodiments of the present invention is shown in FIG. 1 through FIG. 7 and FIG. 11 through FIG. 14 where the media is always bent in the same direction (clockwise from the perspective shown in FIG. 5 and counter-clockwise from the perspective of FIGS. 13 and 13A. Applicant has discovered that reverse bends, even minor reverse bends such as those used in many prior art tensiometers, can be very damaging to delicate media, including for example reacted magnesium diboride (MgB2) or reacted niobium3-tin (Nb3Sn) superconductor wire.

Bend Radius Control

For handling reacted MgB2 or Nb3Sn type delicate superconductor wire according to some embodiments of the present invention, the minimum bend radius should be at least 11 inches (27.9 cm), which is equal to a bend diameter of at least 22 inches (55.9 cm), for media which was reacted in a flat (i.e., approximately uncurved) state. The radius of curvature is used to determine the maximum stress point to which the media in question can be exposed without suffering mechanical damage.

Figures 13, 13A:
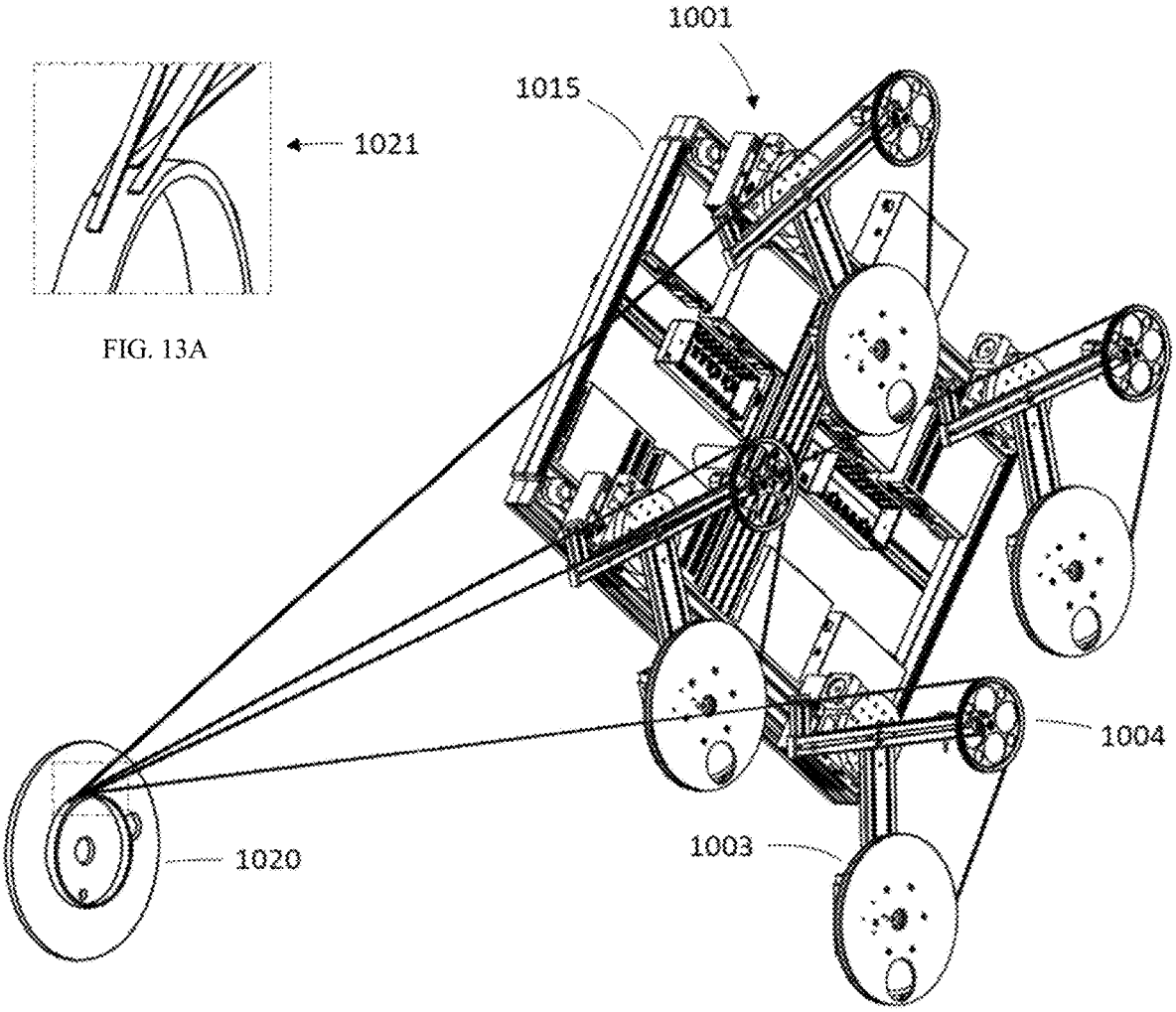
FIG. 13 shows an isometric view of a portion of an embodiment of the invention that can produce a full transposition wind of a subcable consisting of four media strands.
FIG. 13A is a partial detailed view of FIG. 13.

On a media cross-section, the radius of curvature is used to define the motion of the neutral axis with respect to the centroid of the material. Inside the material at a given radius of curvature, separation from the neutral axis provides compressive and tensile forces which determine the media stress and strain relations that contribute to material fatigue and failure points. Applied to wire routing, the radius of curvature can thus be used to determine the minimum bend radius allowable under various conditions. If magnesium diboride wire, for example, is reacted flat, then the reaction geometry including radius becomes the stress-free point. The radius of curvature bend limit is then either a complete bend in one direction with no reverse bends, half of this bend radius value in either direction from the linear reaction point, or some other arrangement totaling the bend limit about the stress-free radius. Similar philosophy dictates any starting stress-free reaction process point and the associated bend radius limits. As an example, a typical winding according the embodiments of the present invention will use wire that has been reacted flat then bent in one direction with no reverse bends. This example reflects a typical use, but other radius of curvature options could also be employed. For example, a wire can be reacted while coiled, and the acceptable curvature would then be determined based upon the coiled position as a stress-free point. The figures show various embodiments of winding machines and not all configured to safely handle the bend radius requirements of most fragile media. Inspection of FIG. 5 shows large radii from wind-off spool 100 to tension measurement spool 103 and onto wind-on spool 108. Inspection of FIGS. 13 and 13A, representative of cable winding embodiments, shows routing from wind-off spool 1003 to tension measurement spool 1004 and onto wind-on spool 1020. In particular, tension measurement spool 1004 is less than the 22 inches bend diameter. Embodiments of cable winding machines can accommodate bend radius control for the most fragile SC, but it creates engineering challenges as these large diameter components crowd one another in crossing planes of motion.

Dynamic Surfaces

The intent is to provide added protection for the linear media by allowing fewer or no static frictional surfaces, thus lowering the axial strain while protecting the surface of the media by ensuring that the coefficient of friction in the direction of media motion is a dynamic coefficient of friction rather than a static coefficient of friction, which would be the case if the media were sliding over a stationary surface. See guide wheel 106 in FIGS. 5 and 1005 in FIG. 11 as an optional means of follower guiding.

Direct Closed Loop Axial Control

The axial tension in the media during winding is measured and the output fed back to the system controller(s), which can adjust the speed of the spool rotations (both wind-off and wind-on spools) in order to keep the axial tension within a desired range. As discussed earlier, the wire tension sensing system 50 of the present invention makes use of a tension sensor wheel 103 and a tensiometer 104 (see also FIG. 1 through FIG. 3). The axial tension must be low enough that the media is not damaged. The upper limit for axial tension will depend upon the media. For most fragile superconductor wire and tape applications, the steady state tension will be less than 5 pounds, more preferably less than three pounds. The greater the margin between allowable tension and sensor resolution (discussed below), the higher the throughput speeds that can be safely achieved. For most applications, the tension will need to be controlled to plus/minus a much smaller value (variance), preferably to within +/−0.1 pounds and even less for small winds. The axial tension will need to be high enough that the media unwinds from the wind-off spool and onto the wind-on spool in the lay down manner and orientation desired. Axial tension of at least 1 pound is appropriate for most cases winding delicate media. In extremely delicate cases the axial tension is readily controlled to around 0.5 pounds for even a medium sized wind and 0.1 pounds for a small wind. The greater the margin between sensor resolution (discussed below) and tension, the higher the throughput speeds that can be achieved.

Direct Closed Loop Lateral Control

Figure 11:
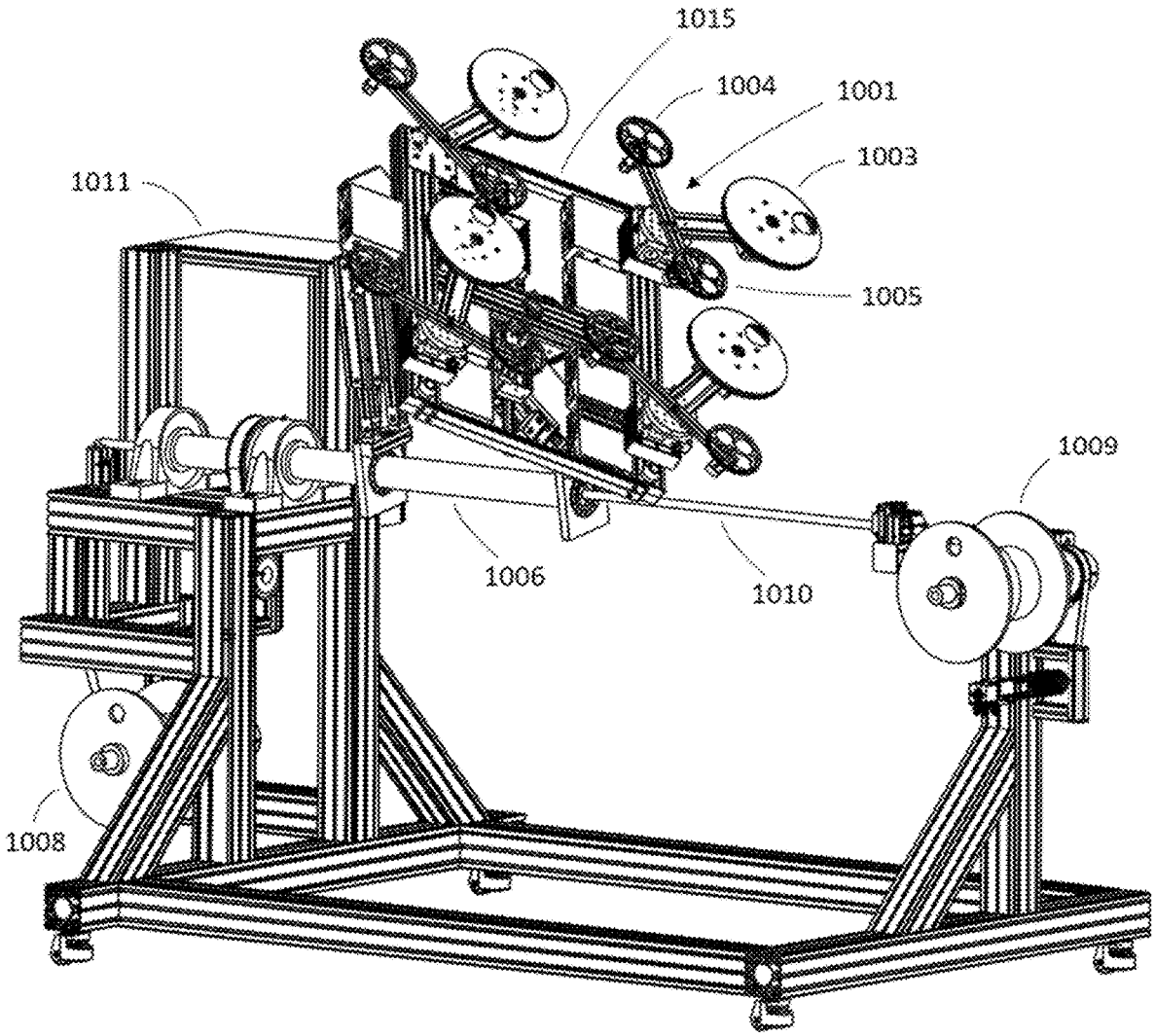
FIG. 11 shows an isometric view of a portion of an embodiment of the invention that can produce a full transposition wind of four media strands.

In some embodiments, this is aided by a follower guide, such as the wheel embodiment located between the tension sensor wheel and the wind-on spool (See 106 in FIGS. 5 and 1005 in FIG. 11). The follower guide wheel option and follower are preferably moveable so that they can maintain a position that is substantially in line with the desired position on the wind-on spool that will allow the media to be tightly wound onto the spool. If necessary, the lateral position of the wind-off spool can be changed to keep the portion of the media which is currently unwinding from the wind-off spool 110 in the same plane as the portion of the media which is winding onto the wind-on spool (or bobbin) 108. A material location sensor can be used to determine when the position of the wind-off spool 110 needs to be adjusted by linear motor 134 to maintain the proper lateral orientation to prevent damage to the media. As used herein, maintaining the wind-off and wind-on points of the two spools, as well as the tension sensor wheel, in substantially the same plane means maintaining the positions of those points close enough to the same plane that the lateral tension on the delicate linear media does not exceed 10% of the maximum axial tension limit for the particular winding task.

Media Orchestrating Routing Technology (MORT)

In certain magnet or spool winding embodiments, MORT is the foundation for both wind-off and wind-on spool attachment to the linear motion structure and provides a highly precise, low tolerance stack during alignment and motion of the linear media even with multiple degrees of freedom through the use of a single piece of primary structure material (i.e., supports 124 described below). MORT allows for media insertion and removal via front, side, or top loading and unloading options whether sliding the load across the holding shaft or incorporating a shaft removal section at the load location. Although a tailstock is readily possible with MORT, MORT can also be used to hold a large spool without the use of a tailstock via a cantilevered system. According to some embodiments of the present invention, the MORT system, including supports, can be configured to allow an adequate degree of freedom, both linear and rotational, to provide and control media routing.

Degrees of Freedom (DoF) Controls

For any motorized single or combination of DoF, independent or electronically geared control of linear media motion is possible through automated, partially automated, and fully manual means. This multiple degree of freedom (DoF) system will have an operator interface equivalent to providing computer aided drafting (CAD) input to computer aided manufacturing (CAM) toolpaths for computer numeric control (CNC) production. Options include a hardware joystick, a software joystick, or partially automated motion controls that allow turning on/off a single to multiple DoF for a particular move. Such ability allows the user to tune the motion for a particular need. Preferably, automated, partially automated, and/or fully manual control of any motorized single or combination of multiple DoFs is accomplished to achieve motion while accurately maintaining desired performance values such as constant axial tension. In examples described below, for example, a motorized DoF provides a continuous or changing winding pitch angle. Active control loops based on the axial tension value as the global control master and a hierarchy of master slave relationships provide the means of varying the pitch angle while accurately maintaining desired performance values such as constant axial tension. The routing design and controlled DoF of the LMHS of one embodiment provide not only a no bend situation with minimized forces but for a tape also a line over point initial contact at the wind-on location in order to further minimize stresses and bends in the linear media. This is achieved through controlled design routing and DoF control. Single winding plane with limited bends of material as well as limited stress in any direction allows a limited strain final product. The more bends and stress introduced during the magnet and cable manufacturing process, then the lower operational values allowed.

Angle On/Off Wind

One means of an optional, specialized winding allowance is accomplished by an additional active DoF providing a continuous or changing pitch angle from the wind-off spool, across the sensor systems such as axial tension, and into the wind-on spool (FIG. 8 provides a schematic and FIG. 9 provides an illustrated view of this additional DoF). Prime examples of need for wire and tape media winding include helical winding, partial to full transposition winding, and braiding where the wind-on spool must assume a special angle for the winding yet the angle from the wind-on spool back to the wind-off spool must be constant or a set varying value. A practical solution is achieved through the addition of rotational DoF on the spool and all wire routing mechanisms working in conjunction with current linear and rotary motion mechanisms. Such capabilities expand into automatically to semi automatically controlling the complete wind on/off angles for any system for any desired need.

End of Layer Sense

One embodiment of LMHS for magnet or coil winding provides a sense mechanism to determine end of layer conditions. Refer to FIG. 4, as the wind-on spool is commanded to left and right to accomplish a desired wind configuration, sense mechanism would signal approach of wind plane 342 to one or both flanges 110. This helps provide additional active precision control feedback to assist with conventionally human interaction and increases winding throughput without errors. Sensing can be accomplished with any number of mechanisms including inductive proximity sensors, mechanical contact, optical sensors, vision sensors, and laser sensors.

Dropout Identification

One contemplated LMHS embodiment benefits from the open frame architecture and employs a system for diagnosing dropouts for each individual SC material strand during the winding process but before wind on. A further embodiment challenges the open architecture for inline space to then allow replacing the dropout location with a splice. Dropout identification can be accomplished inline in the machine winding operations or as a separate process with media that would be respooled. A final cable or magnet can then operate at higher overall power or energy including commercially acceptable operational values, such as voltage and current, and factor of safety because a higher dropout limit has been established for entire lengths of SC material.

Material Handling

Some of the LMHS contemplated herein removes high and non-uniform axial tension, makes all non-axial tension negligibly small, removes all reverse bends, keeps all bends to a single and large radius, and makes all side bends negligibly small, etc., during the winding process. Side bends are especially problematic for wires that are not round such as rectangular cross sections of wire, particularly very thin by very wide to then become a tape.

Further when making a cable, the final cable wind-on is a smaller than desirable bend. To alleviate additional stress and strain this small radius bend operation happens only once at the end of the wind process when the strand contacts the former and is never unwound from that position. Once delicate SC strands are wound into the final cable or magnet subcomponent arrangement, they are typically then protected from any further damaging mechanical manipulation via insulation or jacket layers.

The wind onto the former occurs only where the linear media, such as the SC and in particular HTS embodiment as described here, connects directly to the former and in a line instead of point contact for the SC. The SC does not touch anything besides guides, including one another, prior to the final cable, subcable, magnet, and cable magnet wind-on former and then only touch within parts of a millimeter tolerance at the wind-on location. This is critical for achieving a proper wind without unduly stressing the linear media as well as positioning for the exact wind geometry desired. For partial to full transposition and braiding this is all due to the transposition wheel rotating where the center axis of the transposition wheel is in-line with the former axis. If the transposition wheel axis was offset then the SC would wind together to establish a subcable prior to touching the former which induces both extra stress into the SC as well as makes full transposition or braiding impossible with a tape if maintaining a flat HTS set of tapes and not using stress inducing guides. The wind stations are purposely offset on the transposition wheel to support linear media crossovers as the back wind station lifts over the front ones with respect to the former. This lift action aligned with the former position will push the lifted SC down the former but the already wound SC onto the former and guide wheel maintains the lifted SC in the correct position.

A final cable, magnet, or cable magnet can then operate at higher overall power or energy including commercially acceptable operational values, such as voltage and current, and factor of safety because no additional performance issues were introduced through an individual SC strand to SC system media handling induced stress and strain.

Proof of Performance. Because tension, etc. are recorded for each mm if desired, the cable and magnet manufacturing values for each SC wire (note: "Strand" or "wire" or "tape" are sometimes used interchangeably herein) can be provided for any location in the final product.

The SC strand test setup of some embodiments confirms on a small scale how sensitive each individual SC strand is to material handling. The problem in each strand is magnified in the final cable and magnet SC product because multiple SC strands must all interact with one another and still work properly as an entire system.

Turn-by-Turn Tension Control

A winding is composed of (1 to x) number of turns per layer and then (1 to y) number of layers. This functionality allows a final magnet to be produced in a pre-tensioned or pre-compressed state. On a layer-to-layer scale this allows a variance of the neutral axis from the original wind when comparing the radially inward hoop stress and associated force to the hysteresis stress of the wire that generates a radially outward force. In addition, the operational neutral axis can be further located by having the original magnet build wind account for the operational mechanical, electromagnetic, thermal, and motional dynamic forces. Given a winding angle and tension value allows determination of the amount of side-to-side compression between turns in a layer that can be varied to produce a desired overall final magnet winding stress.

In one example of use, this feature allows the often-desired case of a multi-layer or delicate central bobbin wind. The magnet or cable magnet can be wound in tension which then provides a radially outward winding stress, thus reducing the entire wind radial inward stress from final mechanical wound hoop and radial stress values as well as operational stress.

This case of winding each turn in tension or compression requires an understanding of the wound material, geometry, and position both radially and axially. The operational code utilized by some LMHS auto calculates the variable turn to turn tension value to provide the desired final overall magnet winding stress. One of ordinary skill in the art will appreciate that the LMHS controls stress values in all Degrees of Freedom (DoF). The ability of the LMHS products to accurately control the final device inherent mechanical stress at each point in the magnet allows the ability to provide far superior magnet performance and structural reliability.

Non-Contact Sensor

At least one sensor provides a feedback mechanism to support winding control and optimization through linear and non-linear control techniques. Vision sensors provide precise multi-dimensional wind-on location, general wire location, and overall wind patterns and, thus, are very desirable.

Some LMHSs contemplated herein move beyond the limits of common motion sensory inputs for control value weights and gains logic by adding a new and specialized machine sensory input. In one example of use, a vision sensor assists in both control and performing optimization studies through vision resolution and identification technologies used for common sensory systems.

Reverse Direction Wind

In one embodiment of the invention, the linear material is constantly wound onto a bobbin and the bobbin wind-on rotation reverses when the bobbin shape affects a curve in the wound linear material or in some way is set to reverse how it is wound onto the bobbin. LMHS feedback loops and multi-DoF motion control are employed to satisfy this winding configuration. A common use for this winding result is to establish an opposite magnetic field such as a null magnetic flux zone in the middle of two opposite winds of the same linear media in an equal and opposite configuration.

Splice Mitigation

As mentioned above, HTS tapes have a particularly large problem with lowered piece length before present production art yields what is known as a "dropout" where the SC properties fall below acceptable limits. This leads to a large number of repair splices where each splice is difficult to manufacture, creates localized areas of lower mechanical strength, and forms micro-ohm resistance areas which are no longer superconducting. The mechanical strength and exceptionally low resistance value of a potted coil may seem inconsequential until considering that SC coils often operate in an extreme mechanical stress and fatigue environment from the combined high magnetic field forces and extreme thermal cycles. The detrimental effects of splicing are often very apparent when the tape/wire is running in and out of persistent mode, but particularly a concern for any SC quench propagation across splice locations when a fully energized SC coil goes from SC to regular mode. Further still, splices are commonly the quench onset location. All of this leads to an SC cable, magnet, or cable magnet with more splices that has a higher likelihood of SC quench that takes the cable or magnet out of SC mode which can be catastrophic during high energy and power operations. An example of splice mitigation is provided as an embodiment in the Magnet Station discussion.

For a motor/generator wind (see FIG. 22) embodiment example, LMHS is capable of multi phases with phase chording via the same mechanism of splice limiting. LMHS is also capable of winding multiple coils in parallel per phase per slot, or equivalent location with mounting system, to provide parallel sets of coils across a machine with no splice per the example of wound poles shown connected by line 1191 which is used to place as an armature set without a splice and with possible chording included in the set as shown in 1185.

For the purposes of producing multiple coils such as pancake magnets in parallel whether using wire or more importantly a wide and/or thick tape media, LMHS can wind multiple pancakes as separate parallel winds and then electrically connect the winds at the inner and/or outer wound radius such as by using low resistance solder joints. The wind angle ability of LMHS can also be used to wind multiple coils such as pancake magnets as a single connected wind without a solder joint for wire or even the very difficult tape media situation. In all cases these multiple coils can be wound in the same or opposite winding directions and can be wound in parallel or in series with one another. In all cases multiple mediums can be wound into each coil at once in a parallel wind situation such as insulation wound in between each superconducting layer or multiple SCs and insulations wound in parallel directly into the magnet turns.

Cable Diagnostics

Final system cable diagnostics are useful such as faults, smart grid, and distributed grid diagnostics. In this case the cable, magnet, and/or cable magnet is designed to reflect electrical bounces to provide a location of splices and certainly of a sudden resistance fault and resistance spread. An SC cable is particularly useful for detecting a sudden R fault due to the 0 to high resistance nature of an SC in and out of the SC mode. Using an SC line to detect the resistance allows connecting both the power and diagnostic systems from cryogen station locations and incorporate associated logic for prognostic needs including fault tolerance response, Health Map, predictive operational use, and preventative maintenance. In cables, a similar technique is distributed temperature sensing.

SC cables require cryogen stations around three km lengths apart in urban areas and 15 km to 300 km apart in open areas with distances depending on multiple factors such as cryogen flow stemming from LN2 flow diameters, cable angles to gravity, etc. The need for cryogen stations also provides a smart grid power and cryogen status detect and protect capability at each cryogen station as well as the use of cryogen for distributed energy storage such as power utility needs due to high cryo liquid to gas expansion ratios.

Although the SC power cable can be used directly for such diagnostics, power noise can be an issue with reading transmitted data. Therefore, in an embodiment of using the SC power cable, the power and diagnostic data are separated by frequency bandwidths. When using a separate SC line for purely diagnostics, then this line can be used for other data applications such as smart grid data transmission needs.

Diagnostic Station

MMP allows a diagnosing station to be placed where the SC material leaves the spool and just prior to inclusion into the magnet, cable, or cable magnet wind. Thus, all SC material can be tested, or just preselected sections can be tested. Therefore, localized continuous or discrete, manual or automatic test stations such as cryo cooled testers can be used to determine SC values which help identify poor performance locations. In one embodiment, the SC values of critical magnetism and current densities at a set temperature below a critical temperature provide a measurement for the SC state. In a non-contact diagnostics embodiment, the SC state is measured and processing methods, such as Gauss and Weibull statistical methods are used to determine the heterogeneous critical current distributions which leads to the quality, current carrying characteristics, and AC losses of HTS tapes. A minimum dropout threshold is set and compared to the measured value. This difference provides a possible SC operational range with a factor of safety.

When the material shows poor performance such as a dropout below desired performance levels, it will be desirable to incorporate a station to manually or automatically cut that section out and create a splice. Furthermore, all splice locations are identified as key locations to maintain additional robustness for cryogen cooling. The final magnet or cable achieves a higher overall operational performance by removing all material poor performance sections. This allows a higher performance SC for long lengths.

All actual SC data for the entire length of the SC is then recorded down to mm length increments and provided to the customer along with the final manufactured magnet or cable.

Media Tensioner

The former or wind-on side of a compression tensioner with guide allows accurate stabilized wind-on tension control providing a tensioned means of swapping out bobbins. The spool or raw material side of the compression tensioner with guide allows incorporation of individual SC process stations before winding onto a final former and a tensioned means of swapping out spools.

For advanced SCs the principals of LMHS for automated handing of fragile media are maintained at all times such as no large longitudinal axial or side loads yet holding the SC in place with tension for the wind-on process. Because all SCs including HTS can handle a large compressive stress normal to the flat surface of the tape or equivalent wire, an SC flat surface or equivalent placed passive or actively controlled press mechanism is incorporated. Embodiments include a press mechanism that allows the SC to slip through or a set of rollers where there is a turning control mechanism on one or both rollers. During an operation where the spool tension would be completely lost such as a splicing operation, this compression tensioner compresses further to hold the SC in place by incorporating on both sides of the splice. This feature can be incorporated into the splicing process as a single station, and can be used to help guide and tension the final SC onto the former. Further, this feature can be located at each raw SC tape spool wind-out location for any desired use.

Automated Splicing

For advanced SCs the principals of LMHS handing of fragile media are maintained for manual or automated splicing. The splicing mechanism is only engaged when the SC diagnostic system indicates an unacceptable value, or at the end of wire or tape length. As all SCs including HTS can receive a large compressive stress in a direction normal to the flat tape surface without SC degradation, a press is used to apply a force to the SC, wherein large longitudinal axial or side loads are not applied. With the SC held in place for the splicing operation, guides, such as a roller option, move the uncut wire or tape into position for the splice operation. The spice mechanism incorporates a holding press used as necessary on both the former or wind-on and spool or raw material side of the splice.

For continued operation whether the splice is manual or automated, the splicing mechanism may have a second raw SC material spool and tension system positioned next to the active spool, and may be configured such that both feed SC into a diagnostic and splice operational area in order to efficiently alternate SC tapes and wires. A splicing mechanism could be located at each raw SC spool-out location. In an alternative embodiment the splicing mechanism is a separate process station which then moves, perhaps automatically, to the desired splice location and performs the splice action. It is envisioned the splice station will work in conjunction with the compression tensioner and guide, or an equivalent device for holding the SC, when used in an automated machine.

In a further embodiment automated splicing allows the LMHS machine to be used for continuous length use. A primary example of this would be using LMHS for cable production beginning with individual SC and inclusive of all final elements required at the cable installation. Here, one or multiple LMHSs could be developing SC cables while processing the SC cable systems which include producing any possible twisted or woven subcables. Inline insertion or cladding into a cable cryogen container or cryostat which is then fed into the installation could also be performed. A primary desire of fabricating SC cables at the installation site is to remove splices required by connecting complete SC cables together. Thus, an infinitely long SC cable of equal size, with lengthwise continuous operational value, and inclusive of all components down to the individual SC level can be created, wherein each element that makes up the final SC cable system is spliced together before entering the SC cable system manufacturing process.

Automated Spool Exchange

The embodiment of LMHS automatically swapping out emptied raw SC spools and replace with new full spools without manual intervention is also combined with Automated Splicing mentioned previously thereby allowing a true automated machine that produces cables of any length. Automated spool swapping does not require a splicing station, but follows similar procedures.

Cryostat Cladding

Figure 18:
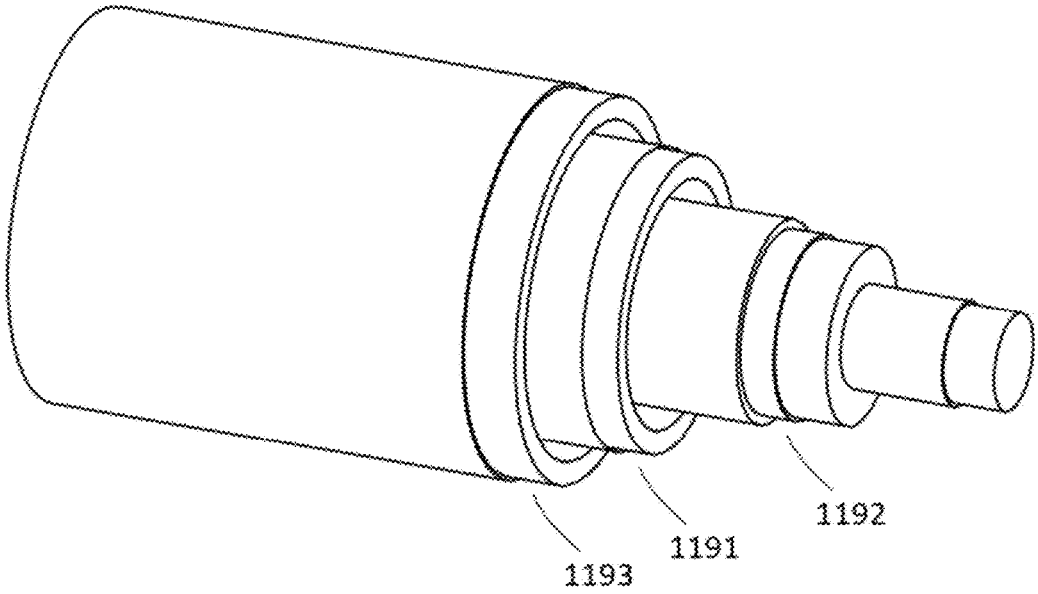
FIG. 18 shows isometric view of a cable exposed to view internal components.

In a further embodiment, a partial to fully automated inline cryostat station allows the entire LMHS to be deployed into the field for continuous length use similar as the splicing concept described above. A primary example is using LMHS for cable production at the cable installation site. In this example one or more LMHS developed SC cables can be wound to include any desired cable twisting or weaving by using a further embodiment of LMHS placed downline in the SC cable winding system, and then inserting or cladding into a cable cryogen container or cryostat inline, which is then fed into the installation. FIG. 18 represents the output where the cryostat cladding and insulation of 1191 and 1193 are placed around the superconductor core 1192.

Figure 18A:
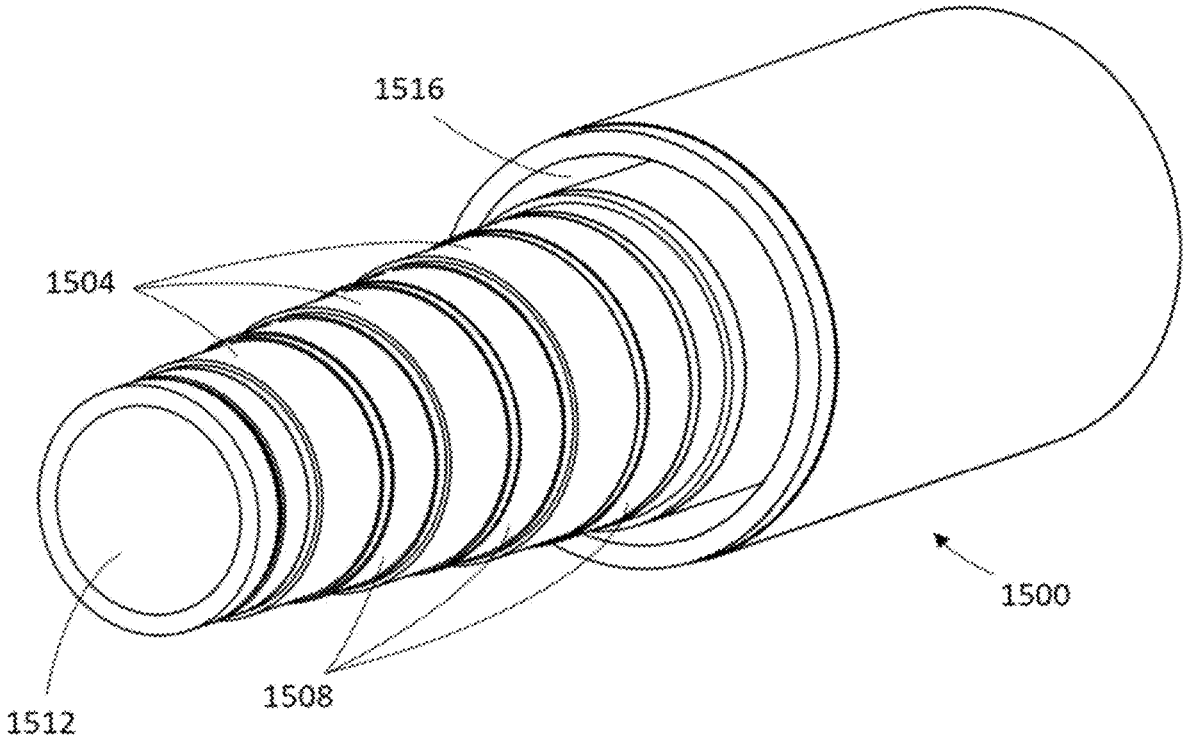
FIG. 18A shows one embodiment of the HTS cable.

FIG. 18A shows further embodiments of the invention that functions as an HTS cable as also shown in FIG. 18. The device shown here is a Field Operable Superconducting Device and can function as a primary element of a Field Operable Superconducting System. FIG. 18A shows one embodiment of a 3-phase, hollow core superconducting cable 1500. Cable 1500 has 3 HTS layers 1504 separated by stabilizer and/or insulating layers 1508. In some embodiments, cryogen flows in areas 1512 and 1516. In some embodiments, power elements are inserted into area 1516 such as the Integrated Wound Component of a spiral wrapped ultracapacitor as a nanowhisker form of energy storage system embodiment.

Magnet Station

In this embodiment of the invention immediately post cable fabrication winds the completed cable into a final simple to complex magnet and cable magnet for the purposes of instituting minimum bends and hence stress and strain as well as increased production time and space efficiency. As the cable former covered with freshly wound media exits the LMHS in the cable magnet embodiment, the contemplated additional embodiment commands the dynamic magnet former to move back and forth to accomplish winding the desired magnet and cable magnet configuration thus protecting the SC strand, subcable, and cable from unneeded re-spooling, transit, and storage. Magnet type groupings include solenoid (often mounted on a common central turning platform), planar (such as a racetrack coil or a curved plane cos-theta magnet and often mounted on cylindrical tooling), and spherical (such as a baseball or yin-yang magnets) categorized per the primary mounting and rotation needs. In some embodiments, multiple magnets and cable magnets can be wound from a single wind-on with no splice. Consider this by adding FIG. 1 to accept output of FIGS. 16/16A or FIGS. 17/17A.

Figures 12, 12A:
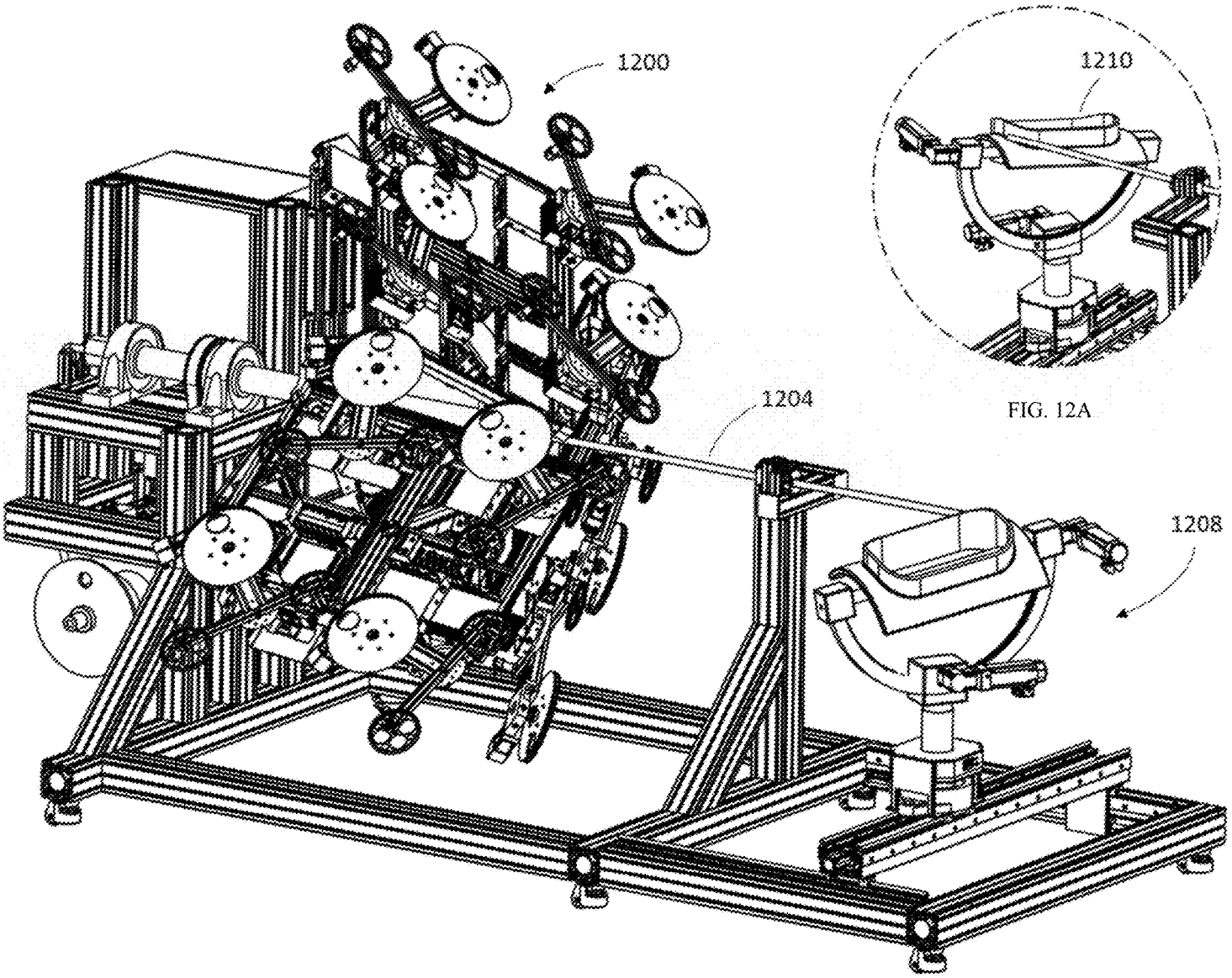
FIG. 12 shows an isometric view of a portion of an embodiment of the invention that can produce a cable magnet wind of 12 media strands.
FIG. 12A is a partial detailed view of FIG. 13 including an embodiment of the rack and pinion embodiment of the Winding Arc Rotation.

When winding up to 6 spatial DoF, and more DoF in former stacked DoF embodiments, for more complex configurations then the winding machine of FIG. 12/12A provide extreme control of magnet and cable magnet winding geometries. In this embodiment, the cable magnet winder is added to the output of FIG. 11 where FIG. 11 is configured with three transposition wheels, four HTS wind stations each, to comprise the 1200 transposition station which revolves around the 1204 cable. In this embodiment the 1204 cable then moves on to the 1208 magnet wind station which winds a 1210 cos-theta type cable magnet former mounted on cylindrical magnet wind tooling providing the output of FIG. 23.

A different embodiment places cable and/or subcable wind stations to face one another and hence point into winding the same magnet in order to wind magnets and cable magnets as the former is pulled back and forth between the wind stations while winding a simple helix to transposition options.

Dynamic Feed Winding

This aspect defines the ability to wind delicate linear media such as SC wire or tape onto a long element such as a long cable or torus. Braiding machines and equivalent have been in service for decades but none incorporate the level of sensing and control as the LMHS to accommodate the needs of reliably winding SC wire and tape. Resulting from the independently controlled feed rates of linear media wind output, the LMHS of one embodiment can be used for creating complex arrangements such as full transposition and braiding of linear media during cable manufacturing.

Non-SC embodiments include winding with very fine conventional wire for extremely fine magnet winding, filamentary linear materials, fiber optic wire, thin strands of carbon-based fiber, smart fabrics, and extremely dense fine fiber matrices. Application embodiments include precise magnets such as high precision seismometers, weaves for fine medical devices such as heart hole plugs, and matrices for impact or extreme environment protection.

Wind Form Filler

The transposition of the HTS creates regular periodic positive and negative perturbations in the pitch in the delivery of the tape to the former. Unlike round wire, when transposing tape these perturbations may result in raised surfaces above the former due to twisting which is further exacerbated for braiding. These raised surfaces are therefore unsupported against magnetic forces during operation, resulting in possible performance degradation. Specifically, in the transposition and braiding diamond position in a four-tape winding, two of the four tapes are single thickness with respect to the core position, while the other two are stacked in double thickness. When external support is applied to the magnet, the single thickness tapes may remain unsupported, again resulting in performance degradation. This inherent winding geometry limitation can adversely affect unsupported cables and magnets, such as unpotted magnets, with voids removed prior to applying epoxy.

To mitigate issues from gaps between wound media that are inherently present in most winds and a necessary byproduct of transposition winds, individual HTS strand mechanical support in the wind pack techniques including the addition of winding electrical and/or thermal conductive or non-conductive fillers which harden, localized epoxy techniques, and winding in materials that act as braces. This filler material is incorporated below the media at the gap location or consistently below the media winding. The filler material could be in the form of a bridge such as an insulating tape or some form of conforming material that fills the gap. Alternatively, the bridge could be a varying width tape insulation that matches the transposition, braid, etc. cross over location. Still further, the filler material could be a conforming material formed naturally during the regular winding process or by way of a special process such as: 1) heating the filler; 2) fill in the gap; and 3) forming a gap filling solid after the treatment is completed.

A frequent result in many wound configurations is the presence of gaps between wound strands from turn to turn in a magnet per layer or gaps in the cable wind/braiding process down the axial length. Sometimes these gaps vary in width and height along the progression of the wind. In both magnets and cables, it can be desirable to have voids for uses from coolant flow to epoxy fill. However, gaps inside a wound product could form an unacceptable SC bend or unsupported wire or tape strand location which can cause stress issues, especially from magnetic forces during operation. Filling these gaps in a cable, magnet, or cable magnet can allow cable bending with lowered stress on the materials inside. An example is any a pair or more tapes wound in a transposition. The tape-to-tape cross over location can create a sharp axial or across tape width bend in an SC and hence lower SC performance. Gap filling can also be used for a tape that is stiff across its width and wound across a curved former. Thus, some LMHS embodiments either manually or in automated fashion fill the gap between one SC and another SC, insulation, former, etc.

Managed Winding Gaps

Conversely to achieve other goals, the use of tension feedback and independently controlled strand and core feed rates during the winding process are used in combination to establish specific patterns of gaps between wound strands and insulation, former, etc. These gaps can provide advantageous lowered stress in the cable or cable elements such as the wound media from bending or other induced movement in the wind. Additionally, gaps may be fashioned to provide for coolant or structural stability from added gap filling material.

Advanced Control and Optimization

Non-linear control and optimization such as fuzzy logic, neural logic, genetic algorithms, and simulated annealing provide highly advanced control solutions that allow winding delicate wire and tape beyond current abilities. In one example of use, Field Programmable Gate Array (FPGA) is used for fast control response and pattern recognition software processing needs. Custom active closed loop sense and heterogeneous (FPGA and CPU) control architectures working in conjunction with appropriate mechanical design techniques may be necessary to attain the delicate linear media handling requirements. LMHS advances present art by combining control processing techniques such as FPGA processing power, LMHS linear control and optimization techniques such as magnitude and derivative operator, and non-linear control and optimization techniques such as genetic algorithms used for both winding machine operation and output product development through the winding operation.

Variable Media

Further, the eventual cable fabrication machine path intends to handle all classic to advanced SC materials and geometries as well as non-SC materials. The LMHS winding invention intends to comprise a single machine that handles fragile linear media from round to rectangular wire as well as tape and on a larger scale cable. This may be native to the machine or via tooling changes. Still further embodiments of the machine are intended to handle winding subcables of varying sizes.

Wide REBCO such as YBCO is a great candidate for the invention of LMHS as it is a fragile SC that exposes the difficult winding problems of tape turning, tape puckering, tape pitch, kink angles, etc. from attempted geometric winding cases of transpositions and braiding. Various purposes such as lowered transient electromagnetic (EM) losses in cables continue to request winds with fully transposed flat braids or further modification to full lattice braids with fully transposed elements.

Transposition

Full transposition for a wound strand means precise position of the conductors which leads to no inductive mismatch or net self-field flux enclosed between the strands and hence low residual magnetization producing transient, such as AC or pulsed power, losses. Full transposition for a subcable or cable goes further to also provide homogenous current distribution across a subcable or cable.

In this full transposition wind case, the HTS layers of each subcable alternate in sequence. For example, contacting the core a four HTS tape subcable order (1,2,3,4) will alternate as (2,3,4,1) then (3,4,1,2), then (4,1,2,3) and then start over at (1,2,3,4). Transposition is achieved through other embodiment mechanisms including Spool Rotation Around Cable and Rotary Lift Stage with Tensioner.

A system of guides, guides can be low friction surfaces or rollers or guides located on one or multiple sides of the media in space, can be used to keep the wires and/or tapes across their widths all in the same flat or curved plane with respect to one another to assist with needs such as placing flat on a former surface of any geometry such as rounded or flat. This system can be used for multiple individual wires and/or tapes being transposed to make a cable and/or multiple individual subcables being transposed. A common example of use is when making SC cables, magnets, or cable magnets to partially to fully transpose multiple HTS tapes of a common or varying width to place onto a central cable core former.

Figure 11A:
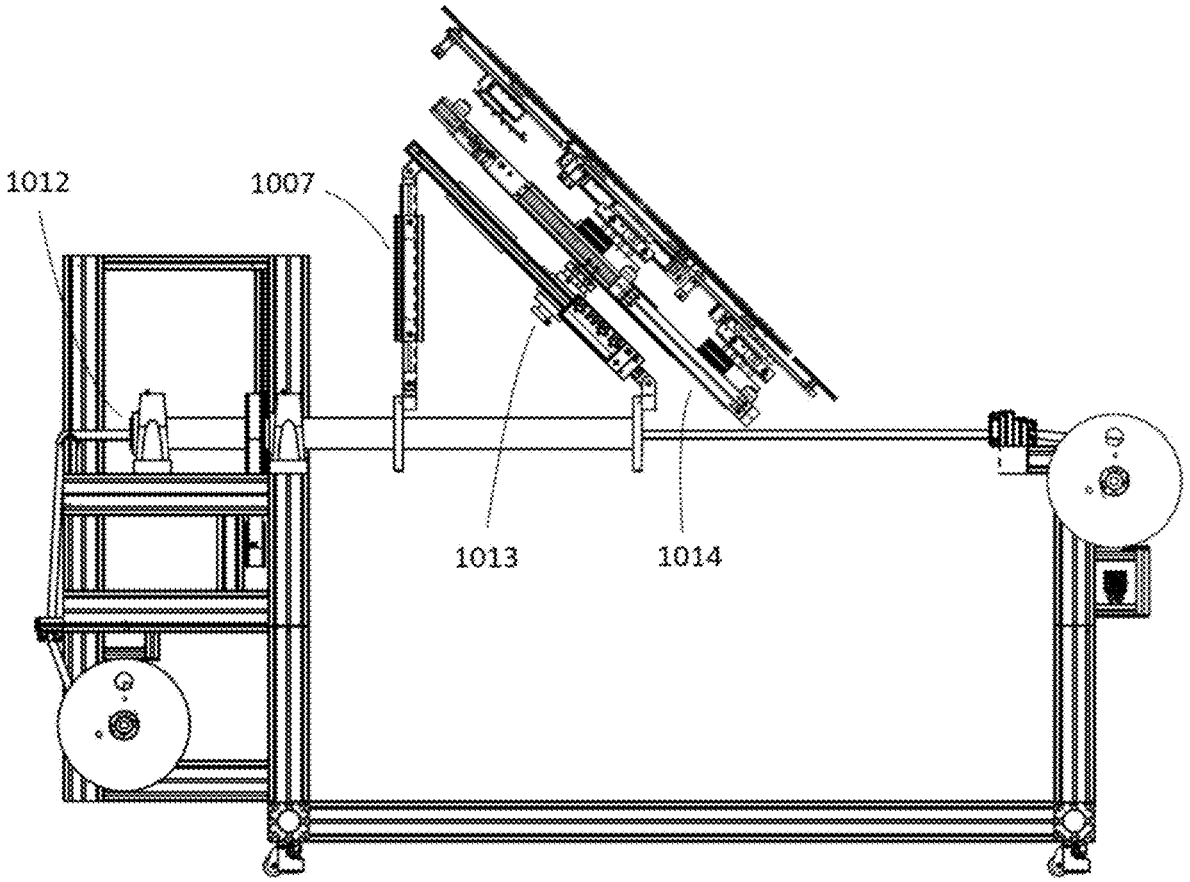
FIG. 11A shows side view thereof.
Figure 19:
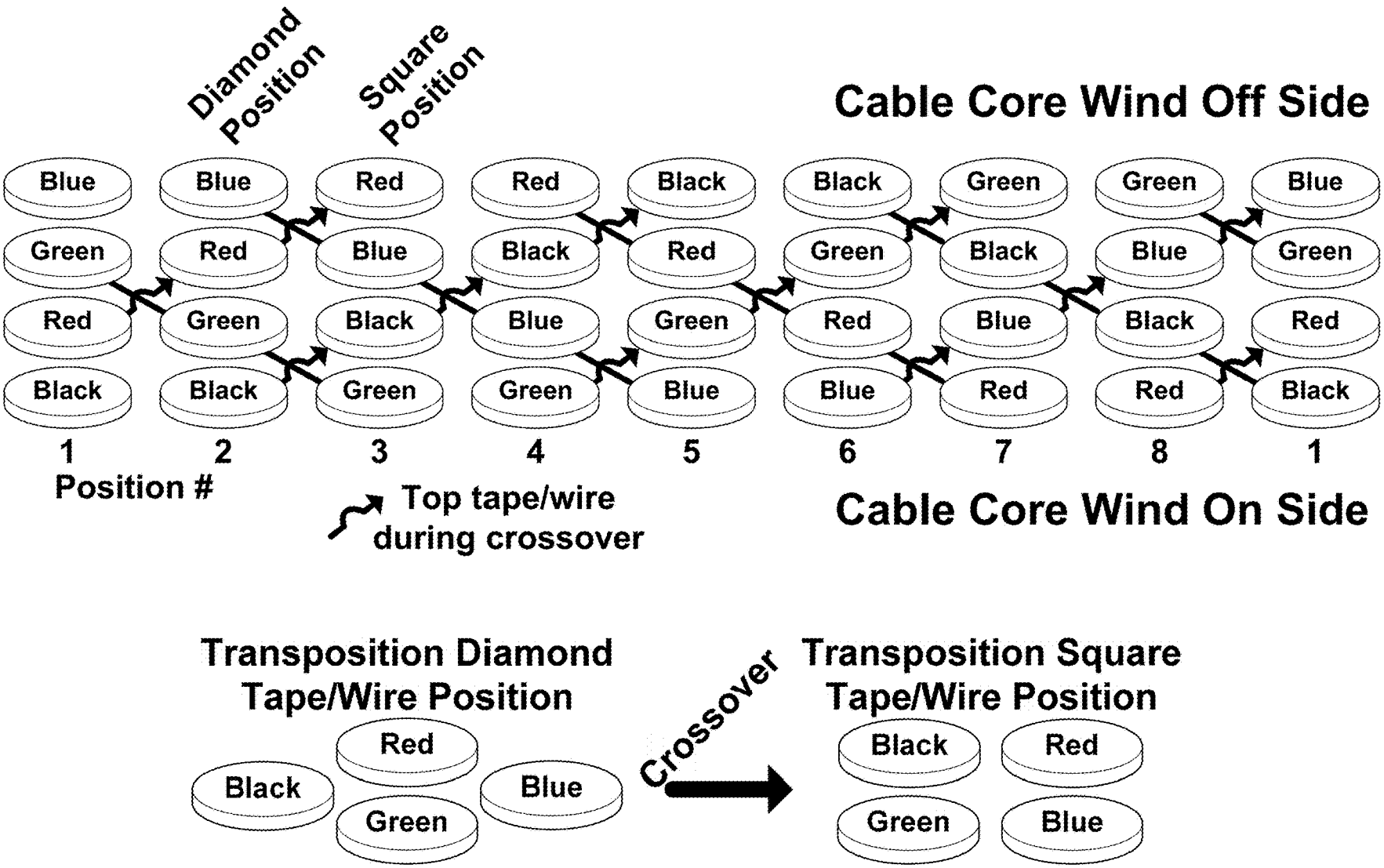
FIG. 19 shows a schematic of transposition wire positions at axial graduations.
Figure 19A:
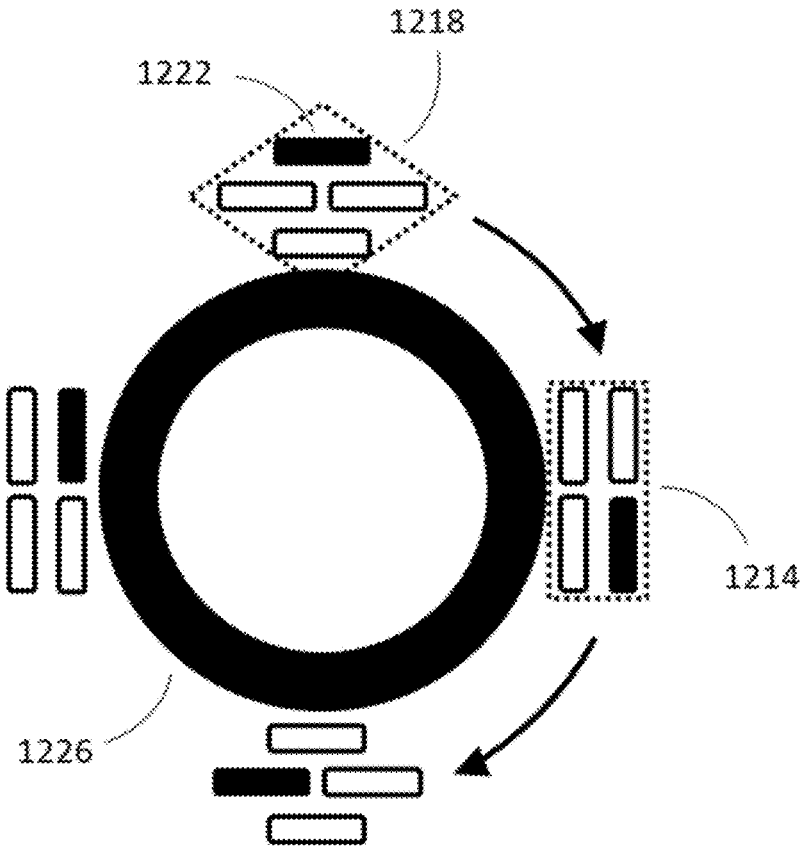
FIG. 19A is a representation of a four-tape winding example.

FIG. 11 shows an embodiment of the invention created to demonstrate a transposition cable wind. Precision motors are synchronized to turn the cable core 1010 off wind-off spool 1008 through revolving tube 1006 and onto wind-on spool 1009. Transposition wheel 1015 is attached to revolving tube 1006 causing four media strand to be wrapped onto cable core 1010. Four wind stations 1001 supply media and routing guidance to cable core 1010. Each strand departs wind-off spool 1003, around tension sensor wheel 1004, across guide wheel 1005, then onto 1010. As transposition wheel 1015 revolves around 1010, it also rotates about its center axis causing the media to alternate relative positions on cable core 1010 as described above and shown in FIGS. 19 and 19A where the HTS 1222 changes position when winding down the length of the cable core 1226 ending up with the square 1214 and diamond 1218 winding patterns. The role of wind stations 1001 is to pay out media while maintain precise tension as measured by it tension sensor wheel 1004, rotate independently of the transposition wheel 1015 upon which it is mounted such that media aligned by wheels 1004 and 1005 will always be directed toward and meet precisely tangential to cable core 1010, and lift and lower its winding plane as defined by its spool and wheels such that media emanating from wind stations further from cable core 1010 are lifted to clear media from wind stations closer to 1010. This lifting and lowering causes the transposition pattern on the cable core as the transposition wheel revolves and rotates all wind stations as the cable core translates linearly during winding operations. Note that if transposition wheel rotation is ceased, wind station lifting and lowering can be ceased and a helical wind pattern is produced by revolution only (of transposition wheel around cable core). Providing power and data to the many motion control stages and sensors also required innovation. Control panel 1011 is shown in FIG. 11. FIG. 11A shows locations 1012, 1013, and 1014 each of which contain a slip ring to accommodate electrical connectivity.

FIG. 12 and FIGS. 15 to 17 provide large embodiments and options for full transposition and braiding.

Variable Twist Pitch and Angle

Active control loops based on the axial tension value as the global control master and a hierarchy of master slave relationships provide the means of varying the twist pitch and angle while accurately maintaining the desired performance value such as constant axial tension. Prime examples of need are a tape media winding or helical winding where the wind-on spool must assume a special angle for the winding yet the angle from the wind-on spool back to the wind-off spool must be constant or a set varying value. A practical solution is achieved through the addition of rotational DoF on the spool and all wire routing mechanisms working in conjunction with current linear and rotary motion mechanisms. Such capabilities expand into automatically to semi automatically controlling the complete wind on/off angles for any system for any desired need.

This aspect of the invention is relevant regardless of the application—winding raw material from one spool to another, winding raw material from a spool to create a magnet, winding a cable or subcable to then use to wind a cable or magnet or cable magnet, winding a cable to create a cable magnet, etc.

Figure 23:
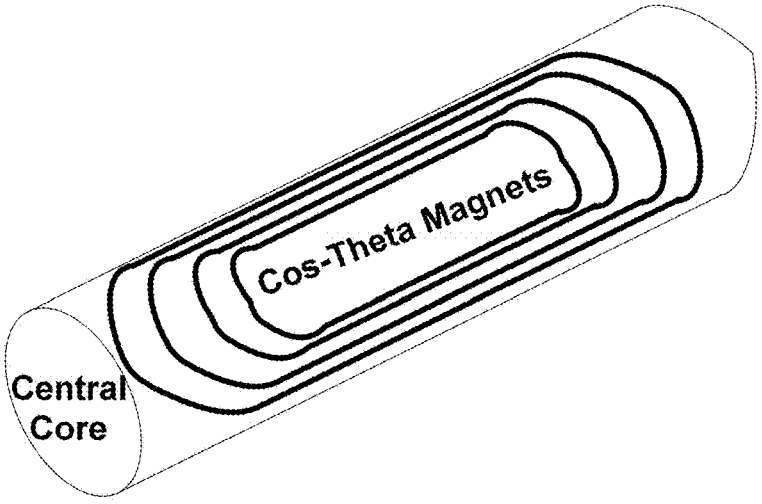
FIG. 23 shows the embodiment of a cos-theta magnet for high energy physics purposes.

For a magnet example, the schematic in FIG. 8 shows pitch angle 742 establishing a twist pitch on former 706. To create this angle, tension measurement wheel angle 722 and also MORT under wind-off spool 704 must carefully maintain the same angle such that wind 702 remains in a plane even as it translates 724. FIG. 9 is the embodiment designed to accomplish winding prescribed by FIG. 8 schematic. In another embodiment of variable twist pitch and angle output a cos-theta magnet configuration providing a high B focus for high energy physics as shown in FIG. 23 is possible as fully automated LMHS output.

To consider a cable example for variable twist pitch control, return to the transposition demonstrator embodiment in FIG. 11 and now inspect its side view in FIG. 11A. Note that the adjustable telescopic strut 1007 control the angle of the transposition wheel. This sets the major component in the wind angle and thus determines the twist pitch. Powering and automating this strut accommodates a varying twist pitch between successive wound layers or even along the length of a wound cable. Full transposition with a variable twist pitch and angle is one HTS cable type preference showing promise for long lengths and scaling to high direct, alternating, and pulsed currents through the addition of more REBCO layers. Yet as each layer diameter varies this leads to an arbitrary twist pitch and angle. Variable twist pitch and angle in the final cable leads to poor AC characteristics due to the inductive mismatch and associated high losses which is unacceptable in many high-power AC applications including fusion. The described LMHS embodiment will provide the cable designer a manual to algorithm automated twist pitch and angle control to allow a controlled to constant cable final twist pitch and angle for transient cable use.

Subcables with Transposition

FIGS. 13 and 13A show an arrangement of LMHS whereby wind stations 1001 rotate and lift as they did in the transposition cable embodiment in FIG. 11. However now the transposition wheel does not revolve about the cable core but rather only rotates in a plane and can produce a fully transposed subcable that can be wound onto spool such as 1020 or directly into a magnet as described in the Magnet Station section. View 1021 presents a close inspection of the media strands that will rotate positions as the wind progresses arranging in pancake magnet winding fashion where the linear media does not touch until it contacts the spool.

Subcables allow scaling of wind complexity. Just as a single wire or tape is wound onto a cable former, so can LMHS wind a subcable. A subcable wound spool is then placed onto LMHS and used in the same fashion as a regular linear media winding spool. Transposition can be accomplished in a subcable wind then a collection of such subcables can be wound with a transposition or braiding geometry into a cable. Thus, complex cables originate from a separate subcable winding embodiment of the LMHS invention.

These subcables can be wound onto the former core clockwise and/or counterclockwise and grouped accordingly across each LMHS winding station as per the direction of the core as the cable runs through the machine one time. This is equivalent to how each individual SC linear media in non-cable form winds directly onto the former core clockwise and/or counterclockwise and grouped accordingly across each LMHS winding station as per the direction of the core as the cable runs through the machine one time.

Subcable sets that have extended ends such as the embodiment of four tapes per set with a flat side together 1-2-1 top to bottom orientation have ends that can overlap from subcable to subcable when wound together such as when winding onto a cable. Winding these subcable sets helps increase the packing factor of subcables when subcables are separated or possibly when transposed.

An LMHS direct cable wind of any type including full transposition and braiding winds directly onto the cable former where the linear media has no contact with other linear media until contacting the cable former at the point of wind on. This allows not only additional wind position control with no linear media side bends but removes any no opportunity for tape twist.

Subcables, Transposition, and Twist Pitch

LMHS will provide the cable designer a manual to algorithm automated twist pitch control for AC cable use as well as partial to full transposition for the entire stack which makes a subcable as well as transposition of each individual tapes per subcable as well as transposition of each subcable to subcable.

Figure 15:
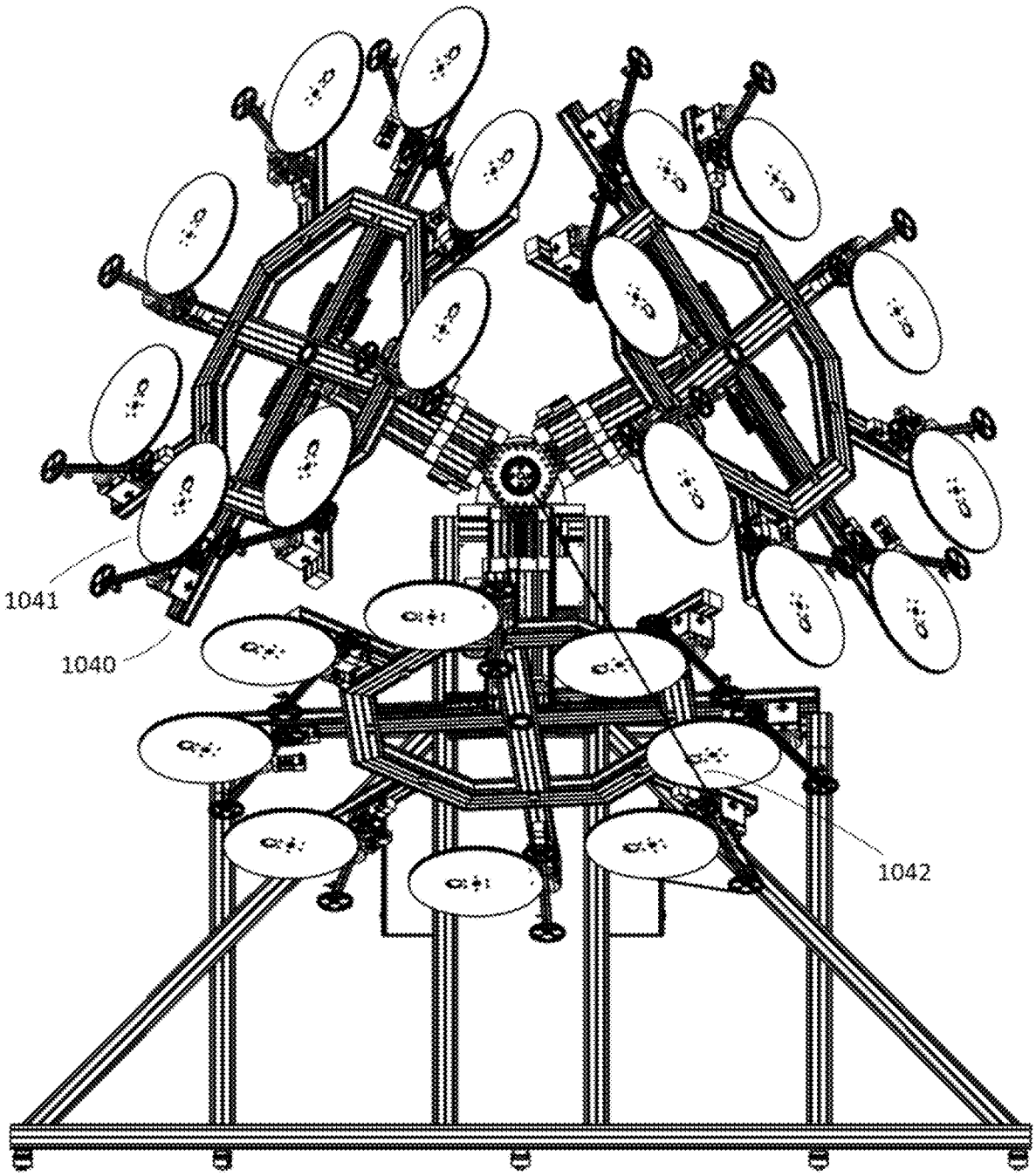
FIG. 15 shows the front view of a portion of an embodiment of the invention that can produce a full transposition wind of 24 media strands.
Figure 16A:
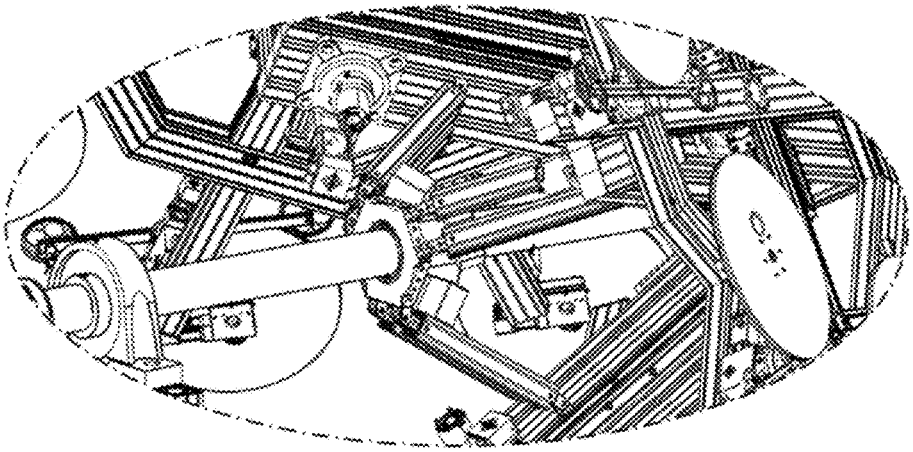
FIG. 16A is a partial detailed view of FIG. 16.
Figure 16:
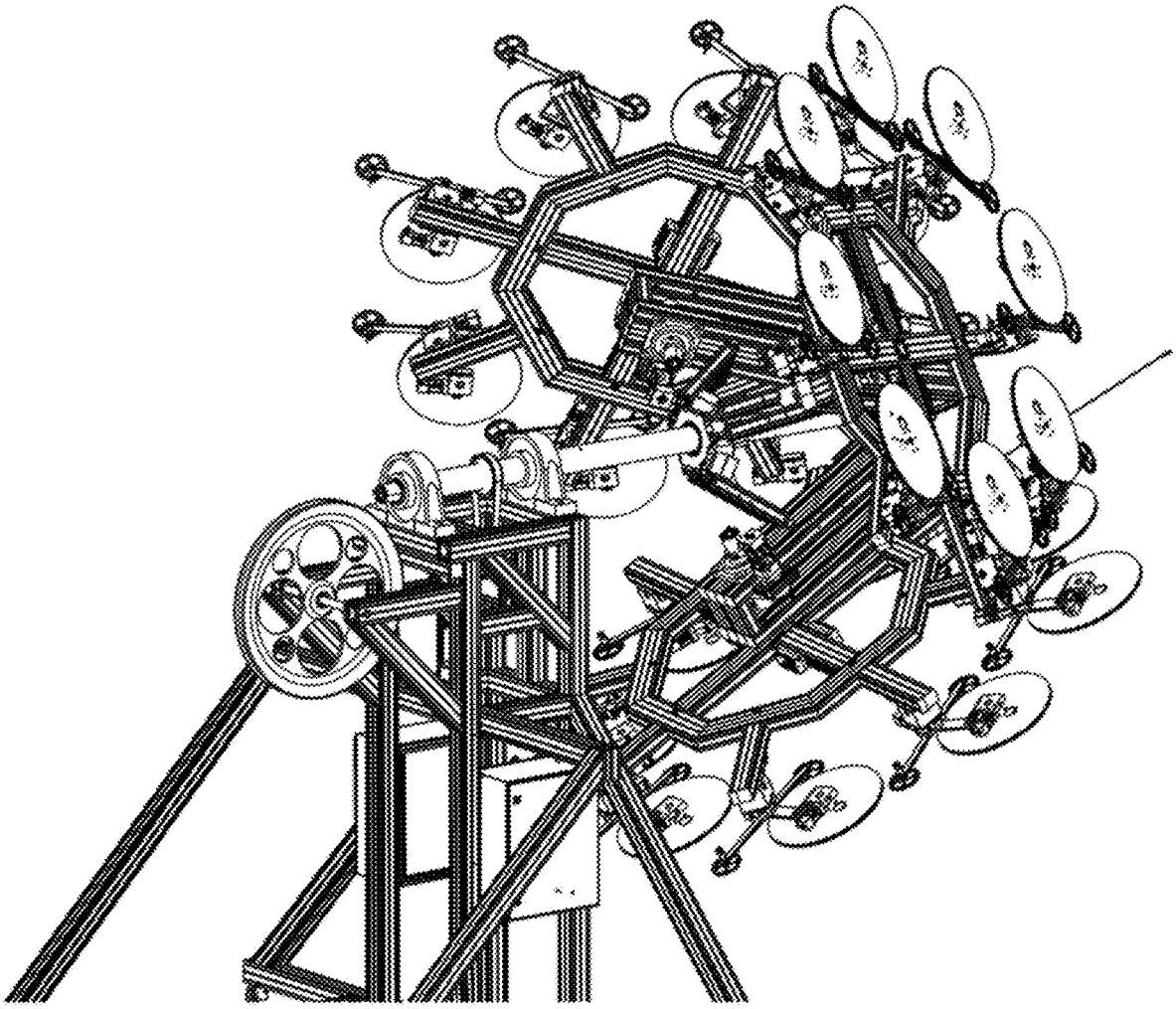
FIG. 16 shows rear isometric view and detailed section thereof.
Figure 17:
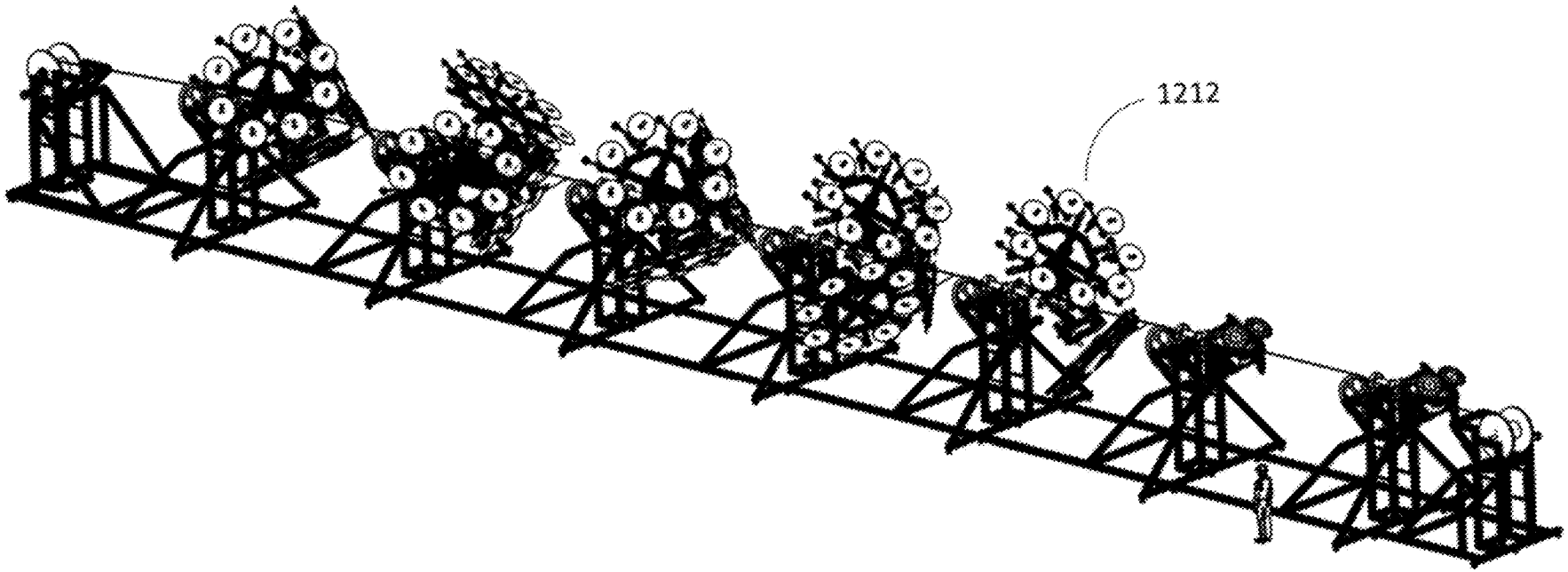
FIG. 17 shows side isometric view and front isometric view of an embodiment of the invention that shows five full transposition winding stations and two helical winding stations inline and in succession.
Figure 17A:
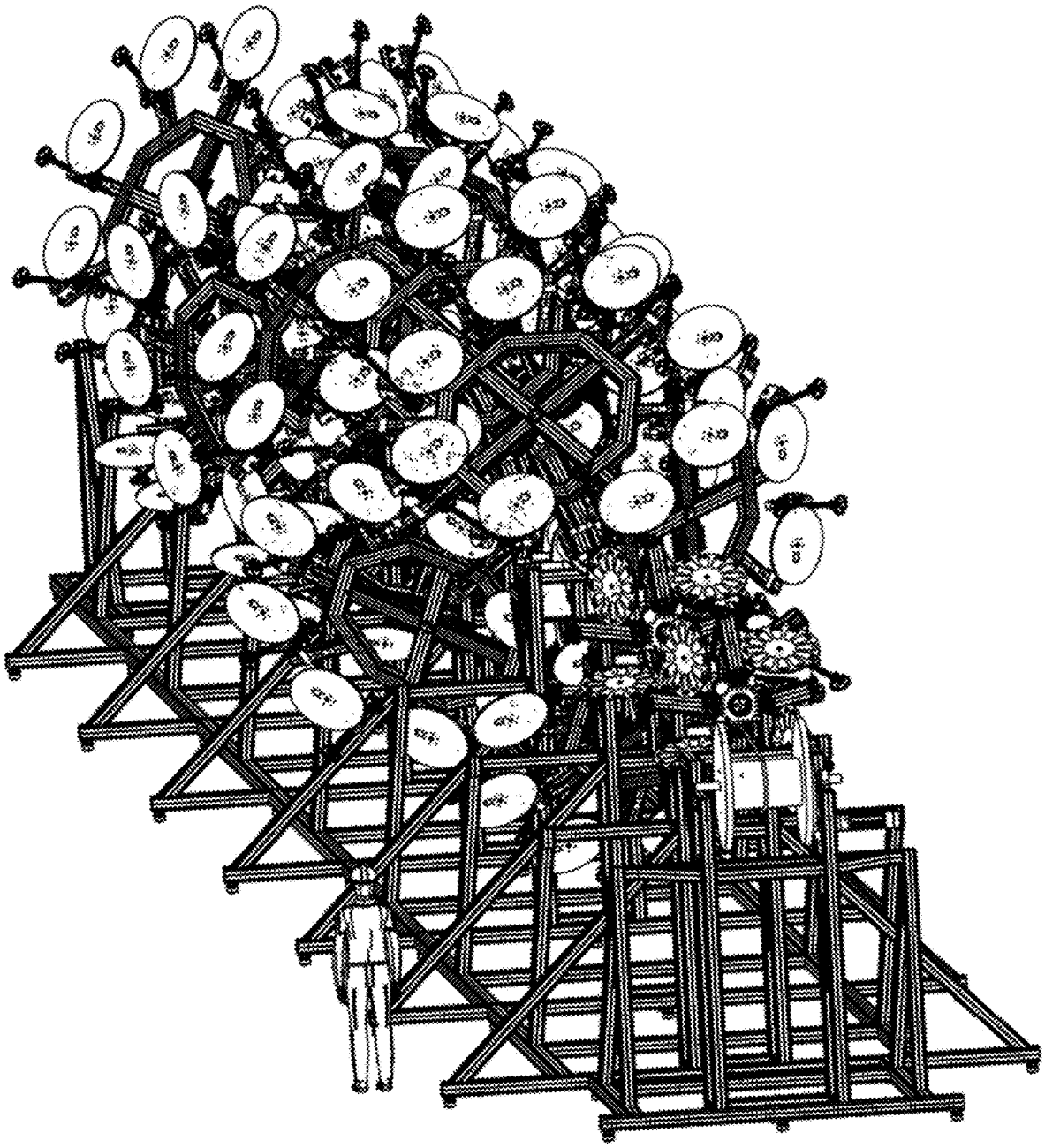
FIG. 17A is a front perspective view of FIG. 17.

Transposition on the cable level LMHS provides more choices for the cable designer. A single set of transpositions can be used to develop the HTS cable across a variable pitch angle, etc. The number of SCs making up the subcable depends upon the former core size since LMHS can readily mount as many SC spools into a single LMHS winding station as a cable designer may require. Currently an LMHS winding station can include over 20 spools. FIG. 15 and FIGS. 16/16A present a single wind station embodiment from different views of LMHS composed of three transposition wheels 1040 collectively holding 24 media spools 1041. 1042 shows the routing path of media from one representative spool. With synchronized lifting and lowering of wind stations, media from all 24 spools refrains from entanglement and can engage in full transposition winding patterns. This wind station is then placed into a larger winding machine set of stations such as the embodiment shown from two views in FIGS. 17/17A with 1212 wind station of FIGS. 15/16.

Another embodiment of the LMHS invention develops SC subcables, much like the Roebel Assembled Coated Conductor (RACC) subcables, and places them into stacked cable setups, must like the Coated Conductor Rutherford Cable (CCRC) cable setup with RACC subcables. Each LMHS winding station provides a new subcable set which then are wrapped in an alternation fashion onto the former core.

Finally, the subcables described above can provide yet another option of fully transposing these fully transposed subcables and then winding onto the former again with a variable twist pitch, etc. and with another full transposition or braiding option. This production choice is limited with the former core again but also into how large of a station is required to fully transpose these subcables since now the number of revolving subsystems is quite large.

Large design changes of using robotic arms to grab and release in a holding location each rotating winding station system can further expand the number of fully transposed subcables. Furthermore, the robotic, or equivalent grab and release of each spool, can braid and transpose the linear material in any desired fashion. This embodiment is equivalent to any means of human arms grabbing and releasing a line to be braided or transposed next into the stack.

HTS cables scale to very high currents through the addition of more REBCO layers. Yet partial transposition as used in current cable fabrication techniques may preclude from use in high energy physics and fusion applications. Full transposition of HTS is required for purposes such as no net self-field flux is enclosed between the strands producing AC losses and hence one of the focal points of LMHS. No known system today fully transposes SCs whether manually and certainly not in an automated machine.

Providing transposition as well as variable twist pitch and angles, etc., which adversely affect the packing factor, enables the designer to choose the best option for their need. Helical SC winding today has another issue where each SC also thermally shields the prior layer. This may require more aggressive cooling as well as properly placed copper stabilizer for safe operation. Yet allowing a lower packing factor for transposition, pitch angles, etc. also allows room for beneficial conductive, such as Cu, stabilizer and/or cooling options. Spool Rotation Around Cable Cable winding is accomplished either by rotating the cable core on its central axis and holding the spool systems fixed or the embodiment of rotating the spool systems around the cable core. FIG. 11 shows the embodiment for most cases. Though more numerous to create most geometries, media spools are considerably lighter to control in motion than the cable core spool and the wound cable spool.

Braiding

Braiding is a type of transposition and in particular more complex than a full transposition. A full transposition can be accomplished by a clockwise or counterclockwise rotation of members around each position location. For braiding, members interchange positions among any rotation. This results in interwoven winds with media completely switching positions at set intervals along the wound output product.

A typical geometry of an SC cable with full transposition contains HTS layers of wound subcables that follows the pattern presented earlier where the subcable positions alternate in rotational sequence. For example, relative to contacting the core a four HTS tape subcable order (1,2,3,4) will alternate as (2,3,4,1) then (3,4,1,2), then (4,1,2,3) and then start over at (1,2,3,4). In a cable with a more simplified level braiding, the next level of complexity beyond HTS full transposition, the HTS tape order has alternating internal sequences further lowering impedance loss. In braiding this four-wire case, subcables 1 and 2 and/or 3 and 4 swap positions at one of the four places in the presented recurring sequence. Like transposition, braiding is achieved through other embodiment mechanisms including Spool Rotation Around Cable and Rotary Lift Stage with Tensioner but with the addition of rotating and/or swapping the spools on the transposition wheel as described further in this section.

Figure 14:
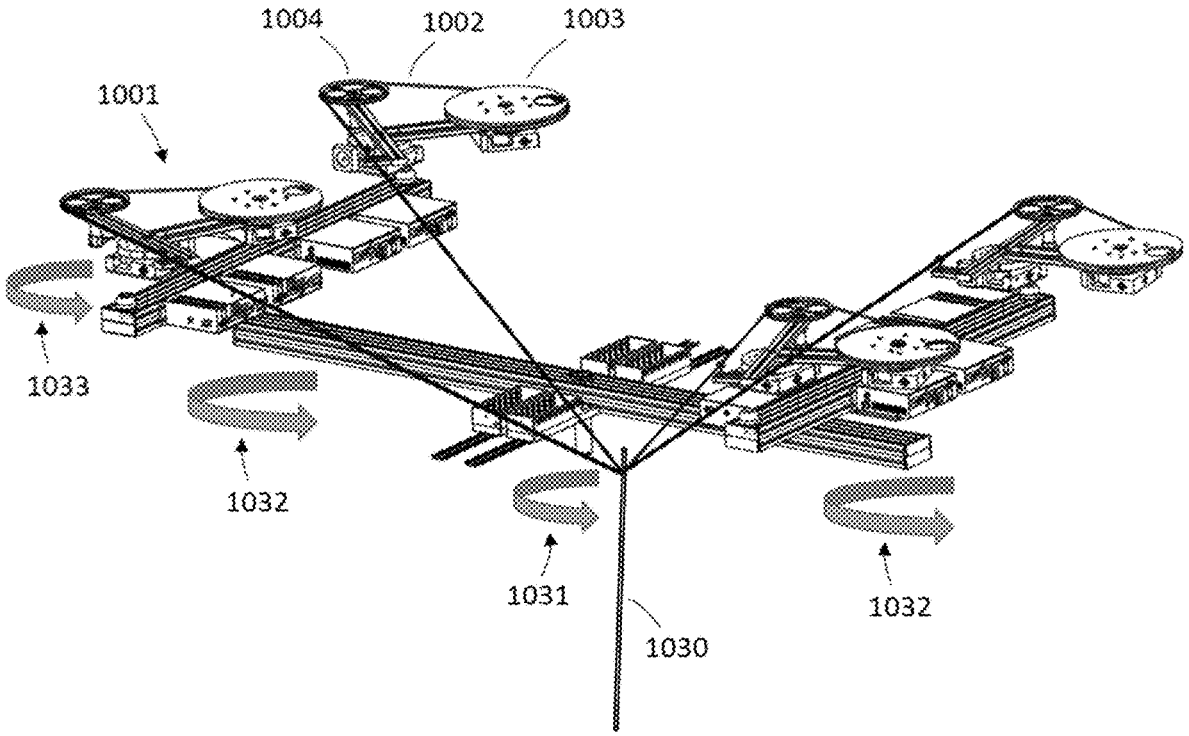
FIG. 14 shows an isometric view of a portion of an embodiment of the invention that can produce a full braid wind of four media strands.

FIG. 14 shows an embodiment that accomplishes braiding involving rotation of two pairs of two spools and is analogous to the full transposition of four spools shown in FIG. 13/13A. Each of the pairs of wind stations 1001 controlling spools 1003 can be rotated separately 1032 as the collection of both pairs rotates on the common braiding wheel 1031. Each media spool must be lifted and lowered with coordinated timing to avoid entanglements and to place the media per specification onto the former. Braiding continues as all spools rotate just as in full transposition then pairs swap positions at set position or positions in the braiding wheel rotation 1031. Observing the results on wound cable 1030, compared to the simpler full transposition, braiding lowers the packing factor compared to a more purely helical based wind but places more complexity into the routed media that can provide the advantage of decreased induced EMF resistance experienced by large current transients. LMHS uses the flat braid technique for winding on central core cables and the lattice or full braid technique for providing complete SC cables. Partial to full transposition is possible with either technique.

Rotary Lift Stage with Tensioner

A significant aspect of LMHS for cable winds with transposition is the provision of relative motion of the media in alternating directions away from some nominal wind plane. If all media spools were on the same plane, or even if they remained stationary on different planes, interference among media strands would occur upon transposition winding efforts. For success, relative motion must occur among media spools such that media spool planes pass through one another during times not aligned with those same media strands crossing one another or the other's wind station. Relative lift motions must be greater than media width and spool thickness however larger lift motions tend toward larger gaps in winding output. The use of powered lift stages provides greater control and motion profile flexibility offering greater success as measured by the synchronized media deposits onto the cable former.

In one embodiment for winding cables, this lift stage is stacked with a rotary stage to create a foundation of a wind station 1001 that can simultaneously move media orthogonal to the wind plane and keep it pointed at the cable former. Adding a tension sensor and a rotation stage for media spool payout and the resulting wind station assembly 1001 is a dense, highly functional embodiment of this invention forming the foundation of motion control that accomplishes cable transposition and braiding for delicate media. This same system can be used to make subcables and can be used to transpose or braid those subcables together.

Automated Multiple Phased Winding

Some LMHS winding machine embodiments have transposition, such as full transposition and braiding, stations with three transposition wheels each. This allows an automated single to three-phased output when running through a single transposition station where insulation stations are added in between each transposition wheel that are connected to the transposition wheel rotation around the core. This automatically creates three phase output when the phase groups remain separated. This same methodology is used for any winding station including helical, transposition, sub-cable, and braiding.

Beyond direct winding, if running a cable thru multiple transposition stations as described then allows the option of termination connecting one of each of the three transposition outputs per transposition station in a variety of manners depending on the number of output phases desired. Such an embodiment allows a wide variety of automated machine phase separation options.

Compact Advanced Superconducting Devices

Figure 20:
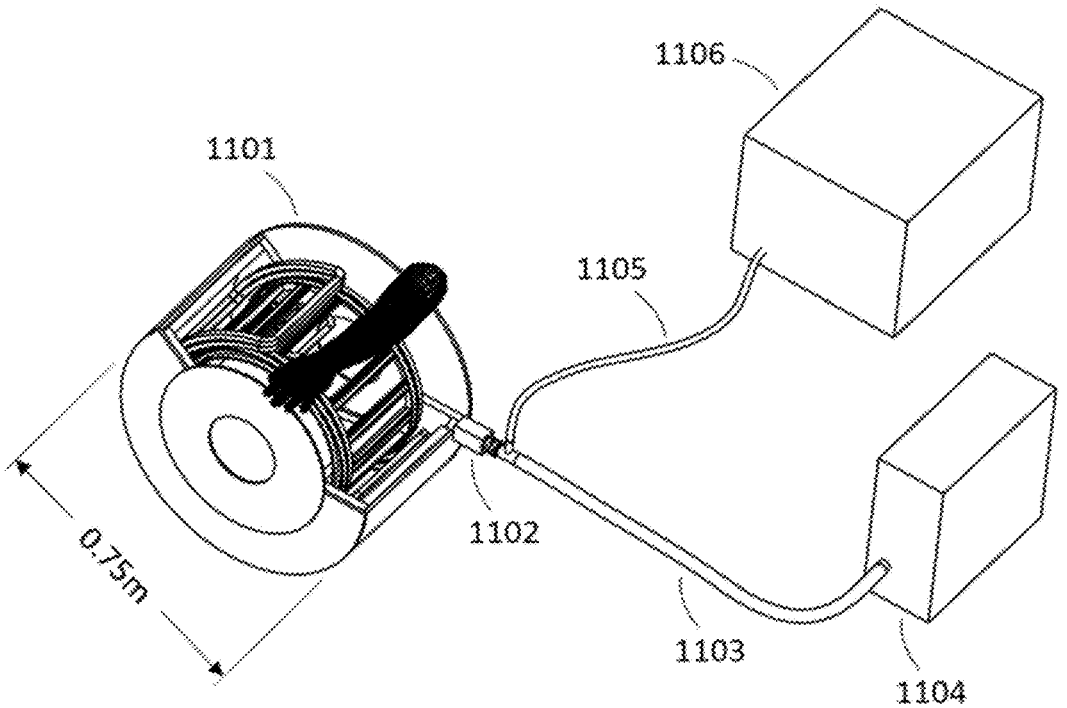
FIG. 20 shows isometric views of system and primary component of an embodiment of the invention that functions as a compact MRI.
Figure 20:
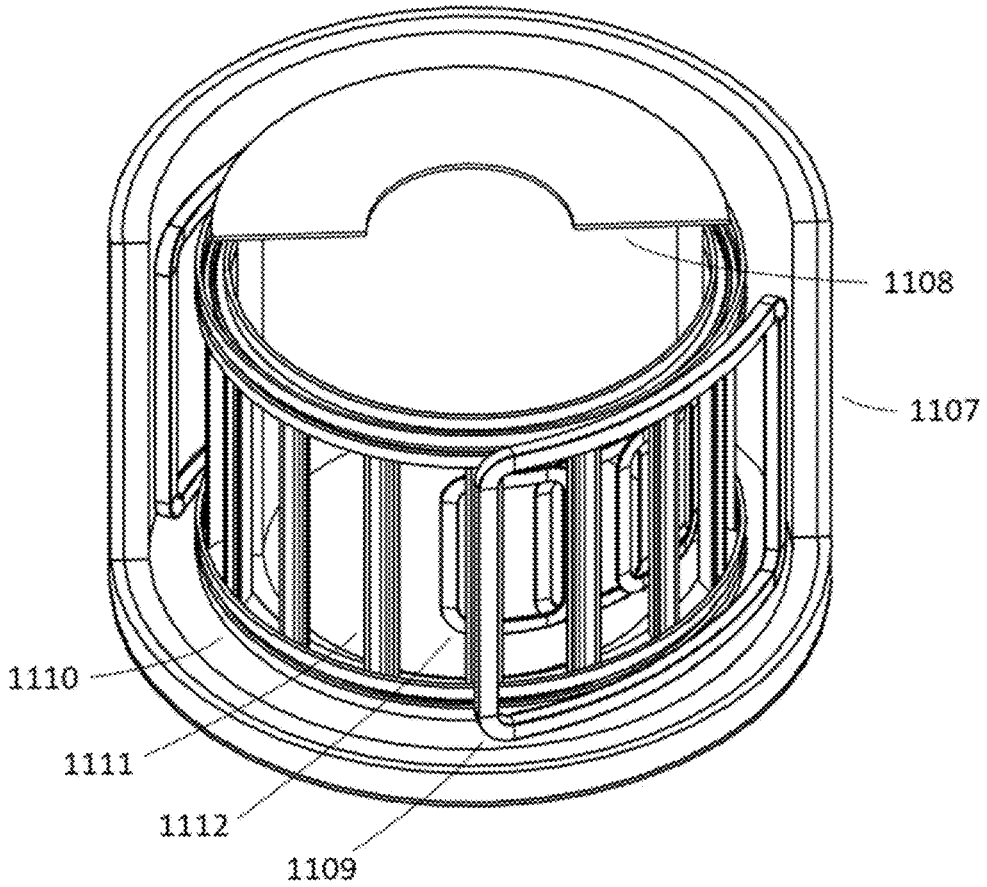
Figure 21:
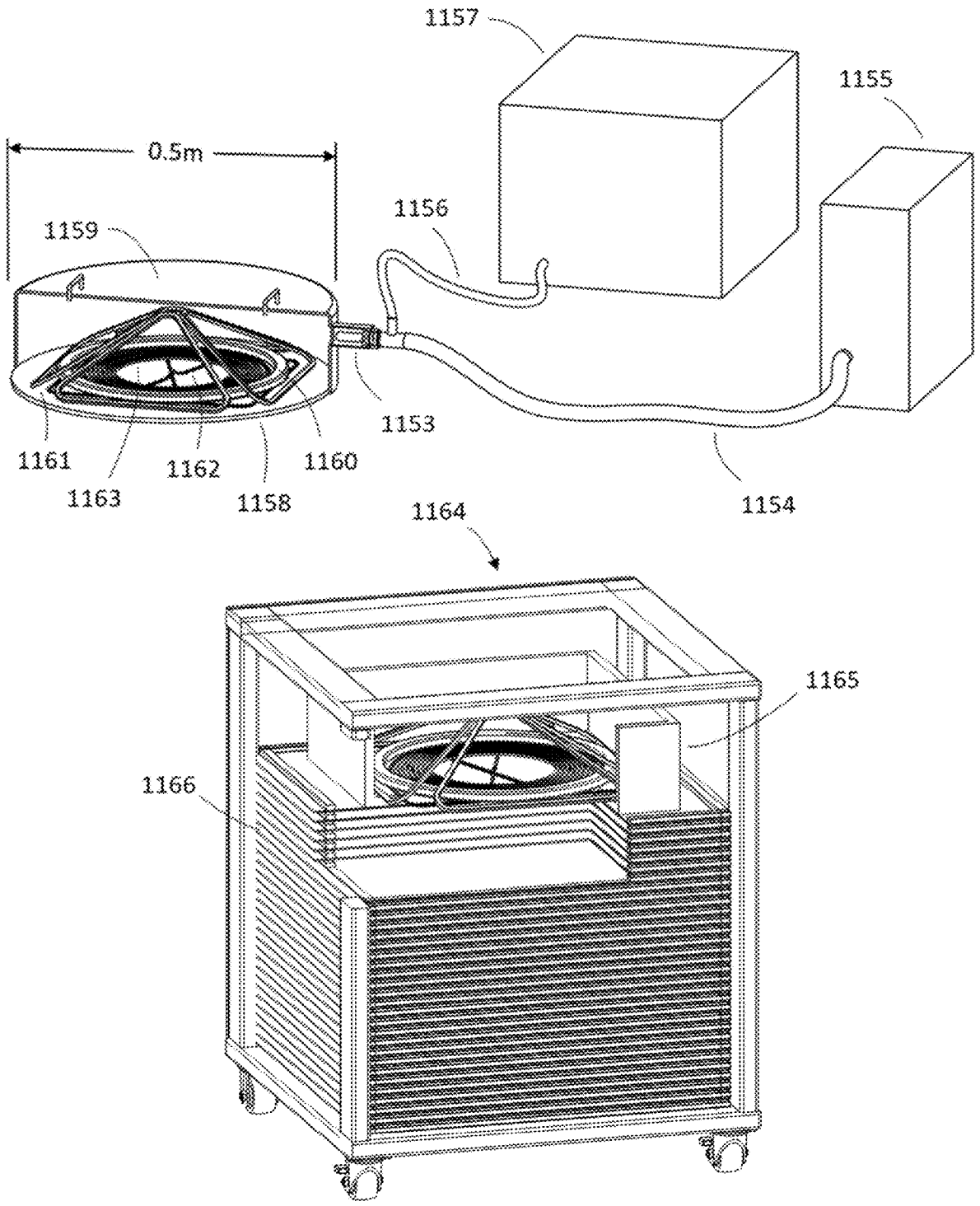
FIG. 21 shows isometric views of a system and the primary components installed in a test stand of an embodiment of the invention that functions as a compact SNMR.
Figure 22:
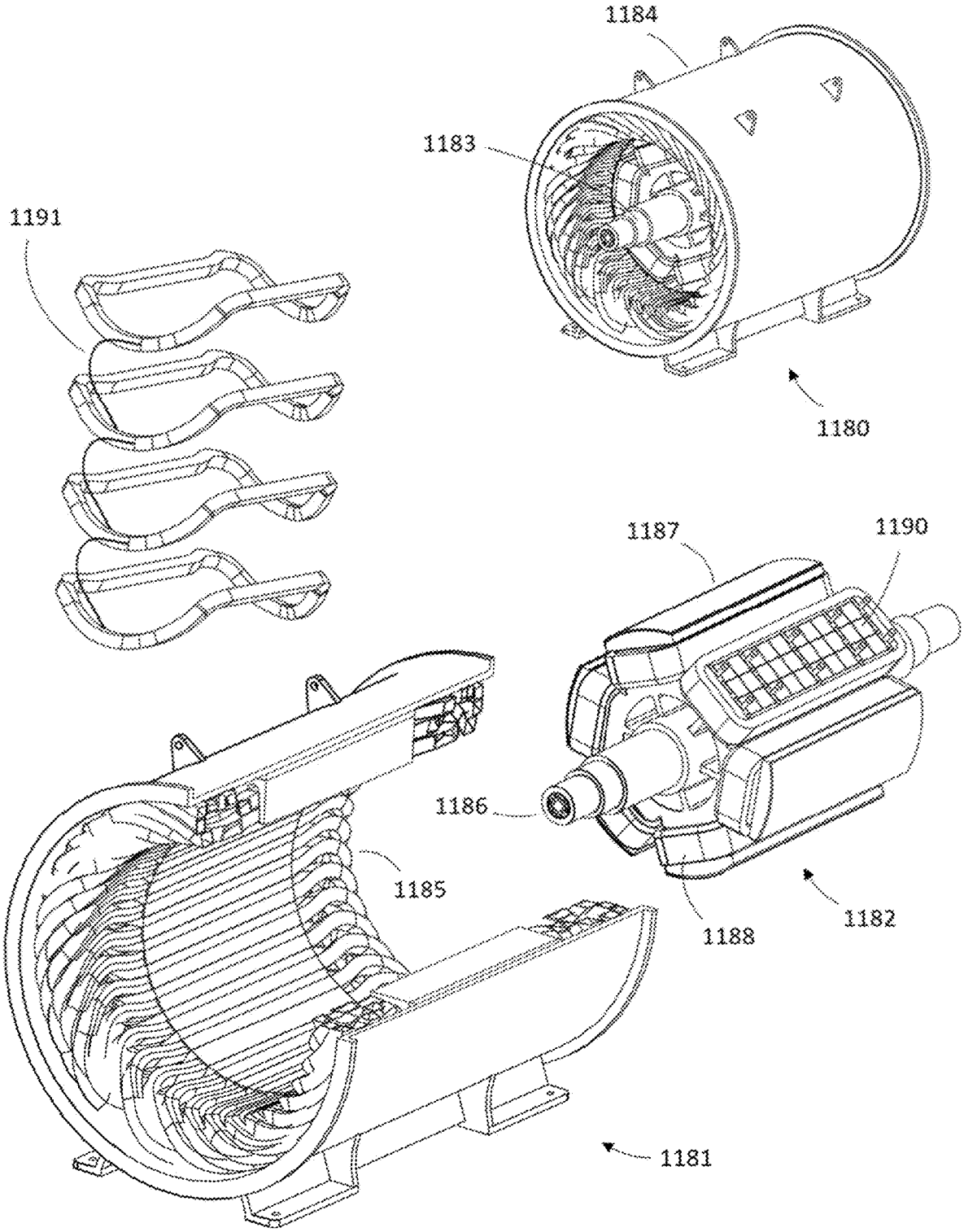
FIG. 22 shows isometric views of an assembled and exploded assembly of an embodiment of the invention that functions as a compact superconducting motor/generator.

FIG. 20 to FIG. 22 show personal, portable devices that are more compact in size and weight than prior art conductively cryogen cooled systems or classic liquid bath designs.

FIG. 20 shows an entire system personnel portable compact MRI used to examine extremities and neuroimaging where the SC magnets are 1109, 1110, and 1112. No 3 Tesla high resolution, or even close to 1 Tesla, NMR or MRI tool of any type on the market or any known in development exists that is person portable or compact.

Figure 20A:
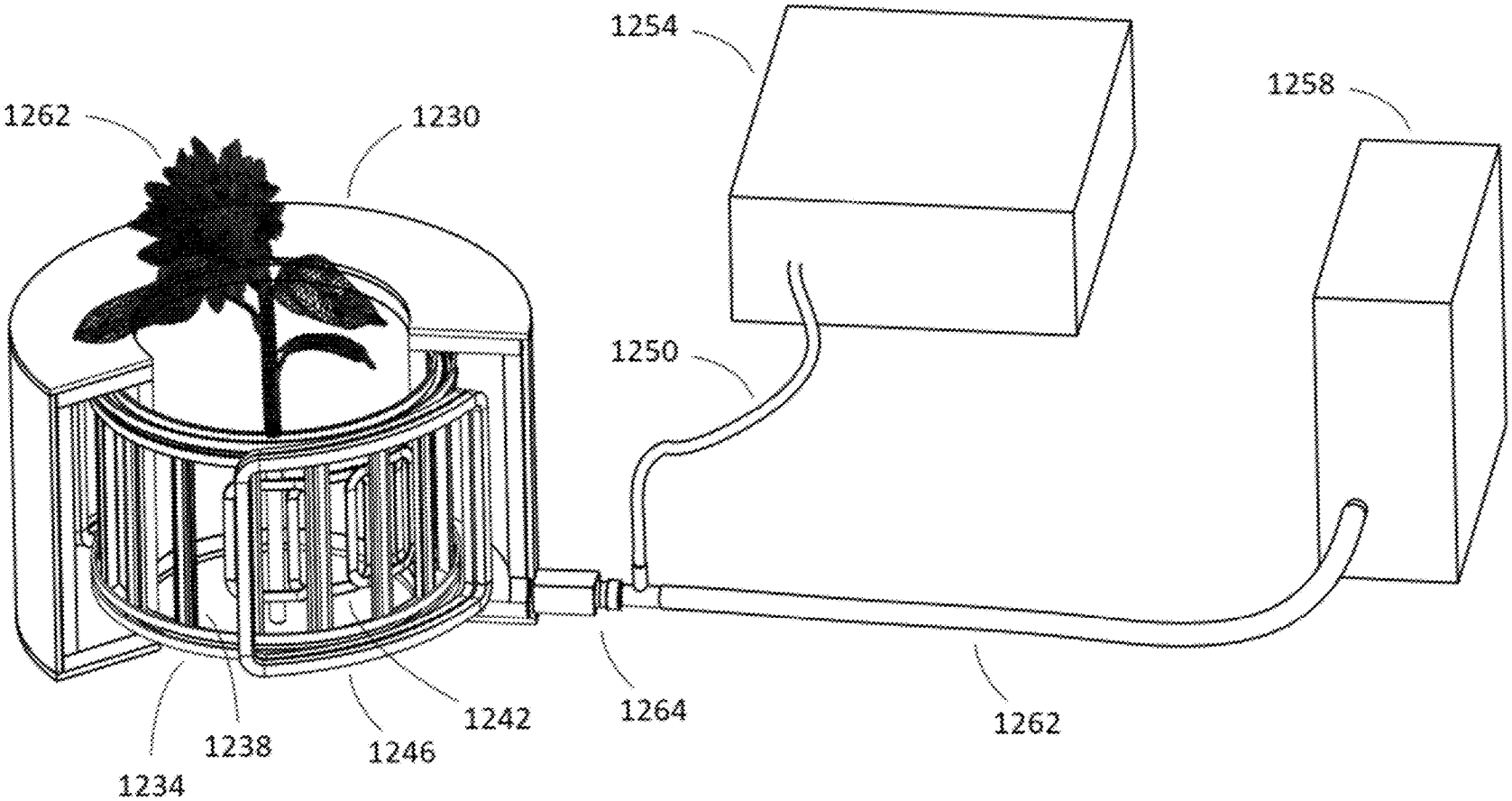
FIG. 20A shows isometric views of system and primary component of an embodiment of the invention that functions as a compact NMR.
Figure 20B:
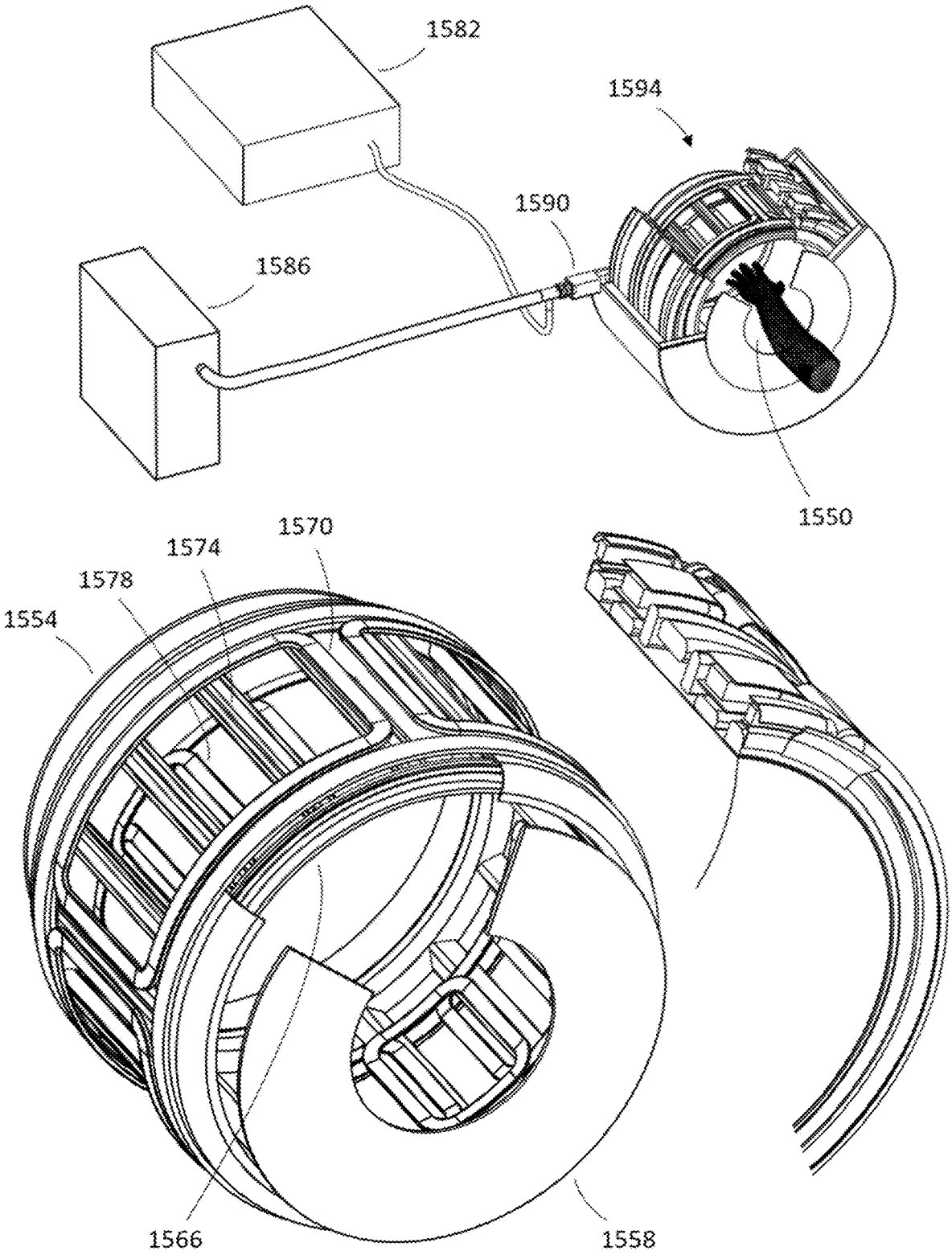
FIG. 20B shows further isometric views of system and primary components of an embodiment of the invention that functions as a compact MRI.
Figure 20C:
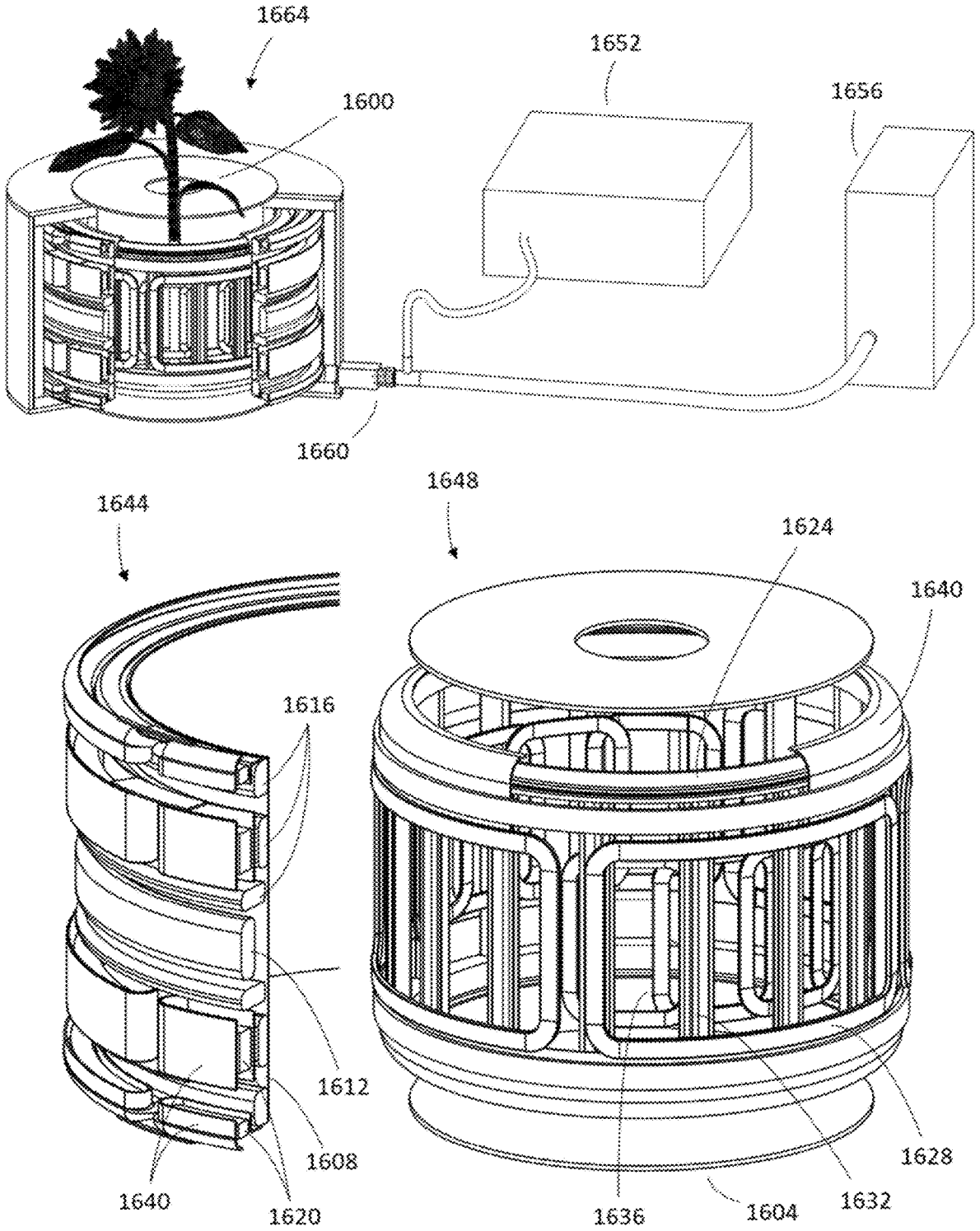
FIG. 20C shows further isometric views of system and primary components of an embodiment of the invention that functions as a compact NMR.

Further the NMR and MRI embodiments shown in FIGS. 20-20C include split bore NMR and MRI into connected parts such as in halves to allow a larger subject body scan yet with a compact and portable device. Magnets across the bore halves connect often with conductively cooled electric leads. One embodiment uses curved and/or split halves or parts to accommodate a part of a torso for a portable diagnosis without requiring the size of today's full body MM. These embodiments include all MRI types including the embodiments of personnel portable, manual wheeled system portable such as a cart or any castored as well as small vehicle portable which are not available today in any form beyond a large-scale MRI build into an 18 wheeled semi-truck, which acts as a mobile lab platform. Compact MRI systems are the logical subscale devices for advanced full body MRI and higher resolution embodiments such as compact MRM. Embodiments from the compact units including magnetic and acoustic containment are then brought into a full body MRI.

NMR and MRI embodiments include bioimaging sensor for sustainable agricultural production systems, protecting natural resources and the environment, biofuel producers, medical researchers, crops such as cannabis and hemp such as for THC or CBD products, exotic crops such as wines, etc. FIG. 20A shows a personnel portable compact NMR used for biological plants facilitates understanding the physical, biological, and chemical interactions and functionality of 1262 plants including the plants that yield food as well as renewable needs such as plants used in the sustainable bioenergy, biofuel process such as cellulosic and lignocellulosic biomass to biofuels. Here the 1234, 1238, 1242, and 1246 magnets are contained in the 1230 housing with separate and connected 1254 and 1258 operating units connected by 1246 cryogen and 1250 power and data cables into 1246 cryogen bayonet connector.

FIG. 20B shows further views of the embodiment of the invention that functions as compact MRI as also shown in FIG. 20 where these versions are represented for human extremities. The device shown here is a Compact Advanced Superconducting Device by using compact NMR/MRI coils and can function as a field operable superconducting device. These views show the bore that can orient to the subject's position 1550, conductive end plate 1554, conductive end annulus 1558, main coils 1562, z-axis gradient 1566, x or y-axis gradient 1570, radio frequency (RF) transmit 1574, and RF probe 1578. Supporting power supplies with control 1582 and cryogen supply elements 1586 provided through the common power, data, and cryogen bayonet connector 1590 to lower heat loads are also shown. The small sizing and closeness of magnetic coils to the field of view (FoV) to attain this NMR/MRI magnet design for this compact MRI 1594 provides the ability to attain benefits such as a large NMR/MRI field of view with a high-resolution while being personnel portable as well as operate as both an NMR and MRI in the same device.

FIG. 20C shows further views of the embodiment of the invention that functions as compact NMR as also shown in FIG. 20A where these versions are represented for plants. The device shown here is a Compact Advanced Superconducting Device by using compact NMR/MRI coils and can function as a field operable superconducting device. In these views the bore that can orient to the subject's position 1600, conductive end annulus 1604, main flat spiral coil 1608, main center coil 1612, main Helmholtz coil sets 1616, main directional coil sets 1620, z-axis gradient (when used for MRI) 1624, x or y-axis gradient (when used for MRI) 1628, radio frequency (RF) transmit 1632, and RF probe 1636 are shown. All magnets with EM shields 1640, DC field main and main directional coils 1644, and RF and gradient (for MRI) field coils and EM shields 1648 are also shown as separate coil groups. Supporting power supplies with control 1652 and cryogen supply elements 1656 are provided through the common power, data, and cryogen bayonet connector 1660 to lower heat loads are also shown. The small sizing and closeness of magnetic coils to the field of view (FoV) to attain this NMR/MRI magnet design for this compact NMR/MRI 1664 provides the ability to attain benefits such as a large NMR field of view with a high-resolution while being personnel portable as well as operate as both an NMR and MRI in the same device.

A Surface NMR (SNMR), which includes SMRI, is analogous to receiving a one-sided MRI scan such as an MRI scan of what is below ground. A SNMR embodiment includes compact SNMR units such as geoscience needs to investigate the ground or a similar substrate, all crops, etc. listings for NMR and MRI, or any need for a one sided NMR or MRI or equivalent operation. An entire system personal portable SNMR embodiment is shown in FIG. 21 where 1160 to 1163 show the SC magnets arranged in a specialized array for greater penetration depths. These 1160 to 1163 magnets are seen in the separate 1164 test setup with 1165 magnet set test articles and substrata for test depth in 1166 pull out trays.

Figure 21A:
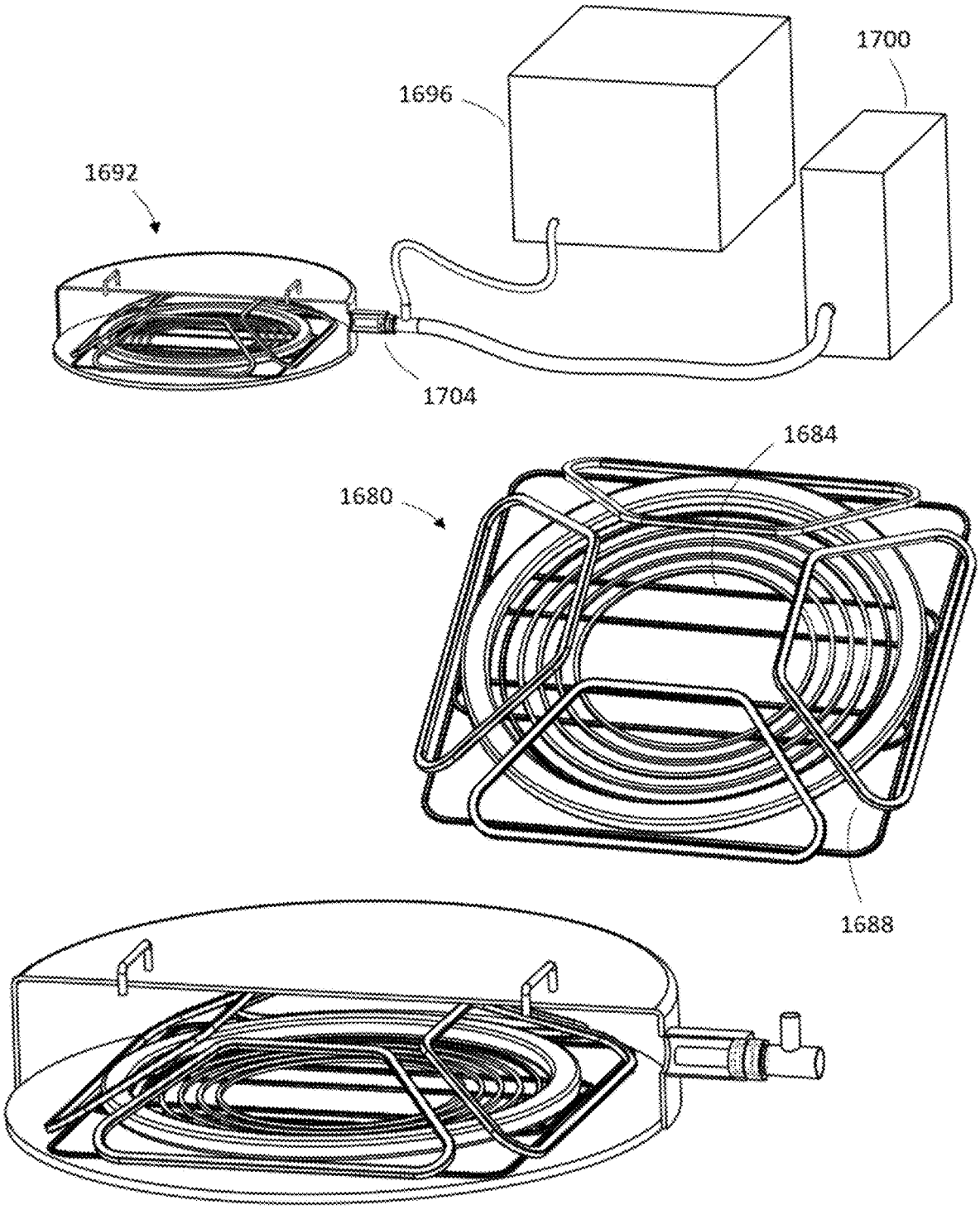
FIG. 21A shows further isometric views of system and primary components of an embodiment of the invention that functions as a compact SNMR.

FIG. 21A shows further views of the embodiment of the invention that functions as compact surface NMR (SNMR) as also shown in FIG. 21 where these versions are represented for geophysics purposes. The device shown here is a Compact Advanced Superconducting Device that can function as a field operable superconducting device and uses compact NMR/MRI coils to attain a high penetration depth SNMR or SMRI under certain embodiments. These views show the main coils in a focused magnet array with main directional doils that are notched and graded 1680, SNMR angled and/or separated RF Coils 1684, SNMR angled gradient coils 1688, and a device with a bore that orients to the subject position 1692. Supporting power supplies with control 1696 and cryogen supply elements 1700 provided through the common power, data, and cryogen bayonet connector 1704 to lower heat loads are also shown. The small sizing and coil architectures for this NMR/MRI magnet design for this compact SNMR/SMRI provides the ability to attain benefits such as a large penetration depth with a high-resolution while being personnel portable as well as operate as both an SNMR and SMRI in the same device.

Figure 22A:
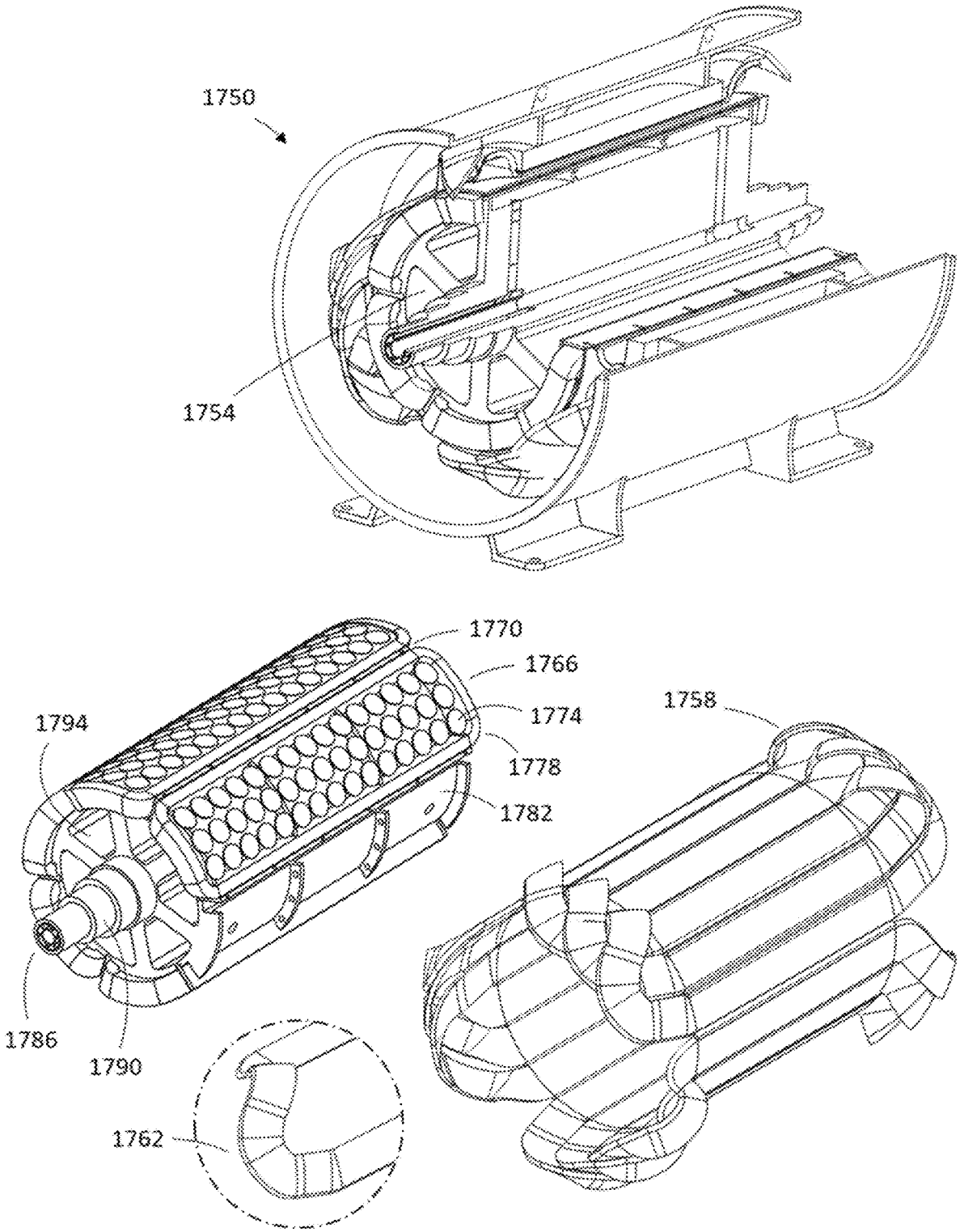
FIG. 22A shows further isometric views of system and primary components of an embodiment of the invention that functions as a fully HTS and hence fully cryogenically cold electric machine (motor/generator).

FIG. 22A shows a fully HTS and hence fully cryogenically cold superconducting electric machine (motor/generator) 1750. The device shown here is a compact advanced superconducting device that can function as a field operable superconducting device and can function as a primary element of a field operable superconducting system. The high magnetic flux density (B) allows a hybrid to air core 1754 electric machine where the tape curvature and alignment for B path is provided in all armature and field coils. The armature coils are a flat fan magnetic coil 1758 where in this embodiment the armature is on the stator. The flat fan end turns 1762 add to the electric machine magnetic length. In this embodiment the curved flat fan coils and TFMs are both used to comprise the field poles 1766 where in this embodiment field poles exist and are on the rotor. In this embodiment specialized HTS EM shields 1770 are provided over the field poles, between armature phases, and over non-magnetic length end turns. In this hybrid superconducting magnetic configuration, the Trapped Field Magnets (TFM) 1774 or permanent magnets are placed in the field coils in groups with surrounding field coils 1778. The entire field pole 1766, even if fully HTS, can be built separately and assembled as a unit into the electric machine including the option for superconducting TFM activation outside of the machine. In one embodiment the field pole has a cryogen reservoir 1782 below conductive cooling regions to support cryo cooling needs. This embodiment of a totally cold, cryogenic, motor or generator is possible through the non-thermal conducting hollow shaft 1786, further indicated with a non-metal section 1790, with a rotating cryogenic coupling with embedded slip ring-based power and data cable connection. An evacuated air gap 1794 embodiment supports a fully cold electric machine by removing icing concerns with added benefits such as the removal of windage.

A motor and/or generator type machine embodiment includes units such as any motor and/or generator use. A motor and/or generator embodiment which is personnel portable if compact enough is shown in FIG. 22 where certain cryostat elements are removed to show SC coils 1185. Motor and generator embodiments range across all types of rotary and linear AC, such as synchronous and induction machines, as well as DC machines for both a hybrid to complete SC armature and/or a hybrid to complete SC active and/or passive exciter field coils where the magnetic poles range from one or a combination of individual component, wound, TFM, solid pole, etc. Embodiments also include back iron or in particular a hybrid core and/or air core motor and/or generator where removal of back iron allows a lighter machine and lowered frequency losses given the SC magnetics allowing a compact machine. The superconducting machine air gap is an evacuated air gap to remove icing of water from the air but also removes all windage loss. Motor and generator machine embodiments are across an extensive number of industries and applications which is too exhaustive to readily list. One embodiment is a wind or hydro turbine generator. Another embodiment is a hybrid or all electric air, land, sea, or space vehicle motor and generator including the embodiment of a partial to complete SC type motor or generator. The embodiment of hybrid to all electric aircraft of all types and sizes are expected to make great use of this invention by itself and in particular embodiments involving the Combined Superconducting Magnetics and Speed invention disclosure and potentially the Hybrid Superconducting Magnetics invention disclosure.

Figure 24:
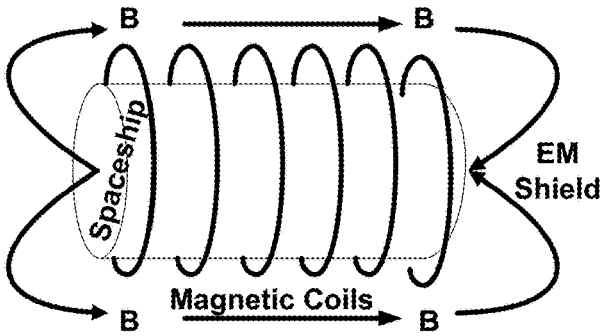
FIG. 24 shows the embodiment of an electromagnetic B shield around a spacecraft.

A further embodiment that is not a compact system in the strict sense of personnel portable but is compact regarding how all elements must be as light as possible is exemplified in a spaceship EM shield as shown in FIG. 24. In this case a set of large SC coils are arranged around a spaceship providing a B shield to protect the spaceship and occupants from harmful EM radiation and ions. Although the coils are very large they assume many of the properties of compact coils such as the need to increase specific power and power density to allow a launch into and then use in space as well as long term robustness without failure. Hence all appropriate embodiments apply to this larger system.

Component Based Superconducting Device

FIG. 20 to FIG. 21 show modular and component-based SC personal, portable devices. FIG. 20 shows 1101 housing and 1104 and 1106 power supply, cryogenic, and control primary components connected by 1103 cryogen cable and 1105 power and data cables into 1102 cryogen bayonet connector. FIG. 20 further shows some of the primary coil and electromagnetic plates such as 1108 end annulus plate, 1112 RF coils as a phased array, 1109 gradient coil example, 1111 RF antenna. FIG. 20A shows 1230 housing and 1254 and 1258 power supply, cryogenic, and control primary components connected by 1246 cryogen cable and 1250 power and data cables into 1246 cryogen bayonet connector. FIG. 21 shows 1159 housing and 1155 and 1157 power supply, cryogenic, and control primary components connected by 1154 cryogen cable and 1156 power and data cables into 1153 cryogen bayonet connector. Allowing multiple separate components to make up the SC system provides the benefit of readily swappable elements such as the magnet set and cryostat, the cryogen system, the power supplies, and the data capture and computer elements. Common embodiments of a compact MRI, for example, include sizing for a particular vehicle insertion or down to personnel portable weight and size levels, supply chair elements, as well as field swappable and stockable systems. Such an embodiment can replace the magnet set in an existing medical MRI for extremities device that is not considered portable nor field operable and then this same component swappable magnet set can be used in a fully compact, portable MRI for extremities possessing the capabilities of being personnel portable and field operable.

FIG. 22 shows a half or fully HTS and hence half or fully cryogen cold of an electric machine (motor/generator), depending upon armature winding choice and means of cryogen cooling such as conductive cooling or a partial bath cool where here any stator cryostat on the rotor side is currently not shown. For simplicity of drawings, many cryogenic, armature core, etc. elements are removed or simplified. FIG. 22 shows 1180 housing, 1182 field coil placed on the rotor, and 1185 armature coils placed on the stator primary components where 1185 can be built and assembled as a connected armature coil group 1191 to limit splice needs. Trapped field magnets (TFM) or permanent magnets 1190 are placed in the field coils in groups with surrounding field coils 1188. The magnetic field focusing cover 1189 provides a transient electromagnetic (EM) shield option for all field TFMs and coils. The entire field pole 1187, even if fully HTS, can be built separately and assembled as a unit into the electric machine including the option for superconducting TFM activation outside of the machine. This case of a totally cold, cryogenic, motor or generator is possible through a non-thermal conducting hollow shaft 1186, further indicated with a non-metal section 1183, with a rotating cryogenic coupling with embedded slip ring-based power and data cables.

Field Operable Superconducting Device

FIG. 20 to FIG. 22 show field operable SC personal, portable devices. Only a couple out of the many possible devices are detailed as embodiments here.

Medical MRI field operation includes any operation beyond the classical multiple decades use of an MRI only in a highly controlled environment. Embodiments throughout hospitals and medical centers include inpatient and outpatient room to room capability such as the Operating Room including common and hybrid real time intervention procedures include intraoperative MRI and angiography operating rooms, Emergency Room, Intensive Care Unit, patient rooms, and general mobile care. Embodiments outside of hospitals and medical centers include mobile medical providers (patients that require mobile transport such as ambulances, helicopters, etc. as well as Visiting Physicians Assoc., home care patients, sports medicine, etc.), onsite emergency to disaster relief such as US FEMA, urgent care facilities such as pharmacies to shopping plazas, rural areas (Farms, Ranches, US Indian reservations, third world countries, etc.), military (forward operating bases, mobile army surgical hospitals, medical flights, shipboard, etc.). MRI field operation embodiments can include diagnostics support away from the MRI sourced from an adjacent building or across the world. No such medical MRI field embodiments exist today in whole or in parts.

SNMR field embodiments include looking into the ground including general characterization of ground composition (including location, permeability, hydrocarbon typing, hydraulic conductivity of rocks, unsaturated and saturated zone porosity, mineralogy, pH level, and for liquids: salinity, types, and condition such as stagnant or moving), and other observations and measurements supporting construction (including subsurface characterization and safe construction site selection and planning for roads, structures, water drainage, irrigation, concrete aging, and other projects), oil and gas (including providing confidence of down well and pipeline structural integrity as well as environmental security, borehole site locating, and exploration), mining (including subsurface composition such as top surface shale, coal seams, and hydrocarbon detection as well as confidence of structural integrity and gas pockets or leak detection), environmental engineers and resource managers (including carbon sequestration of the soil and risk assessment on land reclamation, soil toxicity and remediation, hydrocarbon detection, hazardous material container leaks, etc., increased greenhouse gases and global temperature, and forests unable to process CO2 gases and increased N2O gases), military (including detecting subsurface threats including explosive devices as well as targets, permanent and fast construction needs, and construction for forward operating bases (FOB), airfields, roads, mechanized operations, buildings sites, etc.), disaster relief (including disaster site surface composition awareness including trapped air and toxic gas pockets and search and rescue operational support), utility (including utility line placement and pipeline structural integrity), archeology (including site determination and prior to a dig), and agrarian uses (including optimization use of land, water, fertilizer, energy and other resources, measuring moisture and nutrient content, hydrogen molecule types, nitrogen, carbon, etc., detecting physical and chemical nature of subsurface, depth detection levels required for most plant roots, soil erosion, and sediment transport, GMO crops, shallow roots that deplete topsoil, factory dairy farms, and unmanageable amounts of manure pollutes air and water).

Superconducting Device Data Control

A primary embodiment is to retain SC device output data such as NMR, MRI, or SNMR, which includes SMRI, scan data as shown in FIG. 20 for MRI and FIG. 21 for SNMR. This is then used in an embodiment of data retained in a database of all data across all scans for customer service use from general data retention to post processing needs such as analysis process of data tools for trends across scan types to compare to a single scan.

A primary embodiment of data retention is to establish a remote local to around the world global link between the device and user in delayed to real time.

In an MRI example the clinician is connected in real time or almost real time. This allows MRI operator remote assistance across multiple MRI emplacements at once business model. Examples include patient local urgent care commercial facilities to across world field sites including remote areas and military actions away from immediate 24/7 ready medical clinician diagnostics review and decision-making support.

In one SNMR example agricultural producers and natural resource managers provide a customer base with vital soil data needs. Grid connect multiple SNMR units are connected in parallel to capture information across a larger area at one time for operator use and decision making.

Bore that Orients to Subject Position

A particular use is the MRI and general NMR embodiments benefitting from a bore that can assume a desired orientation such as an MRI orienting to a human or veterinary patient, plant, or any structure or location of interest. A current veterinary patient use without an orienting bore is to drug an animal such as a horse to lay on a table and have their leg extend horizontally into the bore. Instead in this embodiment the bore can be oriented to allow the horse to stand in place with their leg in a natural, vertical orientation. An example of a horizontal or vertical oriented MRI or general NMR bore orientation is provided in FIG. 20.

NMR and MRI Field of View

This FoV aspect benefits MRI and general NMR embodiments of any size.

Figure 25:
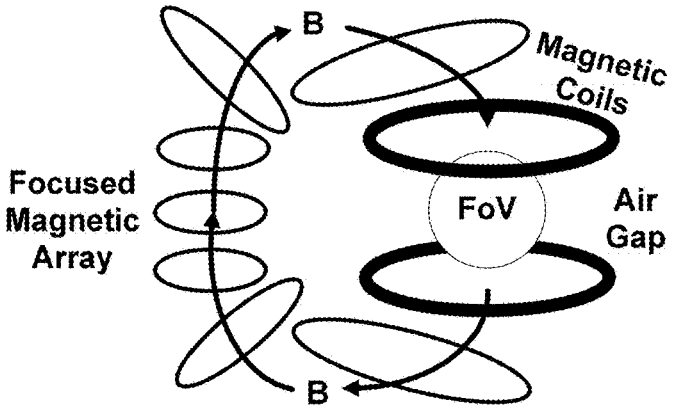
FIG. 25 shows the embodiment of a focused magnet array for focusing B around a general NMR or MRI field of view (FoV).

SC coils for this compact system require complex shapes such as null flux configurations in order to maintain magnetic confinement while still achieving a large enough high resolution FoV as shown in FIG. 20 and in FIG. 25 for a focused magnet array based FoV. This then leads to more complex cryostat, magnetic confinement, and packaging designs. LMHS allows the ability to wind coils into a 3D curved saddle with even a baseball coil end configuration to increase the source focused power transmission, echo pick up response with limited noise, and magnetic containment all required for a proper and compact device with an adequate FoV. FoV should achieve the desired tuning precision down to part of a mm to resolve 3D voxels. This coil configuration at over 1 T is expected to achieve a <0.1 ppm/hr temporal stability and a <0.5 ppm spatial uniformity in the FoV measured as volume RMS with an acceptable signal to noise ratio (SNR).

Shim coils use is lessened to potentially removed due to 3D curved main coils producing a highly homogeneous FoV, the small FoV versus coil size assisting with FoV homogeneity, and LMHS removing most main coil manufacturing errors while allowing advanced 3D coil geometries to structure a desired B.

High Penetration Depth Surface NMR and More Elements

Non-SC borehole NMR and SNMR, which includes SMRI, devices are limited in penetration depth. For example, a newly designed slim borehole NMR per USGS provides a max. 20.3 centimeter (cm) radial sensitive volume and down to a 2 millimeter (mm) low resolution gap. Present SNMR sounding devices use up to 200 m diameter EM coils for detecting ground water greater than 20 m deep but deliver greatly limited resolution and sensitivity and only detect the anisotropic isolated homonuclear spin pair of hydrogen isotopes. Present SNMR horseshoe and bar magnet types with higher resolutions, including the classic NMR-Mouse, provide 1 cm limited penetration depths. Larger non-personnel portable units limit penetration depths to 7.5 cm and a possible 15 cm is under investigation by the US Dept. of Agriculture (USDA). None of these values are high enough for the appropriate magnetic flux density (B) field to reach well into the desired soil horizon. All of these units only solve for the anisotropic hydrogen isotope.

An SNMR embodiment to achieve hydrogen detection up to and beyond a 20 cm penetration depth with an Objective Goal of 50 cm and eventually the Target Goal of 2 m penetration depth which is the USDA defined soil horizon depth is shown in FIG. 21. The resolution can be a course value and down to a fraction of a mm.

An SNMR embodiment to achieve carbon detection, which also provides nitrogen content, up to and beyond an Objective Goal of 20 cm and eventually the Target Goal of a 2 m penetration depth is shown as FIG. 21 with a slight modification. The resolution can be a course value and down to a fraction of a mm.

In particular a single sided NMR such as the SNMR embodiment of any size benefits from observation with high penetration depth and measuring more constituent elements.

Focused Magnetic Array

Similar to certain Halbach Array orientations with a spatially rotating pattern of magnetization, the magnet sources are oriented to provide opposing poles to the adjacent magnet(s) to magnetically contain the B to the desired path and limit to remove stray fields away from this path. A common embodiment is a set of magnets with possible Fe addition arranged in a curved orientation to increase the maximum B across both curved end poles across a common air gap such as a motor, generator, MRI, NMR, etc. while minimizing the stray flux.

The conventional and/or SC EM can also take the form of a distributed wind of multiple coils or the turns of a single coil that help focus the B in a desired path while limiting to negating the stray flux. One embodiment is a wound curved fan such as a part, non-closed toroidal orientation. The curved coil in this case will have embodiments of continuous else varying cross sections. The final EM part of the array can be separate magnets spliced together or a single magnet wound from a continuous linear media(s).

Some embodiments will even mostly complete an entire magnetic flux path almost completely turning upon itself much like a commonly known magnetic keeper of Fe material. An example of this embodiment will be a focused magnetic array to orient an NMR and/or MRI B path to both sides of the air gap Field of View (FoV) as shown in FIG. 25. An SNMR embodiment will also use this array to focus the B into the desired path and limit stray flux.

Some embodiments will involve magnets and/or permeable material within close proximity but B path separated due to direct current(s) and/or transient values such as alternating current(s) and/or pulsed current(s). In these embodiments transient conductive shielding effects can be minimized to negated via techniques discussed in the, "Geometric and Operationally Tunable Coils," claim.

In one embodiment of materials all EM, particularly SC, coils are air core types else limited permeable material such as Fe inclusion to set a normal B path at key locations. Fe core magnets focus B with orthogonal vectors leaving the Fe which allows a higher local sensor resolution via this higher B but it also turns the B vector back to the source earlier than an air core which limits penetration depth beyond the permeable material or B source into another permeable material and/or opposite pole B source. In EM wound embodiments the separate windings can be wound in the same or opposite direction for separate or continuous, no splice, wound media depending on the desired B path orientation and response.

In EM wound embodiments the separate windings can be wound in the same or opposite direction for separate or continuous, no splice, wound media depending on the desired B path orientation and response.

Geometric and Operationally Tunable Coils

In one embodiment for the operational aspect of tunable antenna and RF coils, even though only a few gauss is required at 50 cm for the DC field and tip angle, a very large field is required at the source and high RF probe sensitivity to monitor the spin echoes. In order to optimize the embodiment for this range while attenuating noise, the main and RF coils will both have the ability to change the B magnitude for the penetration depth of interest. The RF coil operational frequency and bandwidth are also controllable to tune for an appropriate Larmor frequency depth. Multiple RF coils will also be employed at once to allow frequency tuning for material type of interest and penetration depth.

In one embodiment for the operational aspect of tunable gradient coils, the gradient coils are set for angled direction pulsed field gradients and response echoes are tuned and filtered for differences between magnetic susceptibility such as in the SNMR case of rock grains, pore or free surface fluids, etc. Performing conventional frequency/phase encoding imaging require pulsed field gradients that will be far from linear and orthogonal due to the geometry of the coils, and further distorted by magnetic susceptibility variations in the soil.

The requirement for orthogonal gradient coil magnets with respect to the other coil magnets severely limits depth of an SNMR. In one embodiment this is solved by groups of high-power gradient coils oriented at certain angles such as 15 to 75 degrees with respect to the ground and pointed towards the center main coil axis to allow a deeper penetration depth as a combined solution with the, "Focused Magnetic Array," claim listed elsewhere. In one embodiment by focusing four evenly paired gradient coil groups (in the x and y axes) at a single measurement point at the chosen depth (in the z axis into the ground) the gradient coil magnets will work to achieve a maximum orthogonal B to the main coil B at the depth of interest. To better assist this system, the gradient coils could be set to allow a variable angle with respect to the ground and hence via physical positioning tune the orthogonal component of the gradient B to the main coil B for the depth of interest.

In an SNMR embodiment as shown in FIG. 21 the single sided main magnet already produces a gradient, which can be used to select a slice as a sensitive volume but this invention is pushing a deep penetration depth. Therefore, the addition of Gradient Coils, as similarly used in an MRI, assist with achieving a higher resolution, the necessary response at high penetration depths, and support the tomography option.

In one embodiment of operational tuning the data processing with verified simulation comparison will be used to resolve the measurement including removal of data that is identified as not being part of an orthogonal magnetics reading. Although the outcome is not the ideal orthogonal gradient B direction with respect to the main coil B, due to high power SCs this system should still allow enough of a pulse to capture good data at desired penetration depth. Geometrically the gradient coils assume an approximated equilateral triangle or equivalent geometry to focus the center magnetics and allow simulation comparison with more ease. A concern with this method as well as with the, "Focused Magnetic Array," claim is how the gradient coils induce an emf in all coils below which provides a gradient B shielding and added current density into the other coils. Due to the transient time of the gradient field, the coil relative geometries, the ability to cancel induced mutual effects via twisting or transposition techniques of the individual coil linear media in the media itself or linear media to linear media or of the entire coil at once, or by shielding all other coils from the gradient coils, this is currently not considered a concern. If this become a concern, then another embodiment is to reduce the gradient B overlapping the other coils via changing the gradient coil geometry and/or moving the gradient coils further away from the main coil center axis.

To increase response resolution, one embodiment has the coils work in groups to achieve a transmit bandwidth signal and probe response around the specific Larmor frequency sensitive volume of interest. Larger area RF coils achieve both an even pulse response and higher echo sensitivity for longer penetration depths. The RF probes are dual set phased array surface coils combined to produce a circularly polarized field with an optimal response in the region directly below the coils where the magnetic flux lines from each 90-degree coil set are roughly perpendicular.

One embodiment of the RF transmit coil starts as a simple round diameter with larger diameters providing higher penetration depth. Further RF transmit coil embodiments include symmetric configurations include dual, quadrature, etc. and will be properly connected electrically providing noise cancellation and power boosting from source to echo response modes. Since symmetric RF coil configurations are highly geometrically dependent between the region of interest and coils themselves, a 2× larger than shown RF array is another embodiment consideration. A distributed to multi-turn transmission line EM resonator (TEM to MTLR) is also an embodiment due to the increased efficiency at high frequency due to lowered radiation loss. To increase TEM sensitivity in a short axial length, shunt capacitors are an embodiment with decoupled TEM coils which increase SNR and improve homogeneity.

In particular a single sided NMR such as the SNMR embodiment of any size benefits from geometric and operationally tunable coils.

Electromagnetic (EM) Containment

In the embodiment of an NMR or MRI operating concern is the static to high frequency magnetics involved. Since all equipment to even the entire room housing an MRI must be magnetically shielded, any use of an MRI requires all metal instruments accounted for and secured down to the level of counting each needle, guide wires, neuromuscular monitoring devices, etc. Cell phones, electronic tablets, pagers calculators, computers, watches, etc. are necessarily turned off to eliminate RF noise and interference around an MRI. Due to the enclosed nature of the compact system embodiments most to all of the EM radiation is not only shielded but for the first time for a medical MRI embodiment mostly contained.

Even with bore active shielding loops the largest EM loss occurs at the bore openings for an NMR or MRI or at the axis for a rotary motor or generator which is worse for transient EM. Conversely a conducting end embodiment acts as a magnetic mirror and up to the skin depth effectively doubles the electric length which significantly improves homogeneity.

As in for a Medical MRI embodiment example, at both bores an embodiment of removable passive and/or active EM shields in FIG. 20 with 1111 End Plate and 1108 End Annulus as shown provide mechanical closure mechanisms provide magnetic mirror response for SC device ends by extending the 1101 and 1107 magnetic containment for 1109, 1110, 1112, etc. coil sets. The End Plate approximately doubles the RF response and is used for far end bore closure when observing sections such as end of limbs such as hands and feet in an MRI embodiment. The End Annulus wraps loosely or tight around the subject and is for all thru limb locations and provides greater RF response and associated EM shielding at the included end. In another embodiment permeable, such as Fe, shields back up all EM end shields to contain B0. Also, in an embodiment a combined EM and Fe shield in an End Annulus shuttered closure mechanism to close down to the patient's limb in the bore access along with additional external Fe and EM shields, such as a shielded shell or blanket, can be added to a medical MRI to limit fringe fields for signal to noise ratio and the 5-gauss human health safety region.

A further embodiment includes a cryostat comprised of a conductive wall acting as an EM shield on all surfaces excluding the bore facing surfaces such as NMR and MRI embodiments. The dewar EM shield will enclose the coils excluding the bore openings and act as a Faraday box protecting external SC device areas from EM transients while also providing a minor waveguide for the RF source and echo response EM power direction needs. In one embodiment aluminum is a strong yet lighter mass material to trade between Faraday box needs while not introducing a high percent of source power loss from RF coil transient induced currents. All aluminum or equivalent conductive material on the cryogen side of the cryostat vacuum will achieve a much higher skin depth for EM shielding at LN2 temperatures than at room temperature which greatly helps contain EM transients. Separating the cryostat into EM shielded zones to further lower the source power loss will be another embodiment starting with the RF coils. In another embodiment a thin Fe shield is placed outside the main coil and possibly as the cryostat outside wall to retain static fields (B0) while staying within portability weight limits.

In certain embodiments such as an SNMR the cryostat dewar as shown in FIG. 21 as 1159 will comprise a conductive top and non-conductive base that faces the ground. The top will enclose the HTS coils all the way to the ground and act, either directly or with a conductive insert, as an above ground Faraday box both shielding external EM noise from above while providing a minor waveguide for RF source and echo responses.

Magnetic sources and surrounding material will be arranged to establish a wave guide means of directing radiation noise into a magnetic trap away from an NMR or MRI Field of View (FoV) or equivalent magnetic noise lessening region or conversely guide magnetics to a desired location of interest. Such guidance is separated into magnetic frequency regions of interest.

In particular the MRI and general NMR embodiments of any size benefit from EM containment.

Acoustic Containment

Due to the enclosed nature of a compact SC system most to all the acoustic noise is not only shielded but mostly contained. As embodiment examples the compact MRI has closed magnetic bores and is far smaller than a full body MRI. Further the end plate and annulus bore closure mechanisms, such the embodiment shown in FIG. 20 with 1108, will be incorporated to wrap around subject further contain the acoustic noise.

Electromagnetic (EM) Material Containment Cooling

In one embodiment the cooling path will allow the option of removing the EM induced heat such as EM transient or any sourced heat into the cryogenic cooling area such as potentially liquid nitrogen based. These shields will include cooling for all heat induced, especially transient EM, into the cryogenic system. For a compact NMR or MRI embodiment will include the annulus bore closure mechanisms, such the embodiment shown in FIG. 20 with 1108, which will involve cooling spikes for all EM shielding needs. Furthermore, any cooling of an EM conductor further increases the EM shielding efficiency of that EM conductor which assists with EM shielding.

In particular the MRI and general NMR embodiments of any size benefit from EM containment cooling.

Cool Down Method and Plenum Design

At the start of the cryogen cool down process, the liquid nitrogen (LN2) plenum is used to push gaseous nitrogen to evacuate air in the warm cryostat prior to LN2. This is performed via an automated, passive external diversion system which allows a single LN2 source to remove all air prior to cool down which removes icing concerns. This method works with any cryo cooling method such as conductive or bath. This method is particularly important for compact devices embodiments and in particular when operating in remote areas where access to a full facility is not possible.

Compact NMR Coils

In an MRI embodiment shim coils remove small wound coil magnetic moment inhomogeneities. These coil manufacturing errors arise from machine errors such as locating coil troughs, wire distribution during winding, contraction of the system when cooled to cryogen temperatures, magnetic force induced wire shifting, surrounding structure magnet impurities, and mechanical stress during transport. For this claim shim coils use is lessened to potentially removed due to 3D curved main coils producing a highly homogeneous Field of View (FoV), the small FoV versus coil size assisting with FoV homogeneity, and LMHS removing most main coil manufacturing errors while allowing advanced 3D coil geometries to structure a desired B as shown in FIG. 20.

Magprop and Maglev

This embodiment allows a large B in the air gap which in turn allows a higher power system including a higher speed and torque propulsion system as well as a higher energy levitation system for the combined use of maglev and magprop. One embodiment is an SC based linear motor for vehicle launch purposes such as aeronautical and aerospace. Another embodiment is an advanced SC such as HTS based superconducting maglev and/or magprop including commercial train speeds to high-speed vehicles beyond commercial train limits including Mach 1 or greater test sleds.

Hybrid Superconducting Magnetics

Embodiments of these hybrid magnetics include conventional magnetics to a hybrid motor, generator, NMR, and MRI. In the motor and generator embodiments, SC to complete SC armature, exciter field coil, and AC induction machine passive conductor. NMR including SNMR, MRI, FCL, etc. embodiments include any magnet in the device. Such embodiments of various magnetics options, in particular combining SC wound and TFM, allow not only a proper magnetic solution for a given task but in particular allow for a very compact machine.

A key embodiment for any SC device is a wound SC such as a magnetic coil wound around a single or group of TFM magnets and used to both activate and then modify the field of a TFM. As a further embodiment these combined SC type poles can be created as separate units to include into the machine for ease of assembly as well as activation of the TFM outside of the SC device or in place in part or whole in the final SC device. This embodiment also allows line replaceable unit (LRU) solution.

In a motor and/or generator embodiment any magnetic type including SC combination units are held down via epoxy and/or mechanical bolts and/or dovetails and/or banding/retaining rings which increases stray losses through a larger air gap and then a different banding option is often employed such as for high-speed machines.

Historically SC bulk and wire materials are used separately across applications. The combined benefits of both are not utilized in a single unit to date.

In one embodiment a system for combining SC wire and trapped field bulk material is presented. This combination provides the ability to capture the greatest benefits of both SC formats at a common cryogenic state. Benefits include magnetic field forming to bulk material activation.

This invention relates to methods of generating high magnetic fields from SC material for the purposes of TFM activation, high B augmentation control, and high B fields in a desired output form.

1. Superconducting (SC) wire coil and SC trapped field magnet (TFM) bulk materials are used in combination to supplement one another's SC magnetic field.
   a. The TFM can be positioned at the magnetic lower or higher points of an SC coil for enhancing or augmenting DC, AC, or pulsed field generated.
   b. TFMs places in the typical void between the SC coil sides and using both SC types in operation allows for a much higher B capability than using either a TFM or SC coil separately.
2. SC wire coil is used to augment the TFM magnetic field
   a. Readily change the magnetic flux density, B, on the SC wire with a varying static DC field change or even an AC to transient depending on the output B desired.
   b. Augmented field machines provide a wonderful machine control technique. Augmenting a uniquely high B is currently unheard of in practice.
3. Use SC wire coil to provide a high TFM material ACTIVATION energy.
   a. TFMs require high activation energies to acquire a high B. Such activation is extremely difficult to achieve. Difficulties arise from the ability to get a high B to the TFM due to reasons such as inductance path to magnetic stray and conductive shields when trying to activate external to the SC cryostat. By placing the SC wire inside of the same cryostat with the TFM bulk then one can make use of not only the high B capability of the SC wire coil but also the close proximity of the SC wire generated B to the TFM activated captured B.
   b. Utilizing an SC wire, unlike conventional a conventional conductor such as copper, the SC wire can handle an extreme current for a short period of time when devoid of pinning centers and typically generates orders of magnitudes less thermal energy than a pure conductor. Minimizing heat generation is extremely beneficial for any SC coil.
   c. The wire is automatically located inside of the cryostat whether around the entire SC bulk pack or next to individual TFMs. In the individual TFM case the coil may be located physically around the TFM or on top of the TFM center. In this case multiple SC coils may be connected in series and/or in parallel to achieve activation.
   d. Once the TFMs are activated, or when using an SC DC magnet without TFMs, the SC DC magnet can set for a steady state mode, such as a motor or generator exciter field or NMR or MRI field magnet, will theoretically never lose the DC steady state charge with the only SC loss occurring from any mostly negligible splice resistance.
4. Use SC wire coil to provide a high TFM material DEACTIVATION energy.

The same coil case of this invention may be used to also deactivate the TFM bulk materials. In this case the SC coil is purposely placed into a quench situation through means such as but not limited to forcing the SC coil(s) to quench through the external power supply or as sudden opening of a potential persistent switch for reasons such as inducing a localized heating zone.

An SC wire is able to be formed in many shapes from pure solenoids to saddle coils, yet this form always has magnetic field distributions such as high B points at the coil turns due the multiple coil legs interacting strongly in that region. A TFM is a small entity that provides a magnetically flux dense field up to the TFM saturation levels in the center areas of the TFM itself where the B distribution approximates an ice cream cone shape. This combination allows one to use the B distributions inherent to both material forms to best create a desired output field from a uniform B with a possible smoothed entering and exit pole region entering a machine air gap to lower the non-fundamental harmonic content. Such affects assist machine design to a dipole or quadrupole particle accelerator magnet where a very high but uniform B is crucial. As for a machine case the placement of TFMs into the typical void between the SC coil sides and using both the SC Coil and TFMs in parallel while in operation allows for a higher output B than either the independent SC Coil or TFM. This allows a much higher power dense machine than either an SC Coil or TFM alone.

Activation and deactivation of a TFM is of extreme importance yet to date not a solved problem for a large machine. Activation techniques are complex and work on controlled B and cryogenic temperatures which may even involve controlled cryogenic pressures. To use the fact that both SC wires and SC TFM bulks must exist within an SC critical state that includes cryogenics, then one is able to readily make use of placing both SCs into the same cryostat. Using this SC coil for activation has the extreme benefit of not forcing a B pulse through a conductive cryostat wall and other supporting material as well as the SC wire generates orders of magnitudes less heat than using a typical conductor for activation. To add, by placing the TFM activation and deactivation as close to the TFM as possible, then less overall energy is required for either TFM activation or deactivation.

Figure 26:
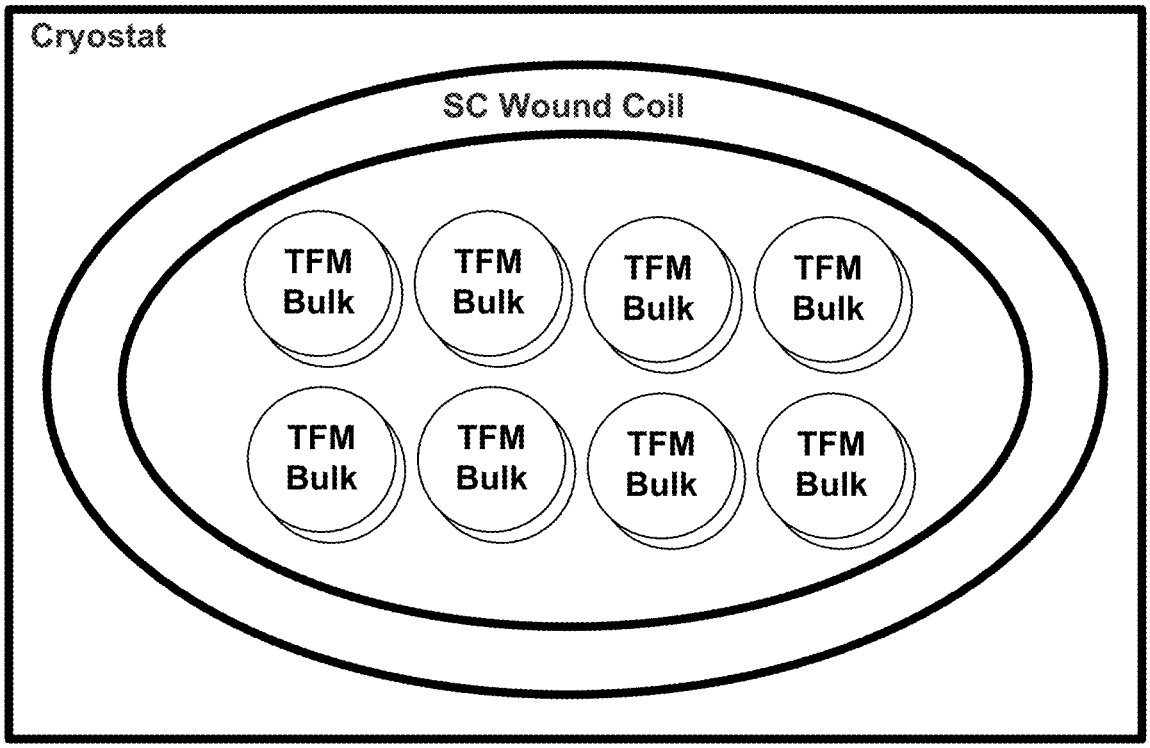
FIG. 26 shows the embodiment of an SC wound magnet around a grouping of SC bulk trapped field magnets (TFM).
Figure 27:
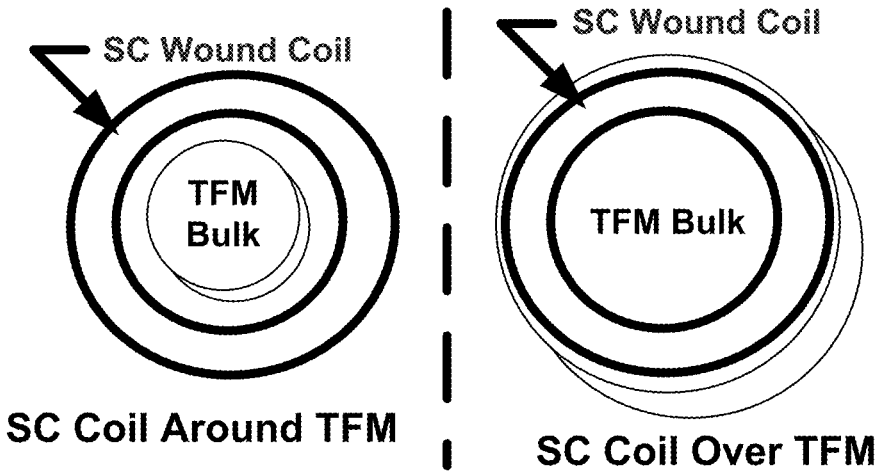
FIG. 27 shows the embodiment of an SC wound magnet around and on top of a single SC bulk trapped field magnets (TFM).
Figure 28:
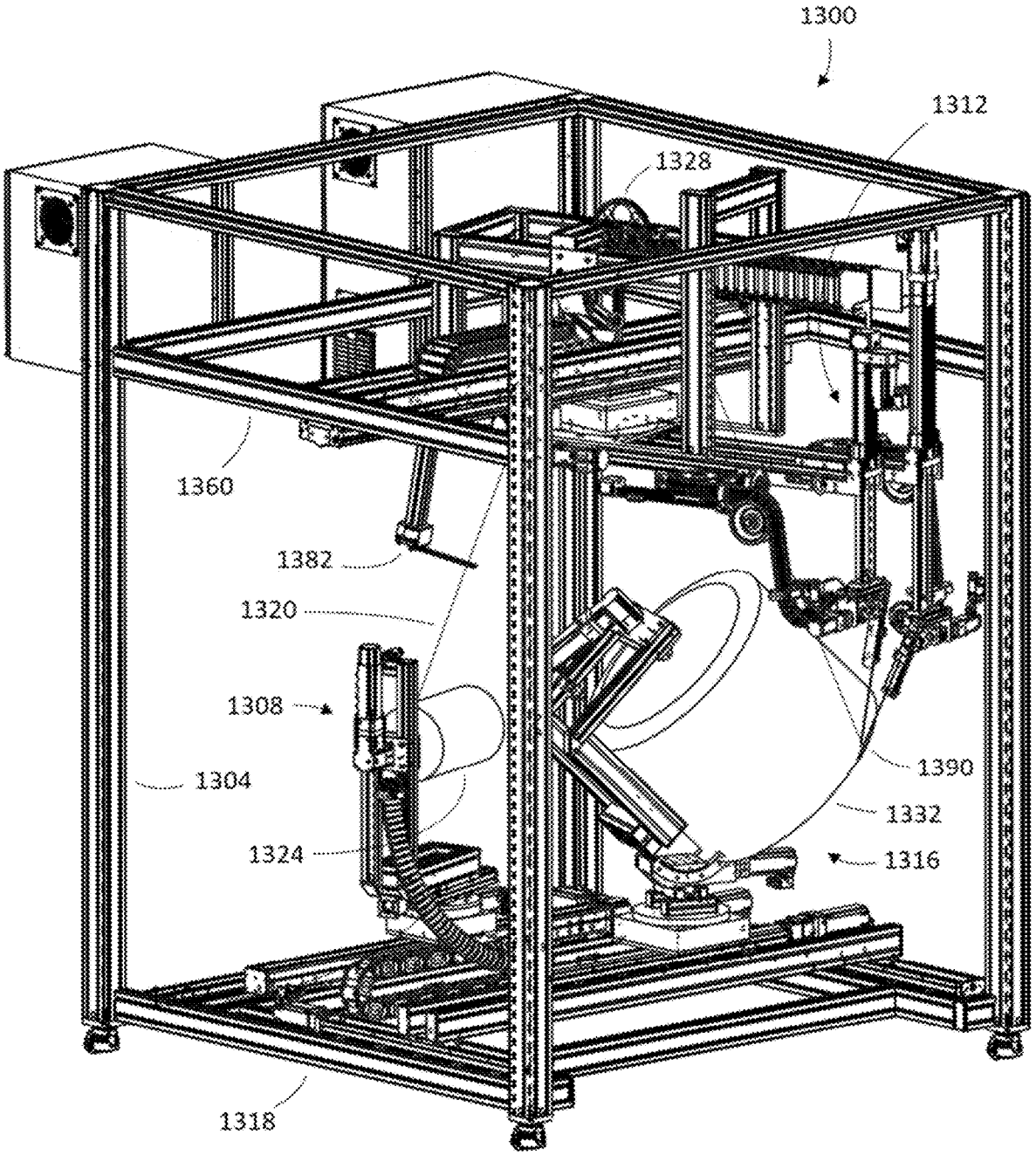
FIG. 28 is a perspective view of a winding machine of yet another embodiment of the present invention.
Figure 29:
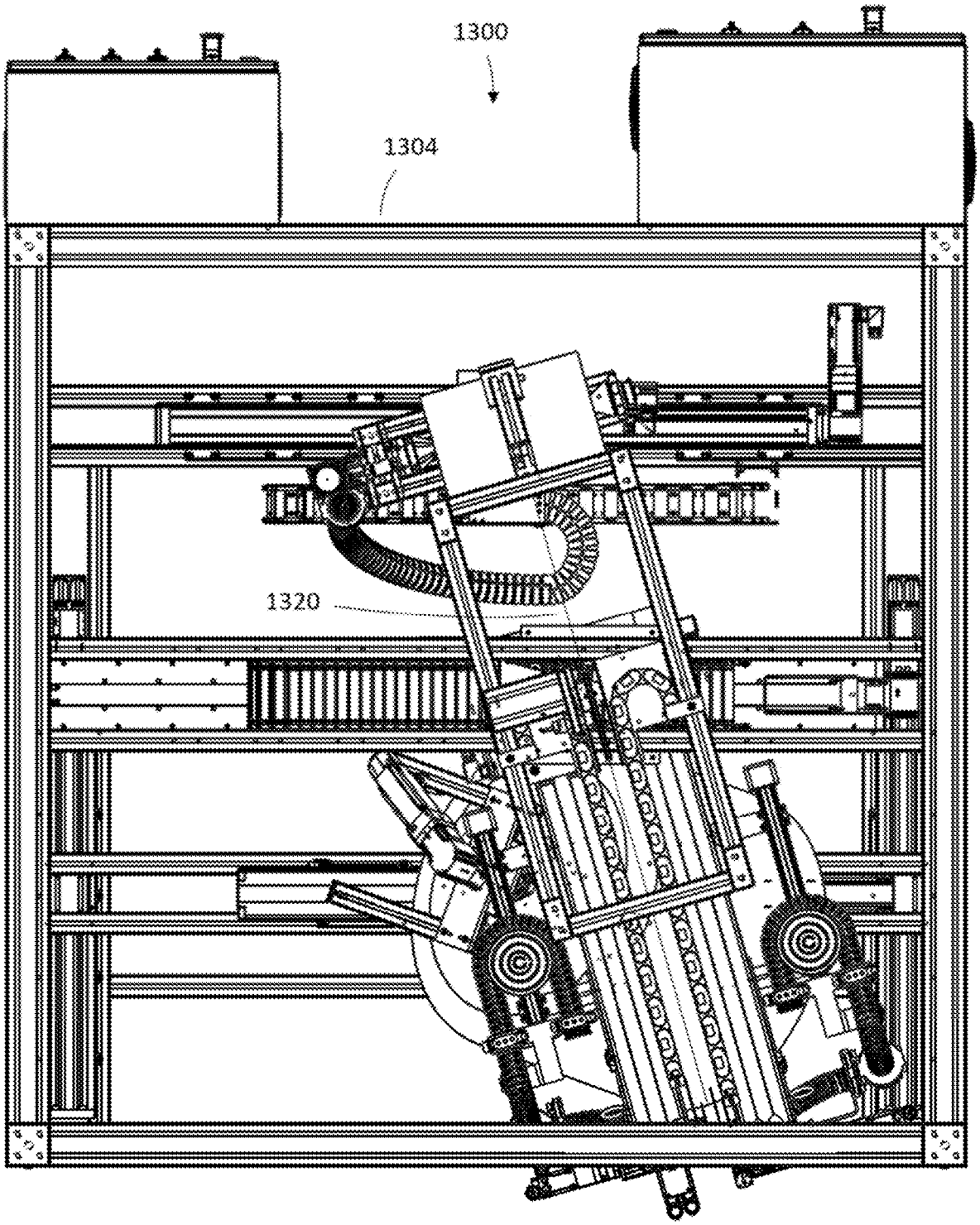
FIG. 29 is a top plan view of the winding machine shown in FIG. 28.

An example of a TFM bundle with a single SC Wound Coil around the stack is provided in FIG. 26 and FIG. 22 where the removable field pole 1187, for general purposes and TFM activation, has coil 1188 wrapping around the TFM stack 1190 and magnetic field focusing cover 1189. An example of a single TFM with a dedicated and single SC Wound Coil per TFM whether around the outside of the TFM or centered on the TFM physical center is provided in FIG. 27. In this second example the dedicated TFM coils are connected in either a parallel and/or series connection to an outside power supply. In either SC coil and TFM case the SC coil and TFM materials are likely in the same cryostat but not necessarily since there are advantages to also separate the SC bulk and SC wire coils for reasons such as making use of magnetic dampers. In either SC coil and TFM case a SC persistent switch may or may not be used.

This invention applies to devices of any size. This invention applies to both low and high temperature SC wire and bulk materials. This invention applies to all sorts of machines including but not limited to rotary and linear motors and generators.

Combined Superconducting Magnetics and Speed

Such embodiments not only support the magnetic solution for a given task but in particular allow for a very compact machine.

In particular motor and generator machine embodiments of any size and use benefit from increasing the speed of the magnetics in the device which benefit from the magnetic prime mover power system approach as discussed elsewhere. A particular embodiment is hybrid to all electric aircraft motors and generators and generally represented in FIG. 22 for a generator for this use and in particular a high-speed generator embodiment operating around 16,000 to 30,000 rpm or higher and motor embodiment operating around 3000 to 10,000 rpm or higher. The magnetic air gap is typically 1 Tesla (T) and above and in particular 2 T and above.

In any mechanical high mechanical speed electromagnetic machine, particularly a motor and/or generator type machine, increased rotational speed also means increased AC losses and decreased efficiency. A fully cryogen cold SC motor and/or generator machine would be ideal for general to especially aircraft use, but the HTS rectangular profile leads to a high frequency transient based loss, such as AC and pulsed power reactance, problem in HTS armature coils. Before LMHS there was no known means of lowering the magnetic effects of HTS. In the HTS case, the large tape width allows more induced currents for any magnetic flux orthogonal to the width direction which is a large problem for non-DC operation such as the armature coils of a motor and/or generator. In a conventional Cu based machine, Litz or Roebel stranding is often used to reduce the induced magnetic loss effects, but this is not possible with fragile and wide flat to thin thickness ratio profile HTS. Therefore, HTS AC losses are removed by LMHS fully transposing and/or braiding the HTS negate the AC loss effect before, as in a subcable, and/or during the magnet and cable magnet direct winding. To further reduce transient losses, the final subcable will desire as thin of an HTS width as possible, within operational performance, and the final magnet winding should orient the HTS subcable, whether in the armature or field coils, so that the magnetic flux is in-line with the thinnest part of the HTS. The thin HTS and increased packing factor also allow the higher number of amp-turns in a higher power dense magnet. Such HTS magnet arrangements apply to all types of magnets experiencing high electrical frequencies which will produce high transience reactive losses without some form of HTS twisting.

Superconducting Magnetic Prime Mover Power System Approach

The power system approach to magnetic coils, employed by the power transmission and distribution industry to achieve maximum power transfer, focuses on maximizing the J even at the expense of magnetic coil B in the SC. It is true that B is proportional to current (I) and number of turns (N) and hence dominant on the isolated generator scale but is not always dominant from a larger, system perspective as in this case. Maximizing the emf or generated voltage (V) as in FIG. 22 is achieved by maximizing the number of turns (N) per Faraday's Law and accordingly a greater primary to secondary magnetic coupling since inductance increases by the square of the N. For an SC or non-SC cryogen cooled to approximate this effect I developed has no resistance (R) dissipative energy component, which is the largest loss of a conventional machine, and negligible stray losses. Therefore, this low loss I developed increases the total power generated and is only limited by B and SC critical values which are traded between series and parallel winding sets per phase. Since a common renewable system machine speed such as a wind turbine is relatively slow, the inductance time lag will still allow a maximum air gap power transfer. Since R and associated thermal loading is not a concern in an SC, increasing N is again limited only by the B, J, and T critical SC operational values. Therefore, this motor, generator, etc. power focus provides a more efficient direct power transfer from the machine primary to secondary through an increased inductance with no conductive thermal losses. This helps this embodiment overcome the common machine issues of not operating efficiently at light loads or small power sizes. Thermally this embodiment does not have the heat removal problems of a small machine as well. Operationally, whether running in continuous or intermittent operation, the machine is based on generated V which develops instantaneously compared to the high inductive time lag of I.

In particular motor and generator machine embodiments of any size and use benefit from the magnetic prime mover power system approach.

Removal of Gearbox for Superconducting Power Train

Gearboxes are the largest failure and preventative maintenance concern in many industries including renewable wind generators. A common desired example is an HTS operating at HTS down to LTS temperatures. Embodiments for a compact machine with limited space makes great use of removing the gearbox due to the SC device such as FIG. 22 with very high torques via both higher current (I) and B.

In particular motor and generator machine embodiments of any size and use benefit from the removal of a gearbox.

Removal of Converter for Superconducting Power Train

In one utility scale embodiment many common renewable sized generators in the megawatt (MW) scale produce voltages on the lower levels of 600V to 4280V whereas the medium voltage level of around 13.8 kV is required for the 13.6 kV utility scale distribution line prior to the 138 kV to 500 kV or greater utility transmission line V step up. Generator and motor manufacturers see this greater V output and input system efficiency benefit and work on 13.8 kV conventional generators which often end up being very large diameter machines where a 2 MW, 13.8 kV generator may be 3.5 meters (m) diameter between the air gaps, over 2 m magnetic axial length, and accordingly massive. In a properly designed SC machine, simply maximizing N and hence higher V up to the critical I and B, directly allows this desired medium V and I output without the prohibitive weight, volume, and associated material cost penalties. This is due to not only the high V output magnitude but also the direct V analog output compared to solid state converter V chopping and steps.

Converters are excellent tools but incur losses. Commonly used machine converters are a combined rectifier and inverter with central stability capacitor, which often rely on Insulated-Gate Bipolar Transistor (IGBT) or Insulated Gate-Commutated Thyristor (IGCT) technologies that are limited to only 1.2 kV to 2.5 kV ranges often in a multistep H-Bridge configuration where the steps are applied in both the positive and negative voltage directions which only increases the losses. Pulse Width Modulation (PWM) technology, an excellent system, is still limited in power to the element V maximums, R losses across all converter elements, and maximum carrier frequency limitations of duty cycle which trades harmonics and hence efficiency for higher power transfer capability. The converter is not only a direct power losing element itself, but the PWM scheme also reflects power waves in the form of voltage spikes back on the motor and/or generator itself which creates transient losses in the conductors and worse still iron (Fe) hysteresis losses. Finally, any filtering and directly connected power transmission elements on either side of the converter will have R losses also due to the converter voltage spikes from the PWM operation. Therefore, removing the high voltage and power converter from a well-tuned, stable filter removes losses across the entire system as per another embodiment. As carrier switching frequencies come to operate in the 50 KHz and greater ranges for a high-power converter then losses are minimized, but those high-power conversion days are still further into the future. A constant generator shaft rotational speed mechanism such as a fluid speed controller or equivalent removes the need for a converter, but these items lower efficiency levels and are best suited for the lower MW range geared systems which removes many advanced SC machine such as FIG. 22 benefits. The final intent of one embodiment described here is therefore to allow maximum energy capture at a high V output across intermittent shaft rotations without a converter or other efficiency lowering device. This is then provided to a large V isolation capacitor bank with a single direction power flow configuration which then directly feeds the next level of V step up into or step down out of the transmission lines.

FIGS. 28-32 show a magnet winding machine 1300 of another embodiment of the present invention capable of at least 20 degrees of freedom. The winding machine 1300 consists of a frame 1304 that supports a wind-off subassembly 1308, a follower subassembly 1312, and a wind-on subassembly 1316. The wind-off subassembly 1308 and wind-on subassembly 1316 are interconnected to the frame's base 1318. In operation, linear media 1320 travels from a wind-off spool 1324 to the follower subassembly 1312, where it engages with a tensiometer 1328. The linear media 1320 then travels to a wind-on spool 1332 of the wind-on subassembly 1316. As in the embodiments described above, handling of the linear media 1320 from the wind-off spool 1324 to the wind-on spool 1332 is carefully monitored by sensors and controlled by a plurality of linear and rotary actuators. The actuators, which will be described in further detail below, allow multiple solutions for a desired motion. The desired motion may be achieved by simultaneously moving more than one actuator in complementary directions, which allows for the winding machine's footprint to be reduced. Thus, a winding normally associated with a much larger machine is possible as motion density in the horizontal and vertical directions can be achieved.

Figure 30:
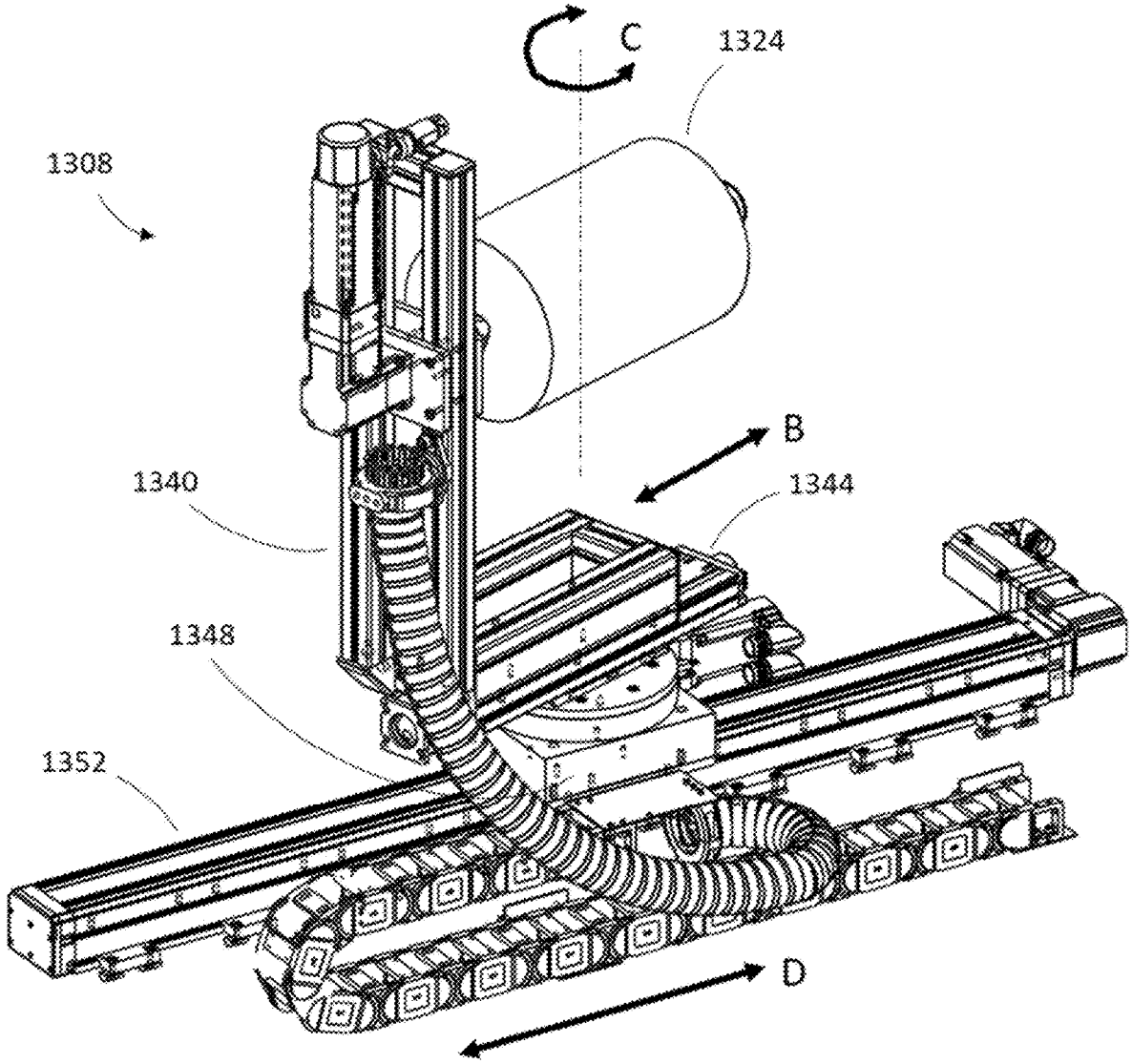
FIG. 30 is a wind-off spool subassembly of the winding machine shown in FIG. 28.

FIG. 30 shows the wind-off subassembly 1308 in detail, which comprises a frame 1340 that rotatably supports the wind-off spool 1324. In other embodiments, the wind-off spool 1324 is vertically fixed. The frame 1340 is interconnected to a linear actuator 1344 that allows movement in the direction of Arrow B. The linear actuator 1344 is interconnected to a rotary actuator 1348 that allows for the frame 1340 and interconnected wind-off spool 1324 to rotate in the direction of Arrow C. Finally, the rotary actuator 1348 is interconnected to a stationary linear actuator 1352 that allows for the frame and interconnected wind-off spool to travel in the direction of Arrow D. In some embodiments, the wind-off spool is also able to move along the wind-off frame 1340 and/or the wind-off frame 1340 can be selectively tilted to provide even more Dof. The combination of linear and rotary actuators allow for precise control of wind-off spool 1324 position, which dictates the position and orientation of the linear media's wind from point. The actuators, thus, maintain the linear media in the wind angle plane, which will be described in further detail below.

Figure 31:
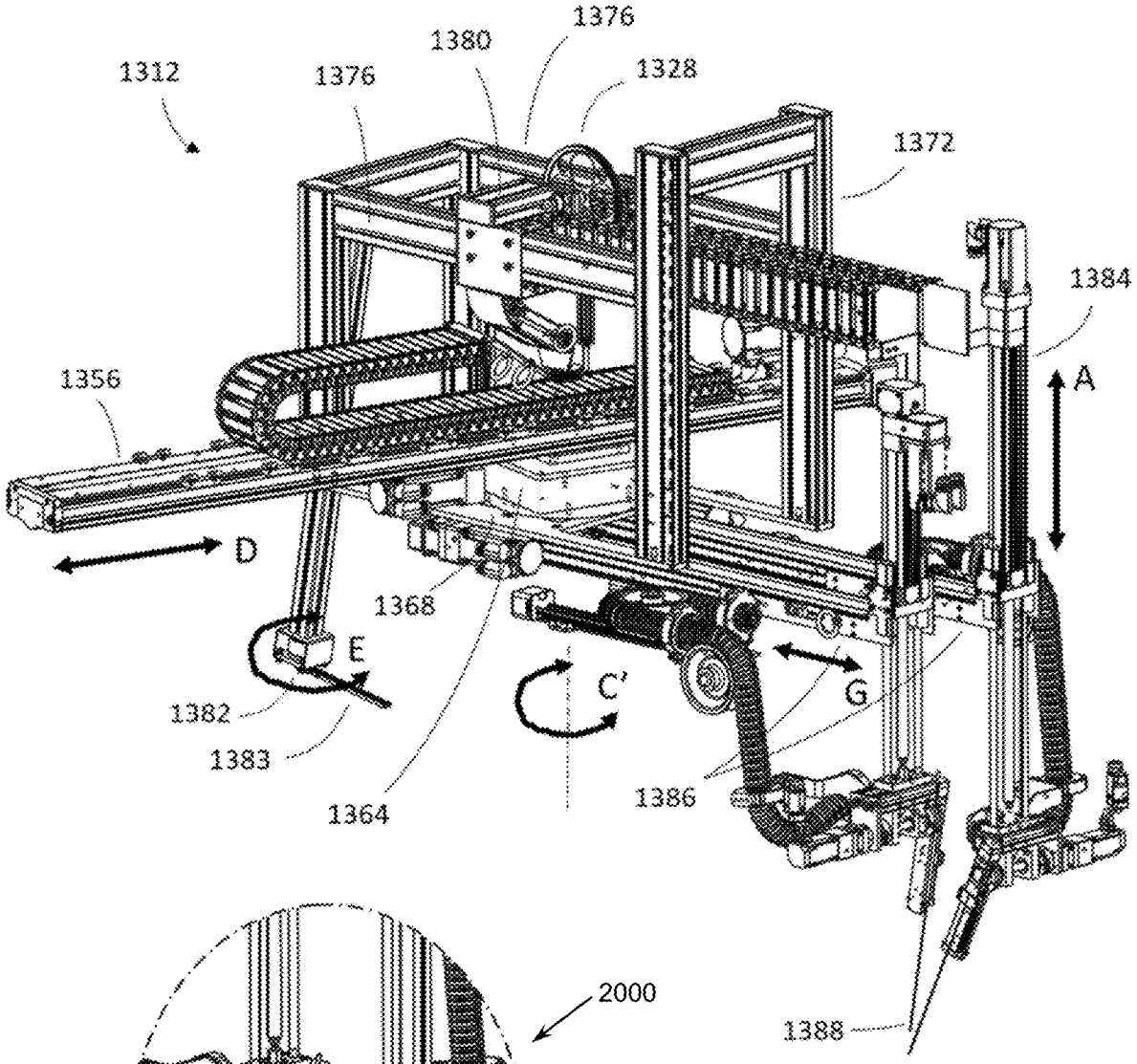
FIG. 31 is a follower subassembly of the winding machine shown in FIG. 28.

FIG. 31 shows the follower subassembly 1312 that operatively supports the tensiometer 1328. The follower subassembly 1312 employs a stationary linear actuator 1356 interconnected on its ends to crossbeams 1360 provided on the primary frame 1304 (see FIG. 28). In one embodiment, the stationary linear actuator 1356 is generally oriented parallel to the stationary linear actuator 1352 of the wind-off subassembly 1308. Thus, the stationary linear actuator 1356 provides movement of an interconnected rotary actuator 1364 also in the direction of Arrow D. Rotary actuator 1364 is interconnected via a plate 1368 to at least one riser 1372 that supports beams 1376. Thus, the beams 1376 are rotatable in the direction of Arrow C' when urged by the rotary actuator 1364. The tensiometer 1328 is also connected to at least one beam 1376 via support beam 1380. Various sensors may also be associated with the tensiometer and interconnected to the follower subassembly 1312 to ensure proper tensioning of the media and to provide the means for selective adjustment of tensiometer position. The follower subassembly 1312 supports a turning fork sensor 1382 that rotates in the direction consistent with Arrow E. The turning fork is comprised of parallel guides 1383 configured to operatively receive the linear media 1320. Input from the turning fork sensor 1382 is used to guide control of linear actuator 1344 in wind-off subassembly 1308.

The follower subassembly 1312 also supports linear actuators 1384 (which in one embodiment are electric cylinders) that impart selective movement of interconnected guide rods 1388 in the direction of Arrow A. These linear actuators 1384 are attached to linear actuators 1386 that selectively impart motion in the direction of Arrow G. Using combinations of actuators in follower subassembly 1312, the guide rods 1388 are moved to maintain a position on either side of a wind-on point 1390 shown in FIG. 28 and are designed to guide the linear media onto the wind-on spool.

Figure 31A:
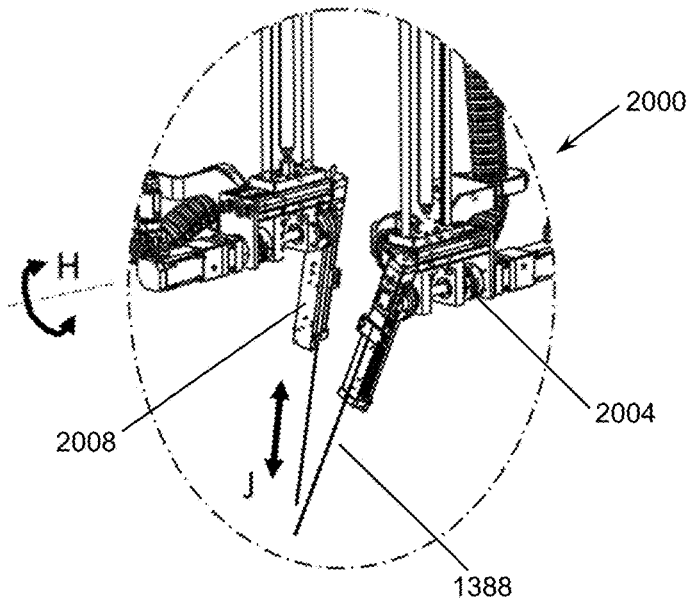
FIG. 31A is a detailed view of FIG. 31.

As highlighted in FIG. 31A, precise articulation is accomplished by a wind-on guide subassemblies 2000 that provide many degrees of freedom (DoF) that affect automated movement of the guide rod tips, which simulates human interaction and allows a wide range of control that approaches complete control of the linear media as it is taken up by the wind-on spool 1332. More specifically, the wind-on guide subassemblies 2000 are interconnected to the ends of the linear actuators 1384 and, thus, can move in the directions of Arrows A and G and rotate in the direction of Arrow C'. A guide rod rotary actuator 2004, which is configured to impart selective rotation in the direction of Arrow H, is provided. The guide rod rotary actuator 2004 is interconnected to a guide rode linear actuator 2008 that selectively articulates the guide rod 1388 in the direction of Arrow J. One of skill in the art will appreciate that linear/rotary actuators may be added/removed or employed/disabled (if present) to hold, tilt, and extend the guide rods to provide achieve the desired linear media control.

Although referred to herein as guide "rods," those of ordinary skill in the art should appreciate that these components can be formed of various shapes. In addition, some embodiments employ a single guide, while other embodiments employ two or more guides. The guides rodes 1388 may terminate in a wheel, a cone, an arcuate member, or similar device. In one embodiment, one guide contains the linear media and the other guide urges the linear media onto the wind-on spool.

Here, the tensiometer 1328 and the turning fork 1382 are located above the wind-on spool and the wind-off spool, connecting rotary motion to linear motion. By operating around the stationary linear actuator 1356, the follower subassembly 1312 minimizes vertical distance required to connect motion and sensor elements, thereby achieving high motion density in the vertical direction. motion density minimizes machine frame size and vibration amplitude, allowing the assembly to be made of lightweight aluminum extrusions instead of steel. This aspect is an important feature of one embodiment of the present invention (MMP) that supports module design of subassemblies and simplified accessory attachment.

Figure 32:
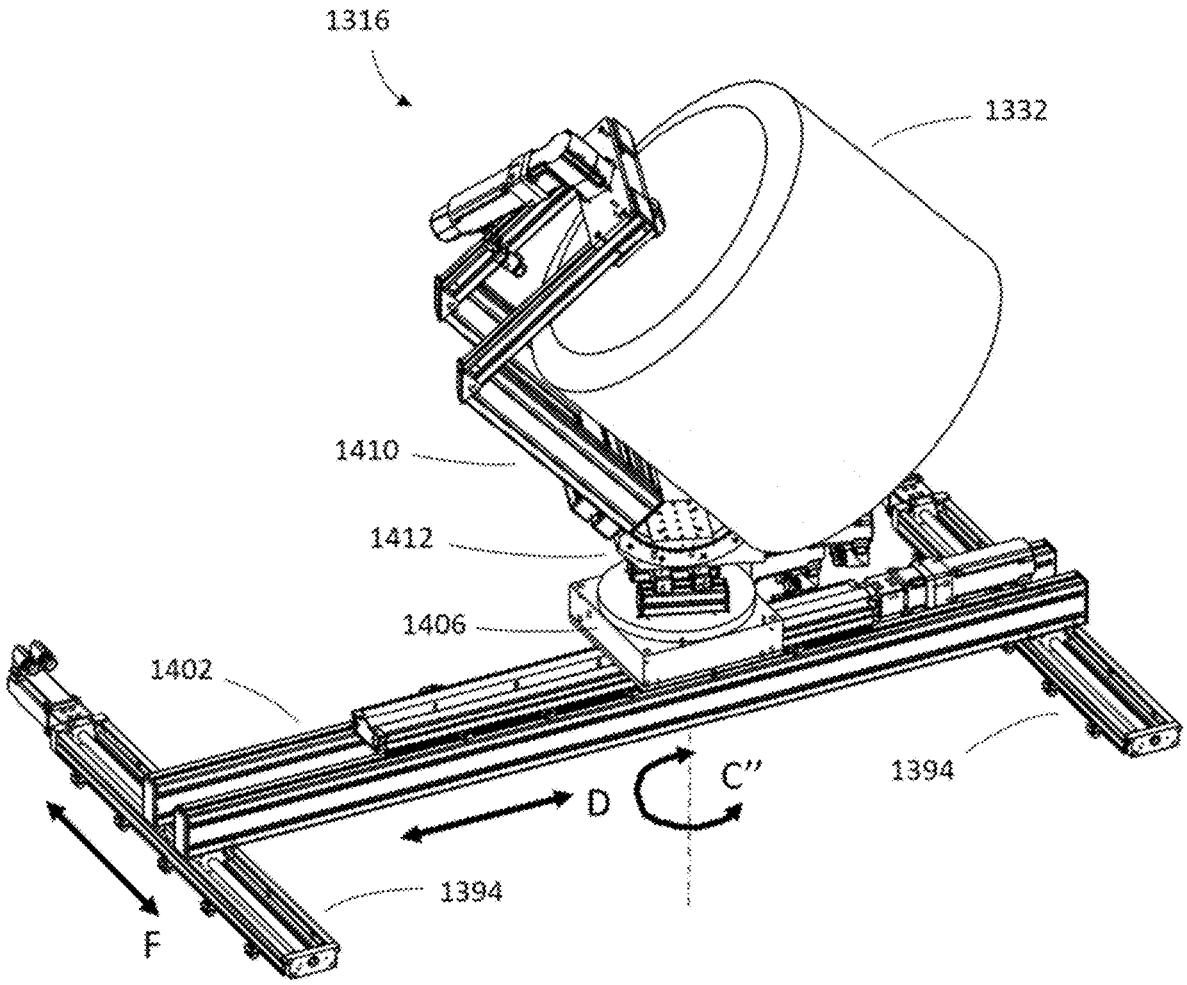
FIG. 32 is a wind-on subassembly of the winding machine shown in FIG. 28.

FIG. 32 shows the wind-on subassembly 1316 generally comprised of stationary linear actuators 1394 that interconnect to the frame base and that support another linear actuator 1402. In this example, the stationary linear actuators 1394 are orthogonal to the stationary linear actuator 1352 of the wind-off subassembly 1308. Accordingly, the stationary linear actuators 1394 allow for a rotary actuator 1406 interconnected to the linear actuator 1402 to selectively move in the directions of Arrows D and F. The rotary actuator 1406 is configured to rotate the wind-on spool along an arc indicated by Arrow C", about an axis parallel to an axis defined by Arrow C or C'. A frame 1410 that supports the wind-on spool 1332 is interconnected to the rotary actuator 1406. In some embodiments of the present invention, the angle between the frame 1410 and the linear actuator 1402 can be selectively altered to change the orientation of the wind-on spool 1332. Some embodiments of the invention include a goniometer 1412 associated with the rotary actuator 1406 adapted to precisely guide the frame's angular orientation.

In operation, the wind-on spool 1332 is caused to move through a series of orientations conducive to producing desired wound output configuration. Operations within the wind-off subassembly and the follower subassembly support placement of the linear media at the wind-on point. Linear media 1320 is taken from the wind-off spool 1324 and directed upwardly to the tensiometer 1328. As mentioned above, the linear media 1320 is also positioned between guides 1383 of the turning fork 1382. The linear media then travels downwardly and contacts the wind-on spool 1332 at the wind-on point 1390. The guide rods 1388 control the position of the linear media as it engages the wind-on spool 1332. System control of linear and rotary actuators maintains the linear media 1320 in a wind angle plane, which is generally vertical, as shown in the FIGS. 29-32. The wind angle plane's angle is defined by the linear media's path from the wind-off spool 1324 to the wind-on spool 1332, and varies according to a desired direction of the wind-on point 1390. Again, the turning fork 1382 is aligned with the wind angle plane, and the linear media 1320 is held between the parallel guides 1383 of the turning fork 1382. Feedback from the turning fork sensor accommodates winding linear media off of a spool with axial width greater than the linear media width while maintaining the linear media path in the wind angle plane. As the wind-off point moves out of the wind angle plane, the linear media held within the turning fork guides causes it to turn and its sensor indication is used to command linear actuator 1344 to move the wind-off spool and therefore the wind-off point until the linear media and turning fork are again centered in the wind angle plane. Guiding the linear media in this way and along this path guarantees no reverse bends and allows only one bend of a minimum diameter around the tensiometer wheel 1328 before the linear media reaches the wind-on point 1390.

The linear media's formation onto the wind-on spool 1332 and all other motion in the winding machine 1300 precipitates from initially moving the wind-on spool 1332. The linear actuators 1394 and 1402 move the wind-on spool 1332 in orthogonal horizontal directions while the rotary actuator 1406 moves the wind-on spool 1332 about a vertical axis. For more complex outputs, simultaneous with other motions, winding arc rotation (i.e., selective tilting) of the wind-on spool 1332 can be accomplished by the goniometer 1412. For cylindrical arc rotation, the goniometer 1412 can be exchanged with gearing as shown in FIG. 12 (reference number 1208).

OVERALL DESCRIPTION

Although the description of some embodiments of the present invention above is mainly directed at a superconductor wire, tape and cable, it should be recognized that the invention could be applicable to any linear media and in particular delicate linear media. As used herein, the term "delicate linear media" will include advanced superconducting wire and tape, very fine conventional wire, filamentary linear materials, fiber optic wire, thin strands of carbon-based fiber, smart fabrics, and extremely dense fine fiber matrices. Further, the present invention can be applied not only to coil and cable winding but also to any other delicate media handling process including but not limited to media insulating, bending, braiding, forming, splicing, heat or chemical treatment such as reacting, encapsulation, inspecting, and any manual or automated process that requires handling the media safely. As used herein, the terms "wire," "tape," "cable," and "media" are used interchangeably. Some embodiments of the present invention can be applied to allow an automatic winding (or other similar) process. Also, the term "spool" is used herein to refer to any object onto which the delicate liner media is wound, regardless of the object's shape. Industry language commonly refers to a wind-off spool as "spool" and wind-on spool as "former" or "bobbin," and those terms may also be used interchangeably herein. Whenever the terms "automatic," "automated," or similar terms are used herein, those terms will be understood to include manual initiation of the automatic or automated process or step.

It should also be recognized that embodiments of the present invention can be implemented via computer hardware or software, or a combination of both. The methods can be implemented in computer programs using standard programming techniques-including a computer-readable storage medium configured with a computer program, where the storage medium so configured causes a computer to operate in a specific and predefined manner according to the methods and figures described in this Specification. Each program may be implemented in a high level procedural or object-oriented programming language to communicate with a computer system. However, the programs can be implemented in assembly or machine language, if desired. In any case, the language can be a compiled or interpreted language. Moreover, the program can run on dedicated integrated circuits programmed for that purpose.

Further, methodologies may be implemented in any type of computing platform, including but not limited to, personal computers, mini-computers, main-frames, workstations, networked or distributed computing environments, computer platforms separate, integral to, or in communication with charged particle tools or other imaging devices, and the like. Aspects of the present invention may be implemented in machine readable code stored on a storage medium or device, whether removable or integral to the computing platform, such as a hard disc, optical read and/or write storage mediums, RAM, ROM, and the like, so that it is readable by a programmable computer, for configuring and operating the computer when the storage media or device is read by the computer to perform the procedures described herein. The invention described herein includes these and other various types of computer-readable storage media when such media contain instructions or programs for implementing the steps described above in conjunction with a microprocessor or other data processor. The invention also includes the computer itself when programmed according to the methods and techniques described herein.

The invention has broad applicability and can provide many benefits as described and shown in the examples above. The embodiments will vary greatly depending upon the specific application, and not every embodiment will provide all the benefits and meet all of the objectives that are achievable by the invention. In the previous discussion and in the claims, the terms "including" and "comprising" are used in an open-ended fashion, and thus should be interpreted to mean "including, but not limited to . . . ." To the extent that any term is not specially defined in this specification, the intent is that the term is to be given its plain and ordinary meaning. The accompanying drawings are intended to aid in understanding the present invention and, unless otherwise indicated, are not drawn to scale.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Exemplary characteristics of embodiments of the present invention have been described. However, to avoid unnecessarily obscuring embodiments of the present invention, the preceding description may omit several known apparatus, methods, systems, structures, and/or devices one of ordinary skill in the art would understand are commonly included with the embodiments of the present invention. Such omissions are not to be construed as a limitation of the scope of the claimed invention. Specific details are set forth to provide an understanding of some embodiments of the present invention. It should, however, be appreciated that embodiments of the present invention may be practiced in a variety of ways beyond the specific detail set forth herein.

Modifications and alterations of the various embodiments of the present invention described herein will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. That is, the embodiments of the invention described herein are capable of being practiced or of being carried out in various ways. The scope of the various embodiments described herein is indicated by the following claims rather than by the foregoing description. And all changes which come within the meaning and range of equivalency of the claims are to be embraced within their scope. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The foregoing disclosure is not intended to limit the invention to the form or forms disclosed herein. In the foregoing Detailed Description, for example, various features of the invention are grouped together in one or more embodiments for the purpose of streamlining the disclosure. This method of disclosure is not to be interpreted as reflecting an intention that the claimed inventions require more features than expressly recited. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention. Further, the embodiments of the present invention described herein include components, methods, processes, systems, and/or apparatus substantially as depicted and described herein, including various sub-combinations and subsets thereof. Accordingly, one of skill in the art will appreciate that would be possible to provide for some features of the embodiments of the present invention without providing others. Stated differently, any one or more of the aspects, features, elements, means, or embodiments as disclosed herein may be combined with any one or more other aspects, features, elements, means, or embodiments as disclosed herein.

What is claimed is:

1. A winding machine, comprising:

a wind-off spool adapted to carry linear media;

a wind-on spool adapted to receive the linear media;

a follower subassembly positioned between the wind-off spool and the wind-on spool, comprising:

at least one actuator associated with at least one wind-on guide subassembly, the at least one actuator configured to selectively impart lateral motion, transverse motion, or a combination thereof relative to the wind-on spool onto the at least one wind-on guide subassembly, the at least one wind-on guide subassembly comprising:

a rotary guide actuator, a linear guide actuator operably interconnected to the rotary guide actuator, a wind-on guide operably interconnected to the linear guide actuator, wherein the linear guide actuator provides at least selective movement of an end of the wind-on guide towards or away from the wind-on spool, wherein the rotary guide actuator provides selective arcuate translation of the end of the wind-on guide; and wherein the linear media is taken from the wind-off spool and wound onto the wind-on spool to form a magnet, cable, or cable magnet, and wherein selective movement of the linear guide actuator or the rotary guide actuator controls the position of the linear media as it is placed on the wind-on spool.

2. The winding machine of claim 1, wherein the at least one actuator of the at least one wind-on guide subassembly comprises a linear actuator that provides selective transverse motion relative to the wind-on spool.

3. The winding machine of claim 2, wherein the at least one actuator of the at least one wind-on guide subassembly comprises a rotary actuator associated with the linear actuator that provides transverse motion that selectively allows the at least one wind-on guide subassembly to move about an access orthogonal to the direction of lateral and transverse movement.

4. The winding machine of claim 1, wherein the at least one actuator of the at least one wind-on guide subassembly comprises a rotary actuator associated with the wind-on spool that selectively allows the wind-on spool to move about an axis orthogonal to the direction of lateral and transverse movement.

5. The winding machine of claim 1, wherein the wind-on guide is comprised of a straight or angled rod, employs a wheel, possesses a cone-shaped end, or possess an arcuate end.

6. The winding machine of claim 1, wherein at least one wind-on guide subassembly comprises a first wind-on guide subassembly with a first wind-on guide and a second wind-on guide subassembly with a second wind-on guide, wherein the first wind-on guide contains the linear media and the second wind-on guide urges the linear media onto the wind-on spool.

7. The winding machine of claim 1, wherein the wind-on spool is associated with a device that provides winding arc rotation, thereby allowing the wind-on spool to selectively tilt.

8. The winding machine of claim 1, wherein the linear media is superconducting wire, tape, or cable that does not pass through any reverse bends.

9. The winding machine of claim 1, further comprising at least one sensor configured to identify when the linear media has dropped out of a superconducting domain.

10. The winding machine of claim 1, wherein the wind-on guide employs a sensor configured to sense at least one of a linear media position, a linear media orientation, a wind-on spool position, and a wind-on spool orientation.

11. The winding machine of claim 1, further comprising a tension controlling device located between the wind-off spool and the follower subassembly, or within the follower subassembly, or between the follower subassembly and the wind-on spool, the tension controlling device that selectively contacts the linear media to maintain a desired tension to allow for repair of the linear media, removal of a length of linear media, or addition of a new wind-off spool.

12. The winding machine of claim 1, further comprising a sensor or a turning fork ending in parallel guides adapted to receive the linear media that monitor the position of the linear media to maintain the linear media in a predefined plane as it travels from the wind-off spool to the wind-on spool.

13. The winding machine of claim 1, further comprising a first motor configured to turn the wind-off spool, a second motor configured to turn the wind-on spool, and a system controller that receives sensed axial tension and controls the speed of the first motor or second motor to maintain a desired axial tension in the linear media.

14. The winding machine of claim 13, wherein the system controller employs active control loops to provide a means for varying tension, location, pitch, or wind-on angle of the linear media as it is placed on the wind-on spool.

15. The winding machine of claim 14, wherein the system controller incorporates an angle and position on/off wind that allows a continuous or changing angle and linear position from the wind-off spool.

16. A winding machine for use with linear media, comprising:

a linear media supply spool adapted to store the linear media and from which linear media is removed;

a cable core, magnet, or cable magnet associated with a wind-off spool;

at least one motor that translates the cable core, magnet, or cable magnet, thereby transferring the cable core, magnet, or cable magnet onto a wind-on spool, a wrapping station configured to wrap linear media strands from the linear media supply spool onto the cable core, magnet, or cable magnet; and a component integration station that adds a component to the cable core, magnet, or cable magnet before, during, or after the cable core, magnet, or cable magnet is wound onto the wind-on spool or a former.

17. The winding machine of claim 16, wherein the component is a power electronics device, a sensor, an injected material, or an energy storage element, and wherein incorporation onto or into the cable core, magnet or cable magnet is achieved by a spiral wrap winding or similar process for a finite, intermittent, or complete cable length.

18. The winding machine of claim 16, wherein the component comprises a first integrated component and a second integrated component, and wherein the first integrated component is placed in a non-cryogenic region of the cable core, magnet, or cable magnet, and the second integrated component is placed in a cryogenic region of the cable core, magnet, or cable magnet.

19. The winding machine of claim 16, wherein the component is cryogenically cooled.

20. The winding machine of claim 16, wherein the component connects directly to the cable core, magnet, or cable magnet power transmission or operation conducting media.

* * * * *